US010836199B2

(12) United States Patent
Holmes et al.

(10) Patent No.: US 10,836,199 B2
(45) Date of Patent: Nov. 17, 2020

(54) SECURITY DEVICES

(71) Applicant: DE LA RUE INTERNATIONAL LIMITED, Hampshire (GB)

(72) Inventors: Brian William Holmes, Hampshire (GB); John Godfrey, London (GB); Robert Whiteman, Berkshire (GB)

(73) Assignee: DE LA RUE INTERNATIONAL LIMITED, Basingstoke (GB)

( * ) Notice: Subject to any disclaimer, the term of this patent is extended or adjusted under 35 U.S.C. 154(b) by 0 days.

(21) Appl. No.: 16/333,153

(22) PCT Filed: Sep. 29, 2017

(86) PCT No.: PCT/GB2017/052928
§ 371 (c)(1),
(2) Date: Mar. 13, 2019

(87) PCT Pub. No.: WO2018/060726
PCT Pub. Date: Apr. 5, 2018

(65) Prior Publication Data

US 2019/0232708 A1 Aug. 1, 2019

(30) Foreign Application Priority Data

Sep. 30, 2016 (GB) ..... 1616615.9

(51) Int. Cl.
*B42D 25/324* (2014.01)
*B42D 25/45* (2014.01)
(Continued)

(52) U.S. Cl.
CPC ..... *B42D 25/324* (2014.10); *B42D 25/351* (2014.10); *B42D 25/373* (2014.10);
(Continued)

(58) Field of Classification Search
CPC .. B42D 25/324; B42D 25/455; B42D 25/351; B42D 25/47; B42D 25/373; B42D 25/45
(Continued)

(56) References Cited

U.S. PATENT DOCUMENTS 4,892,336 A 1/1990 Kaule et al.
6,856,462 B1 2/2005 Scarbrough et al.
(Continued)

FOREIGN PATENT DOCUMENTS

EP 0 059 056 A1 9/1982
EP 0 860 298 A2 8/1998
(Continued)

OTHER PUBLICATIONS

Jan. 23, 2018 Invitation to Pay Additional Fees and Partial Search Report issued in International Patent Application No. PCT/GB2017/052928.
(Continued)

*Primary Examiner* — Justin V Lewis
(74) *Attorney, Agent, or Firm* — Oliff PLC

(57) ABSTRACT

A security device is disclosed, comprising an array of focussing elements with regular periodicity in at least a first direction, each focusing element having an optical footprint of which different portions will be directed to the viewer in dependence on the viewing angle; and an array of image elements with regular periodicity in at least the first direction overlapping the array of focusing structures, the image elements representing portions of at least two respective images, and at least one image element from each respective image being located in the optical footprint of each focusing structure. The security device includes a first region and a second region which is laterally offset from the first, the image elements in the first region being laterally shifted in at least the first direction relative to the image elements in
(Continued)

the second region such that, at a first viewing angle, in the first region of the device the focussing structures direct image elements corresponding to a first image to the viewer such that the first image is displayed across the first region of the device, and simultaneously, in the second region of the device, the focussing structures direct image elements corresponding to a second image to the viewer such that the second image is displayed across the second region of the device, and at a second viewing angle the second image is displayed across the first region of the device and simultaneously the first image is displayed across the second region of the device. The security device further comprises a colour filter located in use between the image elements and the viewer, the colour filter overlapping at least part of the array of focussing elements and the array of image elements, and having a first colour in the first region of the device and a different colour in the second region of the device such that the colour appearance of the first and second images is different in the respective first and second regions of the device.

17 Claims, 25 Drawing Sheets

(51) Int. Cl.
*B42D 25/351* (2014.01)
*B42D 25/455* (2014.01)
*B42D 25/47* (2014.01)
*B42D 25/373* (2014.01)

(52) U.S. Cl.
CPC ..... *B42D 25/45* (2014.10); *B42D 25/455* (2014.10); *B42D 25/47* (2014.10)

(58) Field of Classification Search
USPC ..... 283/67, 70, 72, 74, 87, 94, 98, 901
See application file for complete search history.

(56) References Cited

U.S. PATENT DOCUMENTS

| | | | | |
|---|---|---|---|---|
| 2008/0160226 | A1 | 7/2008 | Kaule et al. | |
| 2009/0297805 | A1 | 12/2009 | Dichtl | |
| 2013/0038942 | A1 | 2/2013 | Holmes | |
| 2014/0103632 | A1* | 4/2014 | Camus | D21H 21/42 283/67 |
| 2015/0360453 | A1 | 12/2015 | Lundvall | |

FOREIGN PATENT DOCUMENTS

| | | | |
|---|---|---|---|
| EP | 0 987 599 | A2 | 3/2000 |
| EP | 1 398 174 | A1 | 3/2004 |
| EP | 1 695 121 | B1 | 6/2014 |
| FR | 2 976 954 | A1 | 12/2012 |
| GB | 2503783 | A | 1/2014 |
| GB | 2517079 | A | 2/2015 |
| GB | 2518286 | A | 3/2015 |
| GB | 2539390 | A | 12/2016 |
| WO | 83/00659 | A1 | 3/1983 |
| WO | 94/27254 | A1 | 11/1994 |
| WO | 95/10419 | A1 | 4/1995 |
| WO | 95/10420 | A1 | 4/1995 |
| WO | 00/39391 | A1 | 7/2000 |
| WO | 03/054297 | A2 | 7/2003 |
| WO | 03/095188 | A2 | 11/2003 |
| WO | 2005/052650 | A2 | 6/2005 |
| WO | 2005/106601 | A2 | 11/2005 |
| WO | 2005/115119 | A2 | 12/2005 |
| WO | 2011/051669 | A1 | 5/2011 |
| WO | 2011/051670 | A2 | 5/2011 |
| WO | 2011/102800 | A1 | 8/2011 |
| WO | 2011/107782 | A1 | 9/2011 |
| WO | 2011/107783 | A1 | 9/2011 |
| WO | 2012/027779 | A1 | 3/2012 |
| WO | 2014/070079 | A1 | 5/2014 |
| WO | 2015/034551 | A1 | 3/2015 |
| WO | 2016/016638 | A1 | 2/2016 |
| WO | 2017/009616 | A1 | 1/2017 |
| WO | 2017/009617 | A1 | 1/2017 |
| WO | 2017/009622 | A1 | 1/2017 |

OTHER PUBLICATIONS

Sep. 29, 2017 Search Report issued in British Patent Application No. 1616615.9 for claims 20 and dependent.
Sep. 29, 2017 Search Report issued in British Patent Application No. 1616615.9 for claims 10, 17 and dependent.
Oct. 2, 2017 Search Report issued in British Patent Application No. 1616615.9 for claims 51-56.
Mar. 31, 2017 Combined Search and Examination Report issued in British Patent Application No. 1616615.9.
Mar. 16, 2018 International Search Report issued in International Application No. PCT/GB2017/052928.
Mar. 16, 2018 Written Opinion issued in International Application No. PCT/GB2017/052928.

* cited by examiner

SECURITY DEVICES

This invention relates to security devices. Security devices are used for example on documents of value such as banknotes, cheques, passports, identity cards, certificates of authenticity, fiscal stamps and other secure documents, in order to confirm their authenticity. Methods for their manufacture will also be described.

Articles of value, and particularly documents of value such as banknotes, cheques, passports, identification documents, certificates and licences, are frequently the target of counterfeiters and persons wishing to make fraudulent copies thereof and/or changes to any data contained therein. Typically such objects are provided with a number of visible security devices for checking the authenticity of the object. By "security device" we mean a feature which it is not possible to reproduce accurately by taking a visible light copy, e.g. through the use of standardly available photocopying or scanning equipment. Examples include features based on one or more patterns such as microtext, fine line patterns, latent images, venetian blind devices, lenticular devices, moiré interference devices and moiré magnification devices, each of which generates a secure visual effect. Other known security devices include holograms, watermarks, embossings, perforations and the use of colour-shifting or luminescent/fluorescent inks. Common to all such devices is that the visual effect exhibited by the device is extremely difficult, or impossible, to copy using available reproduction techniques such as photocopying. Security devices exhibiting non-visible effects such as magnetic materials may also be employed.

One class of security devices are those which produce an optically variable effect, meaning that the appearance of the device is different at different angles of view. Such devices are particularly effective since direct copies (e.g. photocopies) will not produce the optically variable effect and hence can be readily distinguished from genuine devices. Optically variable effects can be generated based on various different mechanisms, including holograms and other diffractive devices, moiré interference and other mechanisms relying on parallax such as venetian blind devices, and also devices which make use of focusing elements such as lenses, including moiré magnifier devices, integral imaging devices and so-called lenticular devices.

Moiré magnifier devices (examples of which are described in EP-A-1695121, WO-A-94/27254, WO-A-2011/107782 and WO2011/107783) make use of an array of focusing elements (such as lenses or mirrors) and a corresponding array of microimages, wherein the pitches of the focusing elements and the array of microimages and/or their relative locations are mismatched with the array of focusing elements such that a magnified version of the microimages is generated due to the moiré effect. Each microimage is a complete, miniature version of the image which is ultimately observed, and the array of focusing elements acts to select and magnify a small portion of each underlying microimage, which portions are combined by the human eye such that the whole, magnified image is visualised. This mechanism is sometimes referred to as "synthetic magnification". The magnified array appears to move relative to the device upon tilting and can be configured to appear above or below the surface of the device itself. The degree of magnification depends, inter alia, on the degree of pitch mismatch and/or angular mismatch between the focusing element array and the microimage array.

Integral imaging devices are similar to moiré magnifier devices in that an array of microimages is provided under a corresponding array of lenses, each microimage being a miniature version of the image to be displayed. However here there is no mismatch between the lenses and the microimages. Instead a visual effect is created by arranging for each microimage to be a view of the same object but from a different viewpoint. When the device is tilted, different ones of the images are magnified by the lenses such that the impression of a three-dimensional image is given.

"Hybrid" devices also exist which combine features of moiré magnification devices with those of integral imaging devices. In a "pure" moiré magnification device, the microimages forming the array will generally be identical to one another. Likewise in a "pure" integral imaging device there will be no mismatch between the arrays, as described above. A "hybrid" moiré magnification/integral imaging device utilises an array of microimages which differ slightly from one another, showing different views of an object, as in an integral imaging device. However, as in a moiré magnification device there is a mismatch between the focusing element array and the microimage array, resulting in a synthetically magnified version of the microimage array, due to the moiré effect, the magnified microimages having a three-dimensional appearance. Since the visual effect is a result of the moiré effect, such hybrid devices are considered a subset of moiré magnification devices for the purposes of the present disclosure. In general, therefore, the microimages provided in a moiré magnification device should be substantially identical in the sense that they are either exactly the same as one another (pure moiré magnifiers) or show the same object/scene but from different viewpoints (hybrid devices).

Moiré magnifiers, integral imaging devices and hybrid devices can all be configured to operate in just one dimension (e.g. utilising cylindrical lenses) or in two dimensions (e.g. comprising a 2D array of spherical or aspherical lenses).

Lenticular devices on the other hand do not rely upon magnification, synthetic or otherwise. An array of focusing elements, typically cylindrical lenses, overlies a corresponding array of image sections, or "slices", each of which depicts only a portion of an image which is to be displayed. Image slices from two or more different images are interleaved and, when viewed through the focusing elements, at each viewing angle, only selected image slices will be directed towards the viewer. In this way, different composite images can be viewed at different angles. However it should be appreciated that no magnification typically takes place and the resulting image which is observed will be of substantially the same size as that to which the underlying image slices are formed. Some examples of lenticular devices are described in U.S. Pat. No. 4,892,336, WO-A-2011/051669, WO-A-2011051670, WO-A-2012/027779 and U.S. Pat. No. 6,856,462. More recently, two-dimensional lenticular devices have also been developed and examples of these are disclosed in British patent application numbers 1313362.4 and 1313363.2. Lenticular devices have the advantage that different images can be displayed at different viewing angles, giving rise to the possibility of animation and other striking visual effects which are not possible using the moiré magnifier or integral imaging techniques.

Security devices such as moiré magnifiers, integral imaging devices and lenticular devices depend for their success significantly on the resolution with which the image array (defining for example microimages, interleaved image sections or the like) can be formed. Since the security device must be thin in order to be incorporated into a document such as a banknote, the focusing elements must also be thin, which by their nature also limits their lateral dimensions. For example, lenses used in such security elements preferably have a width or diameter of 50 microns or less, e.g. 30 microns. In a lenticular device this leads to the requirement that each image element must have a width which is at most half the lens width. For example, in a "two channel" lenticular switch device which displays only two images (one across a first range of viewing angles and the other across the remaining viewing angles), where the lenses are of 30 micron width, each image section must have a width of 15 microns or less. More complicated lenticular effects such as animation, motion or 3D effects usually require more than two interlaced images and hence each section needs to be even finer in order to fit all of the image sections into the optical footprint of each lens. For instance, in a "six channel" device with six interlaced images, where the lenses are of 30 micron width, each image section must have a width of 5 microns or less.

Similarly high-resolution image elements are also required in moiré magnifiers and integral imaging devices since approximately one microimage must be provided for each focusing element and again this means in effect that each microimage must be formed within a small area of e.g. 30 by 30 microns. In order for the microimage to carry any detail, fine linewidths of 5 microns or less are therefore highly desirable.

Typical processes used to manufacture image patterns for security devices are based on printing and include intaglio, gravure, wet lithographic printing as well as dry lithographic printing. The achievable resolution is limited by several factors, including the viscosity, wettability and chemistry of the ink, as well as the surface energy, unevenness and wicking ability of the substrate, all of which lead to ink spreading. With careful design and implementation, such techniques can be used to print pattern elements with a line width of between 25 μm and 50 μm. For example, with gravure or wet lithographic printing it is possible to achieve line widths down to about 15 μm.

Methods such as these are limited to the formation of single-colour image elements, since it is not possible to achieve the high registration required between different workings of a multi-coloured print. In the case of a lenticular device for example, the various interlaced image sections must all be defined on a single print master (e.g. a gravure or lithographic cylinder) and transferred to the substrate in a single working, hence in a single colour. The various images displayed by the resulting security device will therefore be monotone, or at most duotone if the so-formed image elements are placed against a background of a different colour.

One approach which has been put forward as an alternative to the printing techniques mentioned above is used in the so-called Unison Motion™ product by Nanoventions Holdings LLC, as mentioned for example in WO-A-2005052650. This involves creating pattern elements ("icon elements") as recesses in a substrate surface before spreading ink over the surface and then scraping off excess ink with a doctor blade. The resulting inked recesses can be produced with line widths of the order of 2 μm to 3 μm. This high resolution produces a very good visual effect, but the process is complex and expensive. Further, limits are placed on the minimum substrate thickness by the requirement to carry recesses in its surface. Again, this technique is only suitable for producing image elements of a single colour.

Some more methods for generating patterns or micropatterns (i.e. image arrays) on a substrate are known from US 2009/0297805 A1 and WO 2011/102800 A1. These disclose methods of forming micropatterns in which a die form or matrix is provided whose surface comprises a plurality of recesses. The recesses are filled with a curable material, a treated substrate layer is made to cover the recesses of the matrix, the material is cured to fix it to the treated surface of the substrate layer, and the material is removed from the recesses by separating the substrate layer from the matrix.

Another method of forming a micropattern is disclosed in WO 2014/070079 A1. Here it is taught that a matrix is provided whose surface comprises a plurality of recesses, the recesses are filled with a curable material, and a curable pickup layer is made to cover the recesses of the matrix. The curable pickup layer and the curable material are cured, fixing them together, and the pickup later is separated from the matrix, removing the material from the recesses. The pickup layer is, at some point during or after this process, transferred onto a substrate layer so that the pattern is provided on the substrate layer.

Other approaches involve the patterning of a metal layer through the use of a photosensitive resist material and exposing the resist to appropriate radiation through a mask. Depending on the nature of the resist material, exposure to the radiation either increases or decreases its solubility in certain etchants, such that the pattern on the mask is transferred to the metal layer when the resist-covered metal substrate is subsequently exposed to the etchant. For instance, EP-A-0987599 discloses a negative resist system in which the exposed photoresist becomes insoluble in the etchant upon exposure to ultraviolet light. The portions of the metal layer underlying the exposed parts of the resist are thus protected from the etchant and the final pattern formed in the metal layer is the "negative" of that carried on the mask. In contrast, our British patent application no. 1510073.9 discloses a positive resist system in which the exposed photoresist becomes more soluble in the etchant upon exposure to ultraviolet light. The portions of the metal layer underlying the unexposed parts of the resist are thus protected from the etchant and the final pattern formed in the metal layer is the same as that carried on the mask. Methods such as these offer good pattern resolution, but still impose restrictions on the number and arrangement of colours that can be exhibited.

Security devices with new and distinctive appearances are constantly sought in order to keep ahead of would-be counterfeiters.

In accordance with a first aspect of the present invention, a security device comprises:

an array of focussing elements with regular periodicity in at least a first direction, each focusing element having an optical footprint of which different portions will be directed to the viewer in dependence on the viewing angle; and an array of image elements with regular periodicity in at least the first direction overlapping the array of focusing structures, the image elements representing portions of at least two respective images, and at least one image element from each respective image being located in the optical footprint of each focusing structure;

wherein the security device includes a first region and a second region which is laterally offset from the first, the image elements in the first region being laterally shifted in at least the first direction relative to the image elements in the second region such that, at a first viewing angle, in the first region of the device the focussing structures direct image elements corresponding to a first image to the viewer such that the first image is displayed across the first region of the device, and simultaneously, in the second region of the device, the focussing structures direct image elements corresponding to a second image to the viewer such that the second image is displayed across the second region of the device, and at a second viewing angle the second image is displayed across the first region of the device and simultaneously the first image is displayed across the second region of the device;

and where the security device further comprises a colour filter located in use between the image elements and the viewer, the colour filter overlapping at least part of the array of focussing elements and the array of image elements, and having a first colour in the first region of the device and a different colour in the second region of the device such that the colour appearance of the first and second images is different in the respective first and second regions of the device.

In common with other aspects of the present invention to be described below, the security device here comprises a colour filter which introduces additional colour effects, and hence imparts a new and more complex appearance to the device. As will be detailed hereinafter, the colour filter could be provided as an extra component additional to those mentioned already but could alternatively be incorporated into one of the existing components, such as the focussing element array itself. What is important is that the colour filter sits between the image array and the viewer in use so as to modify the apparent colour of the image array. The colour filter will typically be formed of transparent materials at least one of which contains a visibly coloured tint so that only selected wavelengths of the visible spectrum are transmitted therethrough.

The device is divided into at least first and second (and optionally further) regions which are laterally offset from one another meaning in this context that they occupy different portions (non-overlapping) of the device area. The colour filter is of a different colour in the first region as compared with in the second region. The term "colour" is used herein to denote any hue which is recognisable to human vision, including achromatics such as black, grey, white, silver and the like, as well as chromatics such as red, green, blue, orange etc. One of the regions of the colour layer could also be colourless (i.e. not modify the apparent colour of the image elements transmitted therethrough) since this will be distinguishable to the human eye from the neighbouring region(s) and therefore have the desired effect of forming a more complex security effect across the device as a whole. These considerations apply to all aspects of the presently disclosed invention.

It will be appreciated that there may be any number of regions each with different phase shifts and similarly more than two images may be provided. For instance, a third region may simultaneously display a third image.

In this first aspect of the invention, the security device is a lenticular device which will display different images at different viewing angles. Each image could take any desirable form, e.g. a uniform block colour, indicia such as alphanumerical text, a line pattern or any other graphic. The array of image elements is configured to co-operate with the focussing elements to generate the optically variable lenticular effect across the device. However, in the first region of the device the arrangement of image elements is laterally shifted ("phase shifted") relative to the arrangement of image elements in the second region. This has the result that the device will display different ones of the images in the first and second regions respectively, simultaneously (i.e. at one viewing angle). By arranging the different images to be displayed in the same two respective regions as those in which the colour of the colour layer differs, a particularly complex optical effect is achieved since each region will display the same two images but at different viewing angles and, significantly, in different colours for each region. The register required between the colour layer and the image element array to achieve this presents a significant challenge to the would-be counterfeiter and any mis-register will be readily apparent. Further, imitating the end result through other means will also be extremely difficult: for example, producing the image elements in different colours in the first and second regions would require a multi-coloured image array which as discussed above presents substantial manufacturing obstacles.

In preferred embodiments, the image array comprises a set of monochromatic image elements corresponding to the first image in the first and second regions of the device. That is, the first image elements are of the same colour in both regions. As mentioned above forming a monochromatic image array simplifies the manufacturing process since a relatively wide range of suitable printing techniques and the like are available. In some preferred embodiments, the monochromatic image elements are substantially opaque and preferably reflective, e.g. formed of a dark material such as black ink or of a metal layer such as aluminium, which is particularly well suited to viewing in reflect light. In other preferred implementations, the monochromatic image elements are semi-transparent or translucent in which case the device may be best suited to viewing in transmission. Advantageously, the colour of the monochromatic image elements is different to the colours of the colour filter in both the first and second regions of the device. This will give rise to a greater number of colours visible from the end device as a whole. In other preferred implementations, the colour of the monochromatic image elements substantially matches the colour of the colour filter in one of the first and second regions of the device. This can give rise to additional security effects as discussed in relation to the second aspect of the invention below.

In some preferred embodiments, the image elements corresponding to the second image are defined by colourless gaps between the monochromatic image elements corresponding to the first image. Thus the second image will be a uniform block area with a colour determined solely by the colour filter, which will lead to different appearances thereof in the first and second regions. In other preferred embodiments, the image elements corresponding to the second image are defined by a second set of monochromatic image elements in the first and second regions of the device having a different colour from those corresponding to the first image. This can be used to introduce yet further colours and hence increase the complexity of the device still further.

The security device could be a one-dimensional or two-dimensional lenticular device. In the former case, the array of focussing elements preferably comprises an array of elongate focussing element structures extending along a second direction which is orthogonal to the first direction, and the image elements comprise elongate image slices extending along the second direction. The elongate focussing element structures could be individual elongate focussing elements such as cylindrical lenses or could each be formed of a plurality of focussing elements which need not individually be elongate, e.g. spherical lenses. For a two-dimensional lenticular device the focussing element array may comprise spherical or aspherical focussing elements arranged on an orthogonal or hexagonal grid for instance, and the image elements could be e.g. dots or squares.

A second aspect of the present invention provides a security device, comprising:

an array of focussing elements with regular periodicity in at least a first direction, each focusing element having an optical footprint of which different portions will be directed to the viewer in dependence on the viewing angle; and a corresponding first image array overlapping the array of focussing elements and configured to co-operate with the array of focussing elements so as to generate a first optically variable effect which varies with viewing angle, the first image array comprising a periodic arrangement of image elements or microimages formed in a first colour across the security device;

wherein the security device further comprises a colour filter located in use between the first image array and the viewer, the colour filter overlapping at least part of the array of focussing elements and the first image array, and having different colours in respective first and second regions of the device which are laterally offset from one another, the colour of the colour filter layer in the first region of the device substantially matching the first colour of the image elements or microimages.

Again, the colour filter can be provided in various different ways as mentioned above in relation to the first aspect of the invention. By matching the colour of the colour filter to that of the image elements or microimages in a first region of the device, various new optical effects can be achieved as a result of effectively reducing or removing the colour contrast between the image elements or microimages and their surroundings. The effects can take the form of changing the number of colours that are displayed by the device, or even inhibiting the first optically variable effect in the first region. It should be noted that the security device of the second aspect of the invention is not limited to operating as a lenticular device but alternatively be a moiré magnification device or a moiré magnifier, for example.

Hence in a first preferred embodiment, the first image array further comprises a background surrounding the image elements or microimages which is substantially colourless. For instance the background might be reflective uniformly across substantially all visible wavelengths (e.g. white or mirror-like silver), or could be optically clear (i.e. transparent with no visible tint). In this way the colour layer in the first region will effectively conceal the image elements or microimages since they will appear in the same colour as the background. As a result the first optically variable effect is exhibited in the second region and substantially not in the first region. This has the strong benefit that the effective optically active zone of the device can be controlled through design of the colour filter alone and does not require modification to the image array or focussing element array.

In other cases it may be preferred if the first image array further comprises a background surrounding the image elements or microimages which is of a second colour, the colour of the colour filter layer in the second region of the device substantially matching the second colour. Such arrangements can be utilised to generate additional colours as the device is tilted of which examples will be given below.

In an especially preferred embodiment, the security device further comprises a second image array overlapping the array of focussing elements and configured to co-operate with the array of focussing elements so as to generate a second optically variable effect which varies with viewing angle, the second image array comprising a periodic arrangement of image elements or microimages formed in a second colour across the security device. Both the first and second image arrays can, if desired, extend across the whole area of the device. If the background is colourless, as mentioned above, in the first region the first image array will effectively be inhibited whilst the second image array will be visible since its elements or microimages will not match the colour of the colour filter and hence will show a contrast with their surroundings. The colour of the second image array could differ from both the colours of the colour filter in the first and second regions in which case the second optically variable effect will be visible in both regions. However, most preferably, the colour of the colour filter layer in the second region of the device substantially matches the second colour of the image elements or microimages. Hence preferably, in the second region of the device the image elements or microimages are substantially concealed from view by the matching colours of the image elements or microimages and the colour filter, such that the second optically variable effect is exhibited in the first region and substantially not in the second region.

In this way the optically active areas of the device can be defined by the lateral arrangement of the colour filter alone, which is used to selectively inhibit the optical effect generated by one image array in one region so that another dominates the appearance there, and vice versa in other region(s) of the device. The optically variable effects generated by each image array could be of the same type (e.g. lenticular or moiré magnifier) or could be a mixture of different types. In the case of multiple lenticular devices, the images incorporated into each image array could be the same or different, and likewise in the case of multiple moiré magnifier devices or similar the microimages could be the same or different. The apparent depth and magnification level of a moiré magnified image could also be different for the two image arrays, achieved by selecting a different pitch or rotational orientation for each array.

A third aspect of the present invention provides a security device, comprising:

an array of focussing elements with regular periodicity in at least a first direction, each focusing element having an optical footprint of which different portions will be directed to the viewer in dependence on the viewing angle; and a corresponding first image array overlapping the array of focussing elements and configured to co-operate with the array of focussing elements so as to generate a first optically variable effect which varies with viewing angle, the first image array comprising a periodic arrangement of image elements or microimages formed in a first colour across the security device;

wherein the security device further comprises a colour filter located in use between the first image array and the viewer, the colour filter overlapping at least part of the array of focussing elements and the first image array, and having different colours in respective first and second regions of the device which are laterally offset from one another, the colour of the colour filter layer in the first region of the device being complementary to the first colour of the image elements or microimages.

Again, the device according to the third aspect of the invention makes use of a multi-coloured colour filter which can be provided in any of the ways mentioned above or below. In this case the colour filter includes a region in which its colour is complementary to the colour of the image elements or microimages forming the image array. A complementary colour is one which combines with its counterpart colour to effectively block the transmission of substantially all visible wavelengths. Depending on the construction of the device a number of beneficial effects can be achieved, including enhancing the visible contrast between the image elements and their surroundings so as to make the optically variable effect more distinct in the first region. This may either be in terms of the contrast between a microimage and its adjacent background (visible simultaneously) in a moiré magnifier or in terms of the contrast seen between different images (viewed sequentially) as a lenticular device is tilted, for example.

In preferred embodiments, the first image array further comprises a background surrounding the image elements or microimages which is substantially colourless. As above, this could in practice be white, reflective or clear for instance. In other preferred embodiments, the first image array further comprises a background surrounding the image elements or microimages which is of a second colour, the colour of the colour filter layer in the second region of the device being complementary to the second colour. This has the advantage of also enhancing the visibility of the optical effect in the second region.

In accordance with a fourth embodiment of the invention, a security device comprises:

an array of focussing elements with regular periodicity in at least a first direction, each focusing element having an optical footprint of which different portions will be directed to the viewer in dependence on the viewing angle; and a corresponding first image array overlapping the array of focussing elements and configured to co-operate with the array of focussing elements so as to generate a first optically variable effect which varies with viewing angle, the first image array comprising a periodic arrangement of image elements or microimages formed in a first colour across the security device;

wherein the security device further comprises:

a colour filter located in use between the first image array and the viewer, the colour filter overlapping at least part of the array of focussing elements and the first image array, and having different colours in respective first and second regions of the device which are laterally offset from one another; and a backing layer located behind the first image array such that the first image array is between the colour filter and the backing layer, the backing layer comprising at least two laterally offset areas of different colour, the backing layer being visible at least between the image elements or microimages in the first image array.

Once again, the security device of the forth aspect of the invention makes use of a colour filter located between the viewer and the image array as in the previous aspects. However in this case the device further includes a backing layer located on the other side of the image array which is also multi-coloured and so introduces yet more complex effects. The backing layer will be visible between the image elements or microimages defined by the first image array in all embodiments, and in some embodiments may also affect the apparent colour of those image elements or microimages if they are formed of a semi-transparent material. Hence in some preferred embodiments, the image elements or microimages of the first image array are substantially opaque or reflective such that the backing layer does not contribute to their colour appearance. In other preferred embodiments, the image elements or microimages of the first image array are semi-transparent such that their apparent colour (before the colour filter is taken into account) results from a combination of the first colour and the colours of the backing layer.

The arrangement of areas forming the backing layer could be independent of the arrangement of regions in the colour filter and the two components need not be registered. However, in particularly preferred cases two of the differently coloured areas of the backing layer correspond to the first and second regions of the device respectively. This further increases the security level since any mis-register between the areas and regions will be immediately apparent. The appearance of the device can be made still more complex if at least two of the differently coloured areas of the backing layer are located in each of the first and second regions of the device. Selected boundaries of the areas and regions may still coincide in order to demonstrate register.

The colours of the various areas in the backing layer could be different from those in the colour filter in order to introduce a greater number of colours to the device. However, in other preferred examples, the colours of the backing layer are the same as the colours of the colour filter.

As indicated above, the security devices of the second, third and fourth embodiments, could operate on any mechanism in which an optically variable effect is generated by the interaction between the focussing elements and the image array upon changing the viewing angle. For example, the devices could be lenticular devices, moiré magnifiers or integral imaging devices and in some cases more than one such mechanism may be incorporated in a single device as mentioned above.

Hence in some preferred embodiments, the first image array comprises a regular microimage array and the pitches of the focusing element array and of the microimage array and their relative orientations are such that the focusing element array co-operates with the microimage array to generate a magnified version of the microimage array due to the moiré effect. (Moiré magnifier)

In other preferred embodiments, the first image array comprises a regular microimage array in which the microimages all depict the same object from a different viewpoint, and the pitches and orientation of the focusing element array and of the microimage array are the same, such that the focusing element array co-operates with the microimage array to generate a magnified, optically-variable version of the object. (Integral imager)

In other preferred embodiments, the array of focussing elements has regular periodicity in at least a first direction, each focusing element having an optical footprint of which different portions will be directed to the viewer in dependence on the viewing angle; and the first image array comprises an array of image elements with regular periodicity in at least the first direction, the image elements representing portions of at least two respective images, and at least one image element from each respective image being located in the optical footprint of each focusing structure, such that, at least in a portion of the device, at a first viewing angle, the focussing structures direct image elements corresponding to a first image to the viewer such that the first image is displayed across the portion of the device, and at a second viewing angle the second image is displayed across the portion of the device. (Lenticular device)

In the case of a lenticular security device, principles of the first aspect of the invention can advantageously be combined with those of the second, third and fourth aspects. Hence, preferably, the image elements in the first region of the device are laterally shifted in at least the first direction relative to the image elements in the second region such that, at the first viewing angle, in the first region of the device the focussing structures direct image elements corresponding to the first image to the viewer such that the first image is displayed across the first region of the device, and simultaneously, in the second region of the device, the focussing structures direct image elements corresponding to the second image to the viewer such that the second image is displayed across the second region of the device, and at a second viewing angle the second image is displayed across the first region of the device and simultaneously the first image is displayed across the second region of the device, the colour appearance of the first and second images being different in the respective first and second regions of the device.

As indicated above, in all aspects of the invention the colour filter can be implemented in various different ways with substantially the same result. The colour filter may be provided as a further component in addition to those already referenced, or may be formed integrally with one or more of those components.

For instance, in a preferred embodiment, the colour filter is formed at least in part by the focussing elements of the focussing element array having different colours from one another in the respective first and second regions of the device.

In another preferred embodiment, the colour filter is formed at least in part by a pedestal layer provided between the focussing element array and a surface of a substrate on which the focussing element array is located, the pedestal layer comprising at least first and second transparent materials of different colours from one another in the respective first and second regions of the device.

In yet another preferred embodiment, the colour filter is formed at least in part by an image base layer provided between the image array and a surface of a substrate on which the image array is formed, the image base layer comprising at least first and second transparent materials of different colours from one another in the respective first and second regions of the device. In this case, the image base layer is advantageously a tie-coat formed of curable materials for affixing the image array to the substrate.

In another preferred embodiment, the colour filter is formed at least in part by an intermediate layer spaced from both the focussing element array and from the image array. For example, the security device could comprise a plurality of transparent substrates having the focussing element array and the image array arranged on surfaces thereof with one or more intermediate interfaces between substrates carrying the colour filter.

In a still further embodiment, the colour filter could be provided in an adhesive layer used to join components of the security device to one another. For example, the focussing element array could be provided in the form of a transfer structure which is then affixed to a substrate via such an adhesive layer, e.g. by hot stamping. The adhesive layer can be formed in regions of different colour to achieve any of the aforementioned effects. The adhesive layer may be pre-applied to the substrate or may form part of the transfer structure. In a variant of this implementation, the adhesive layer could be colourless and a colour filter layer printed onto the substrate prior to application of the lens structure thereover.

It should be noted that across the device as a whole the colour filter could be formed of more than one of the above options in combination with one another, e.g. incorporating the filter using different ones of the above techniques in different regions of the device. Alternatively or additionally, the colour filter comprises at least two colour filter layers provided at different spacings from the focussing element array and/or from the image array which are laterally offset and preferably partially overlap one another. For instance across one portion of the device (which may or may not correspond to a specific region thereof) the colour filter could be provided by an intermediate layer within the substrate structure whereas across another portion (which may overlap with the first) it may be provided by another intermediate layer at another location within the substrate thickness.

Preferably, at least in a portion of the device the image array is located substantially in the focal plane of the focussing element array. This ensures that a substantially focused image will be displayed by the end device. Typically, the focal plane will be at the same position across the whole device. However, in preferred embodiments the complexity of the device can be further enhanced if the position of the focal plane of the focussing element array is made different in the first and second regions of the device. This could be achieved for instance by varying the focal length of the focussing elements from one region to the next, e.g. by forming the focussing elements of different shapes, or by positioning the focussing elements at different levels, e.g. through the use of pedestal layers under the focussing element array with different heights in each region.

In preferred embodiments, each focusing element comprises any of: a cylindrical focusing element, a spherical focussing element or an aspherical focussing element. In all cases, the focusing elements making up the focusing structure array are preferably lenses or mirrors. The periodicity of the focusing structure array and therefore maximum width of the individual focusing is related to the device thickness and is preferably in the range 5-200 microns, still preferably 10 to 70 microns, most preferably 20-40 microns. The focusing elements can be formed in various ways, but are preferably made via a process of thermal embossing or cast-cure replication. Alternatively, printed focusing elements could be employed as described in U.S. Pat. No. 6,856,462. If the focusing elements are mirrors, a reflective layer may also be applied to the focussing surface.

Preferably, the array of image elements or microimages is located approximately in the focal plane of the focusing structures. Typical thicknesses of security devices according to the invention are 5 to 200 microns, more preferably 10 to 70 microns, with lens heights of 1 to 70 microns, more preferably 5 to 25 microns. For example, devices with thicknesses in the range 50 to 200 microns may be suitable for use in structures such as over-laminates in cards such as drivers licenses and other forms of identity document, as well as in other structures such as high security labels. Suitable maximum image element widths (related to the device thickness) are accordingly 25 to 50 microns respectively. Devices with thicknesses in the range 65 to 75 microns may be suitable for devices located across windowed and half-windowed areas of polymer banknotes for example. The corresponding maximum image element widths are accordingly circa 30 to 37 microns respectively. Devices with thicknesses of up to 35 microns may be suitable for application to documents such as paper banknotes in the form of slices, patches or security threads, and also devices applied on to polymer banknotes where both the lenses and the image elements are located on the same side of the document substrate.

In some preferred embodiments, the image elements or microimages are defined by inks. Thus, the image elements or microimages can be simply printed onto a substrate although it is also possible to define the image elements using a relief structure or by partially demetallising a metal layer to form a pattern. Such methods enable much thinner devices to be constructed which is particularly beneficial when used with security documents.

Suitable relief structures can be formed by embossing or cast-curing into or onto a substrate. Of the two processes mentioned, cast-curing provides higher fidelity of replication. A variety of different relief structures can be used as will described in more detail below. However, the image elements could be created by embossing/cast-curing the images as diffraction grating structures. Differing parts of the image could be differentiated by the use of differing pitches or different orientations of grating providing regions with a different diffractive colour. Alternative (and/or additional differentiating) image structures are anti-reflection structures such as moth-eye (see for example WO-A-2005/106601), zero-order diffraction structures, stepped surface relief optical structures known as Aztec structures (see for example WO-A-2005/115119) or simple scattering structures. For most applications, these structures could be partially or fully metallised to enhance brightness and contrast.

Examples of preferred techniques for forming the image elements in a metal later are disclosed in our British patent application no. 1510073.8. Particularly good results have been achieved through the use of a patterning roller (or other tool) carrying a mask defining the desired pattern, as described therein. A suitable photosensitive resist material is applied to a metal layer on a substrate and the exposed in a continuous manner to appropriate radiation through the patterned mask. Subsequent etching transfers the pattern to the metal layer, thereby defining the image elements.

Typically, the width of each image element or microimage may be less than 50 microns, preferably less than 40 microns, more preferably less than 20 microns, most preferably in the range 5-10 microns.

It is not essential for the array of focussing elements to be registered to the image array, but this preferred especially in the case of lenticular devices in order to control which image is exhibited at which viewing angle.

The security device may preferably further comprise a magnetic layer or another functional substance such as a fluorescent, phosphorescent or luminescent material.

Preferably, the security device or security device assembly is formed as a security thread, strip, foil, insert, label or patch. Such devices can be applied to or incorporated into articles such as documents of value using well known techniques, including as a windowed thread, or as a strip applied to a surface of a document (optionally over an aperture or other transparent region in the document). The document could for instance be a conventional, paper-type banknote, or a polymer banknote, or a hybrid paper/polymer banknote. Preferably, the article is selected from banknotes, cheques, passports, identity cards, certificates of authenticity, fiscal stamps and other documents for securing value or personal identity.

Alternatively, such articles can be provided with integrally formed security devices of the sort described above. Thus in preferred embodiments, the article (e.g. a polymer banknote) comprises a substrate with a transparent portion, on opposite sides of which the focusing elements and image array respectively are provided.

As mentioned above, one especially preferred way to implement the colour filter layer is as a multi-coloured tie coat. Such a multi-coloured tie coat can be used in other contexts with beneficial effect and hence a fifth aspect of the present invention provides a method of forming an image array for a security device, the image array comprising a pattern of at least one first curable material, the method comprising:

(i) providing a die form, the die form having a surface comprising an arrangement of raised areas and recessed areas defining the pattern;

(ii) applying the at least one first curable material to the surface of the die form such that said at least one first curable material substantially fills the recessed areas;

(iii) bringing a pattern support layer in contact with the surface of the die form such that it covers the recessed areas;

(iv) separating the pattern support layer from the surface of the die form such that the first curable material in the recessed areas is removed from said recessed areas and retained on the pattern support layer in accordance with the pattern; and (v) during and/or after step (b)(ii), at least partly curing the first curable material in one or more curing steps;

wherein the method further comprises either:

(ii') after step (ii) and before step (iii), covering the surface of the die form and the recessed areas filled with the at least one first curable material with a tie coat comprising at least two second curable materials arranged in respective laterally offset areas; or (ii") before step (b)(iii), applying to the pattern support layer a tie coat comprising at least two second curable materials arranged in respective laterally offset areas; and step (v) further comprises at least partly curing the at least two second curable compound such that in step (iv) the tie coat and the at least one first curable material are retained on the pattern support layer;

and wherein the at least two second curable materials have different optical detection characteristics from one another, whereby the image array comprises a background to the pattern of the at least one curable material, formed by the tie coat, the background having different appearances in respective laterally offset areas.

As detailed above, the tie coat can either be applied to the die form in a manner comparable to that disclosed in WO 2014/070079 A1, or it can be applied to the surface of the pattern support layer as described in US 2009/0297805 A1 and WO 2011/102800 A1. However, in both cases the tie coat will be formed of at least two regions with different optical detection characteristics. Preferably, the different optical detection characteristics are any of: different visible colours, different fluorescence, different luminescence or different phosphorescence.

The two or more second curable compounds are preferably applied in register to one another at least to the extent that any mis-register is not immediately apparent to the naked eye (e.g. a tolerance of up to 100 microns may be acceptable). In some embodiments, the at least two second curable compounds are applied to the die form or pattern support layer sequentially, e.g. directly from each of respective application rollers. However, in more preferred embodiments, the at least two second curable compounds are applied to an intermediate collection surface, preferably in register with one another, and then applied from the intermediate collection surface to the die form or pattern support layer simultaneously. This approach has been found to achieve more accurate register between the materials.

Preferably, the first curable material(s) applied to the surface of the die form are only partially cured before step (b)(iii) and fully cured once the pattern support layer has been brought in contact with the die form. This improves adhesion of the first curable material to the second curable materials and ultimately to the pattern support layer.

Advantageously, step (b)(ii) further comprises removing any excess first curable material(s) from the surface of the die form outside the recessed areas, preferably using a doctor blade or by polishing. This helps to ensure accurate replication of the desired pattern.

The image array produced using this method could be of any type, e.g. comprising a regular array of image slices or microimages as suitable for use in lenticular devices, moiré magnifiers or the like.

Examples of security devices and methods for their manufacture will now be described and contrasted with conventional devices, with reference to the accompanying drawings, in which:

FIG. 1 schematically depicts an embodiment of a security device, in cross-section;

FIG. 2 shows, in plan view, (a) an exemplary image array, (b) an exemplary colour filter, and (c) their appearance when overlapped;

FIG. 3 schematically depicts a comparative example of a conventional security device: FIG. 3(*a*) showing a schematic perspective view of the security device; FIG. 3(*b*) showing a cross-section through the security device; and FIGS. 3(*c*) and (*d*) showing two exemplary images which may be displayed by the device at different viewing angles;

FIGS. 4 to 7 schematically depict four security devices in accordance with embodiments of the invention, (a) in cross-section, (b) in plan view from a first viewing angle and (c) in plan view from a second viewing angle;

Figure 10A:
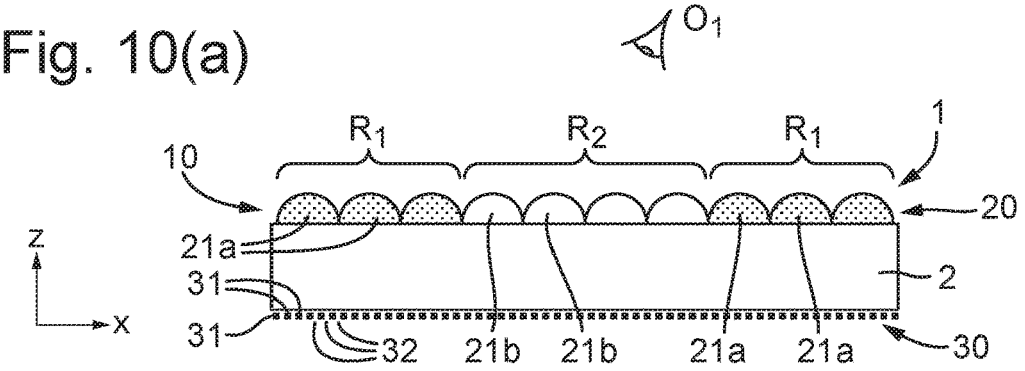
Figure 10B:
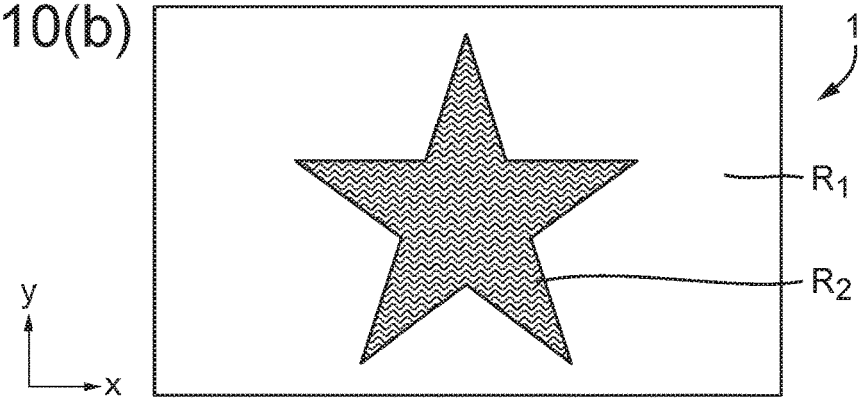
Figure 11A:
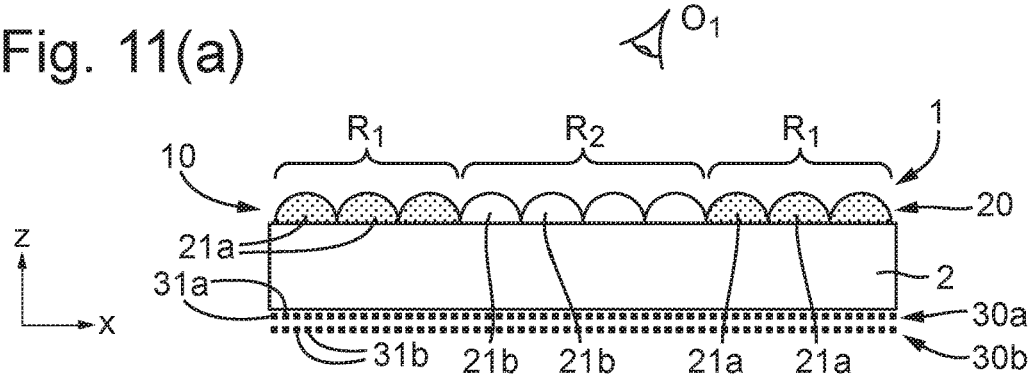
Figure 11B:
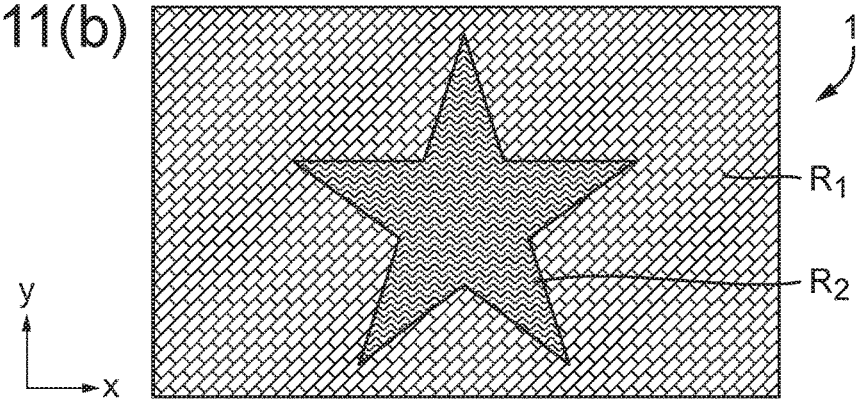
Figure 18A:
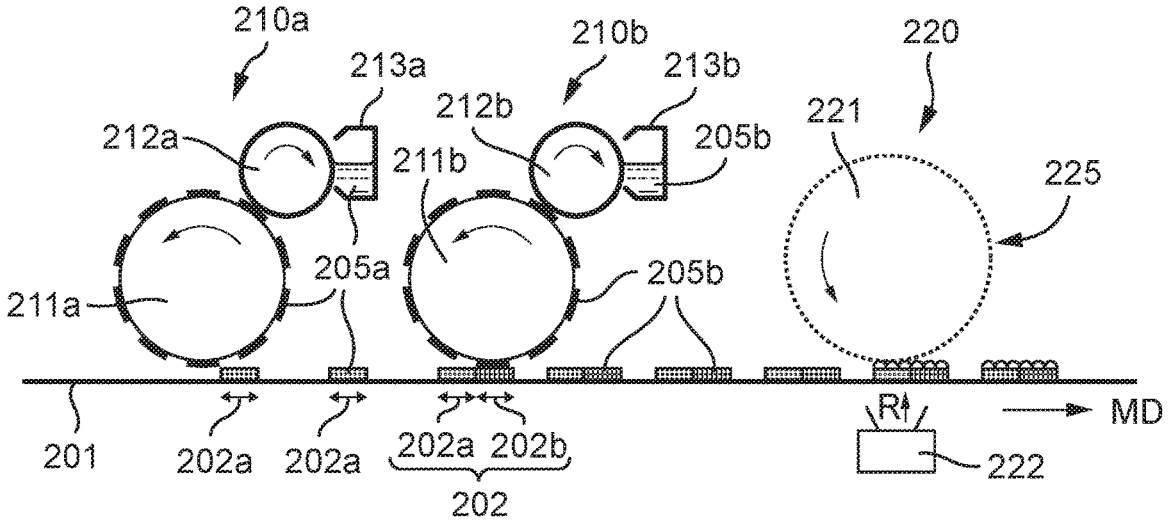
Figure 18B:
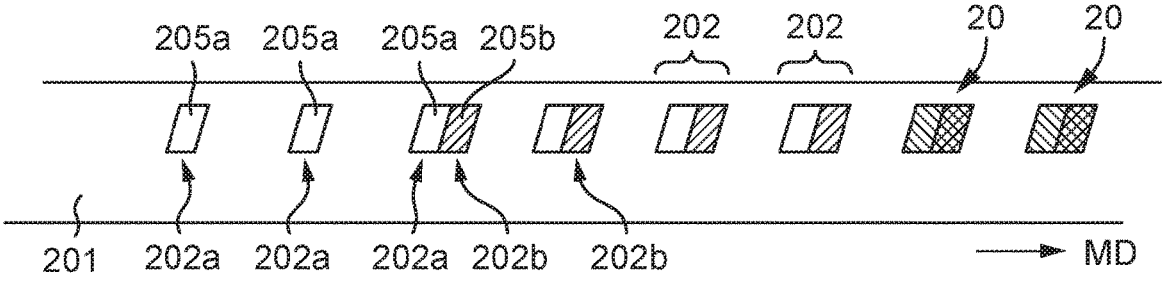
Figure 19:
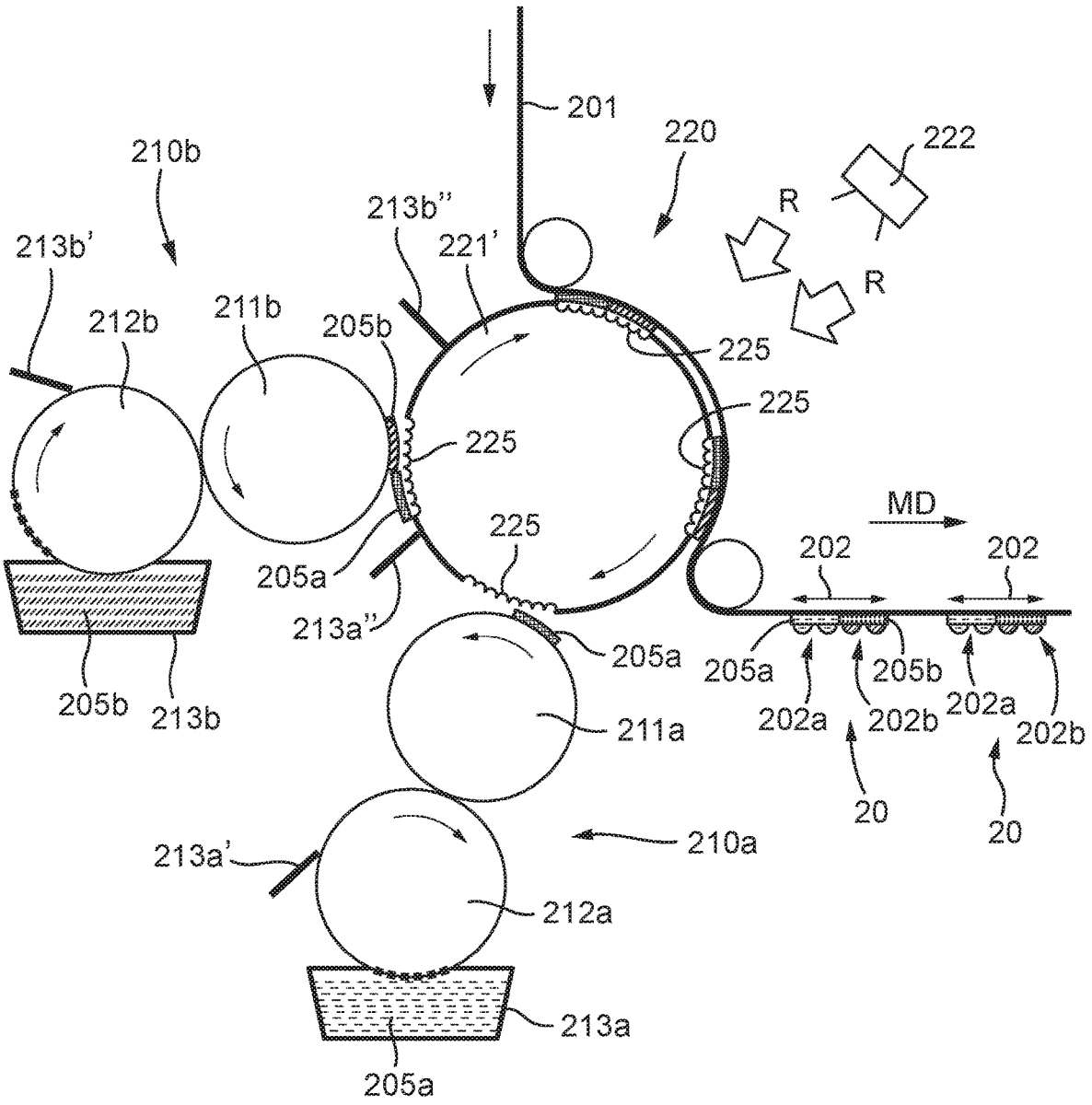
Figure 20:
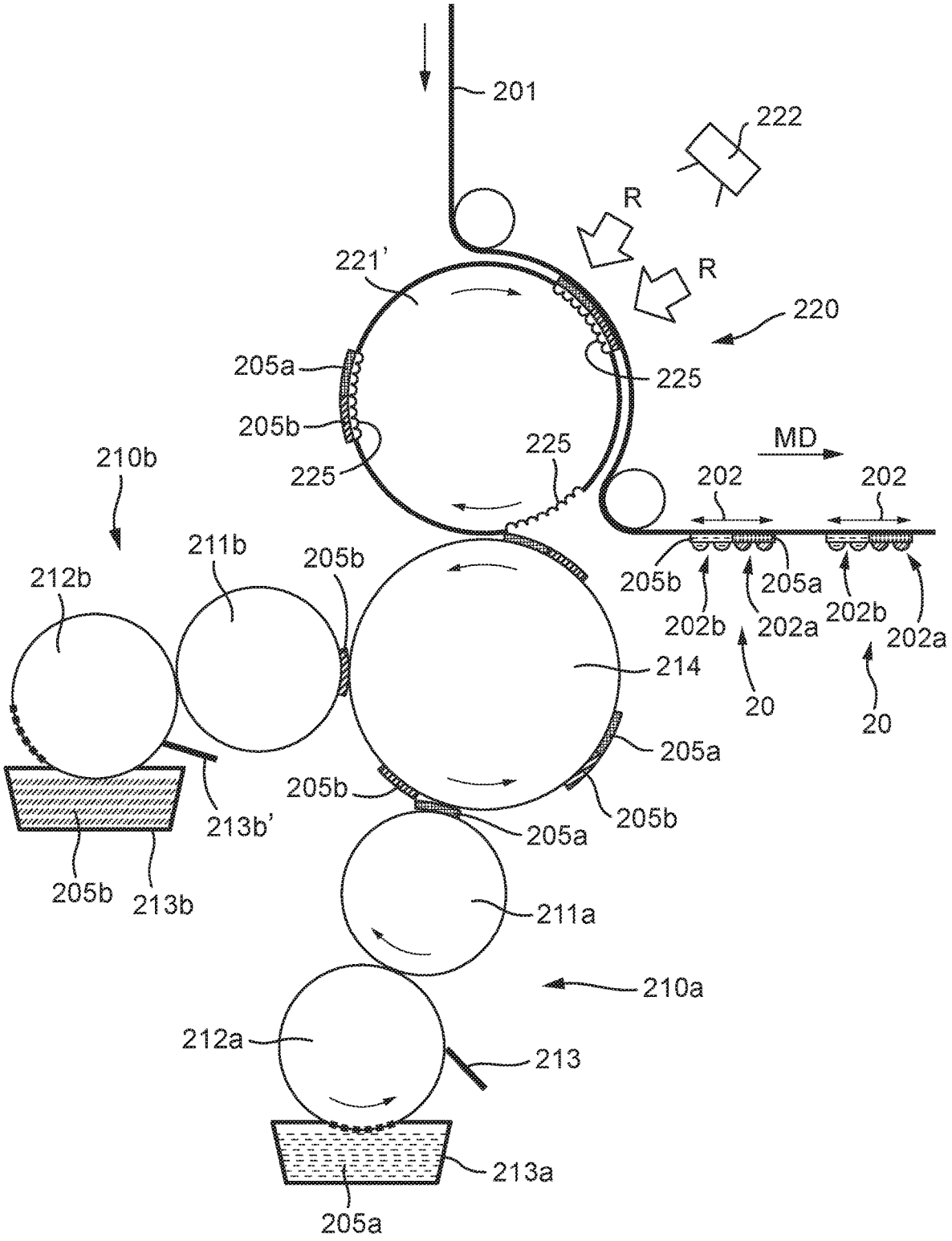
Figure 22A:
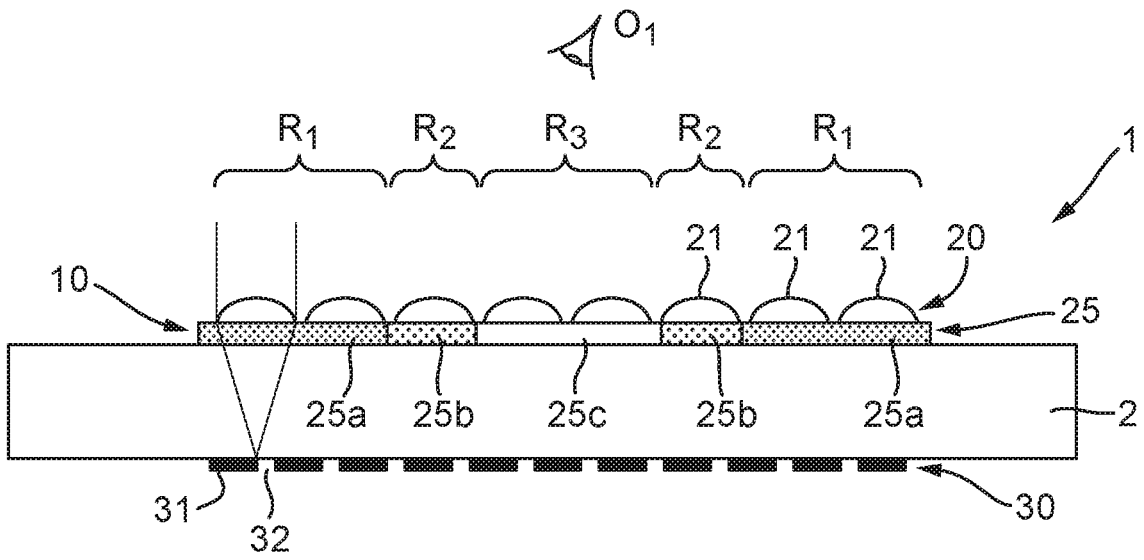
Figure 23:
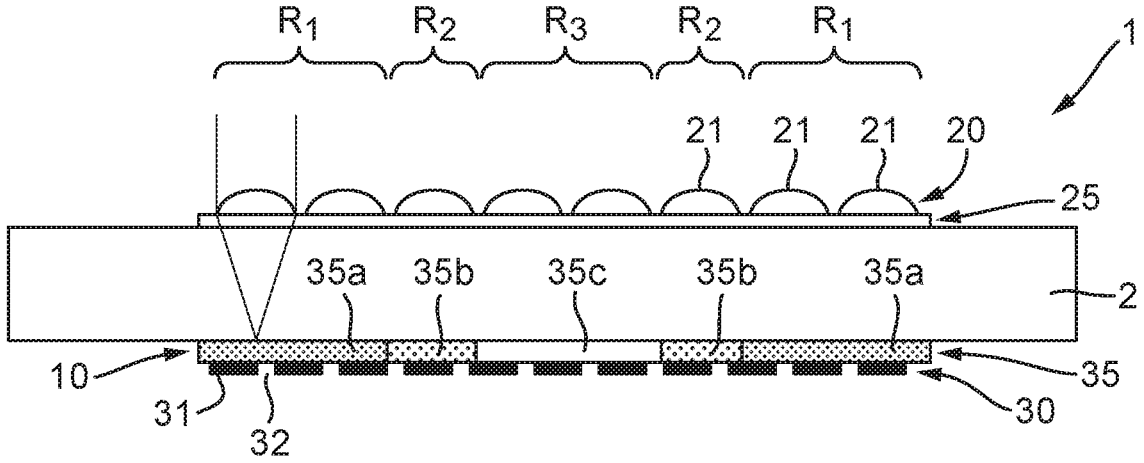
Figure 22B:
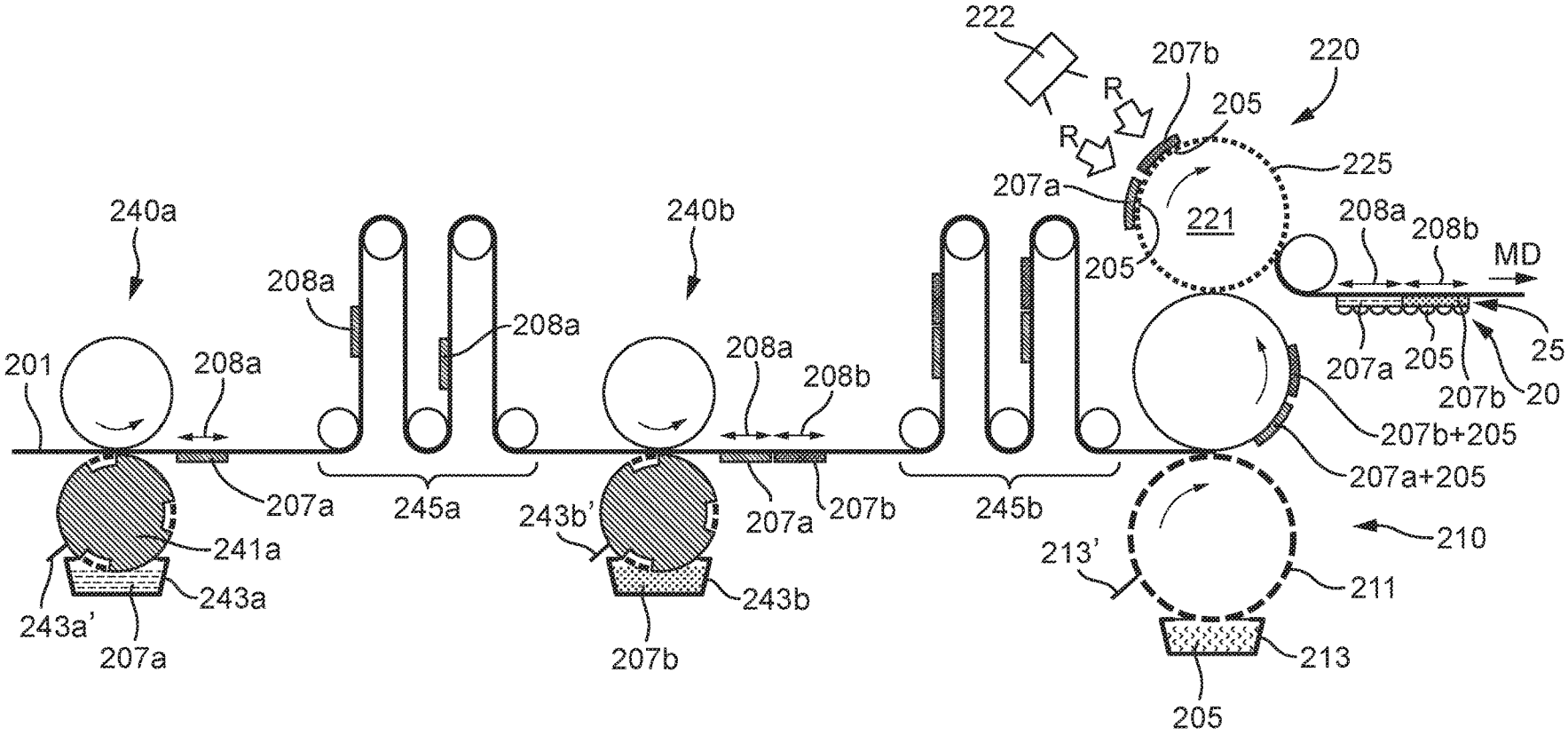
Figure 24A:
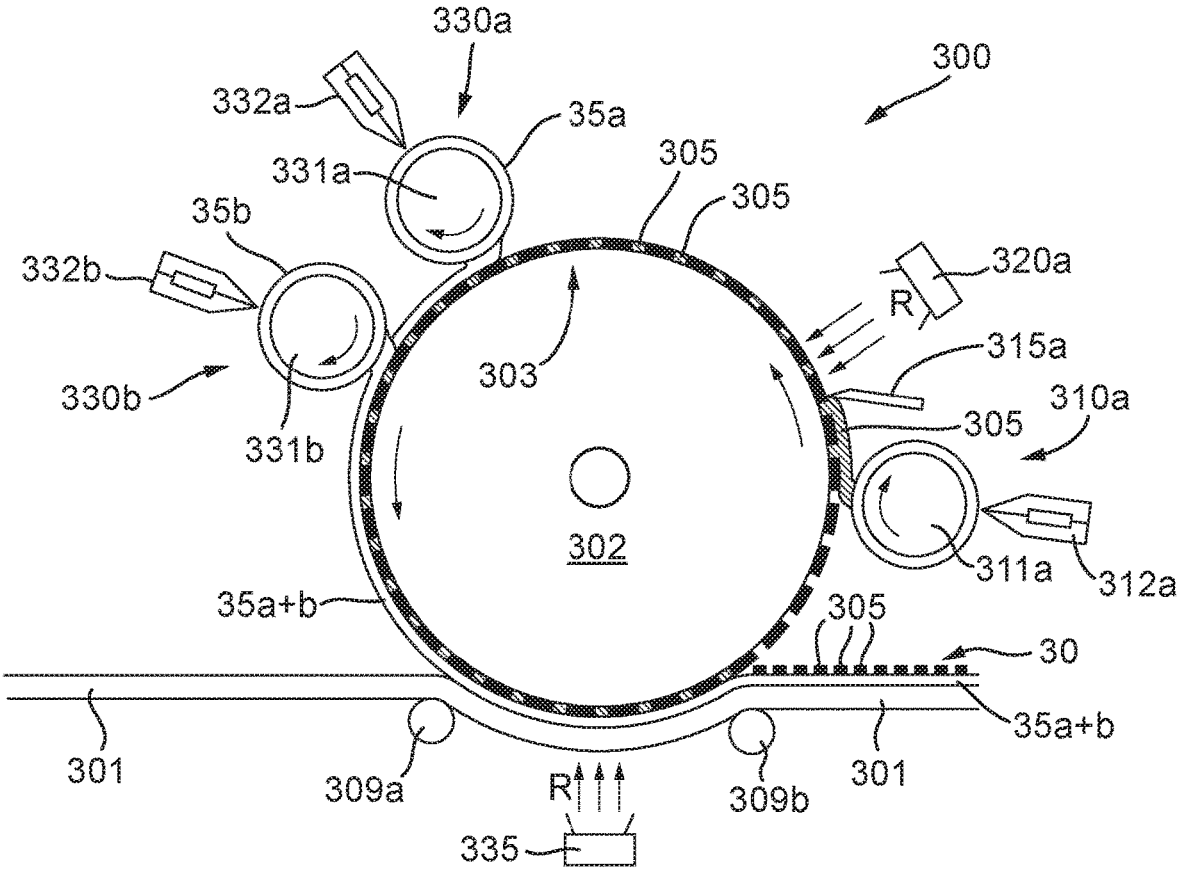
Figure 24B:
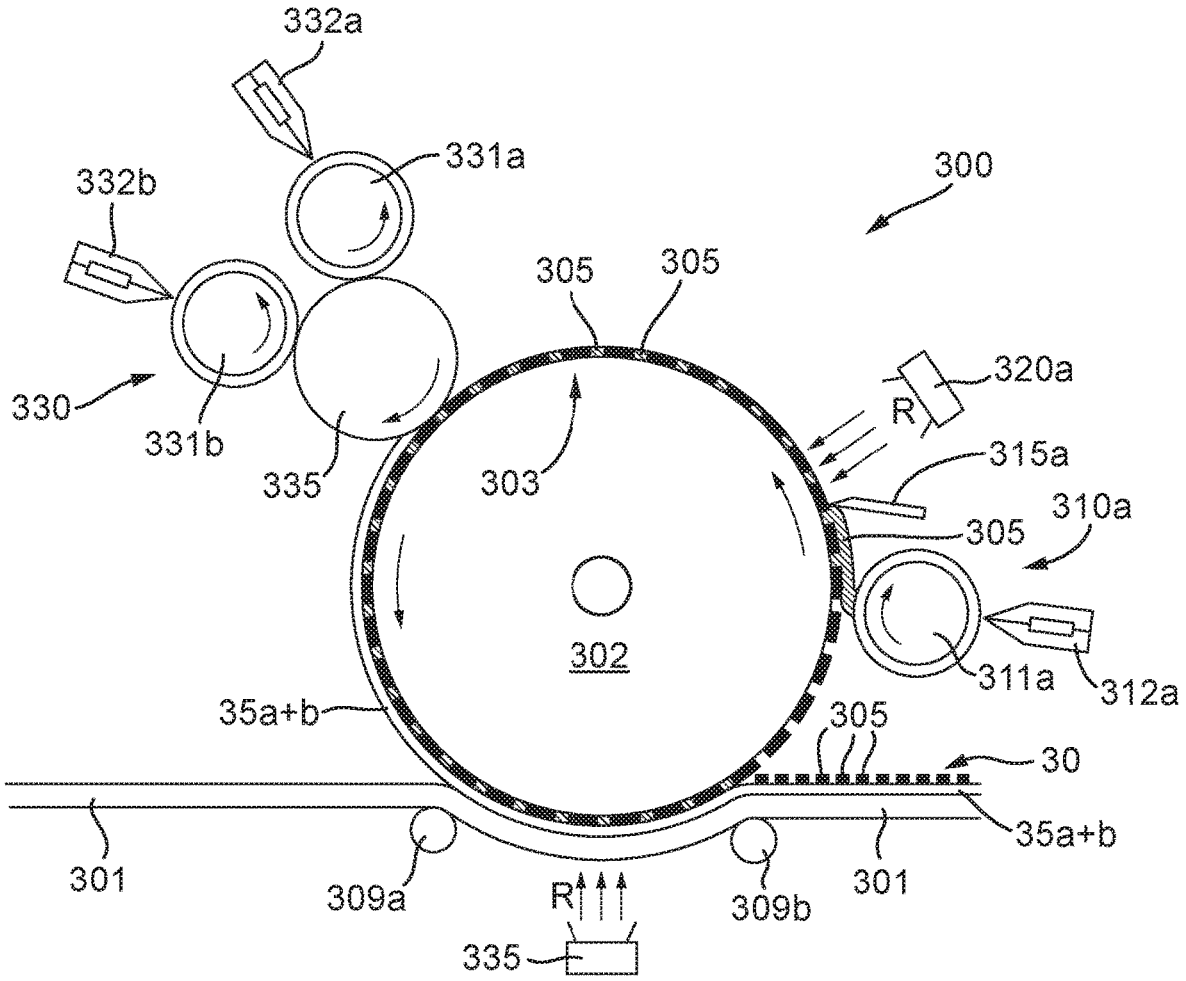
Figure 26:
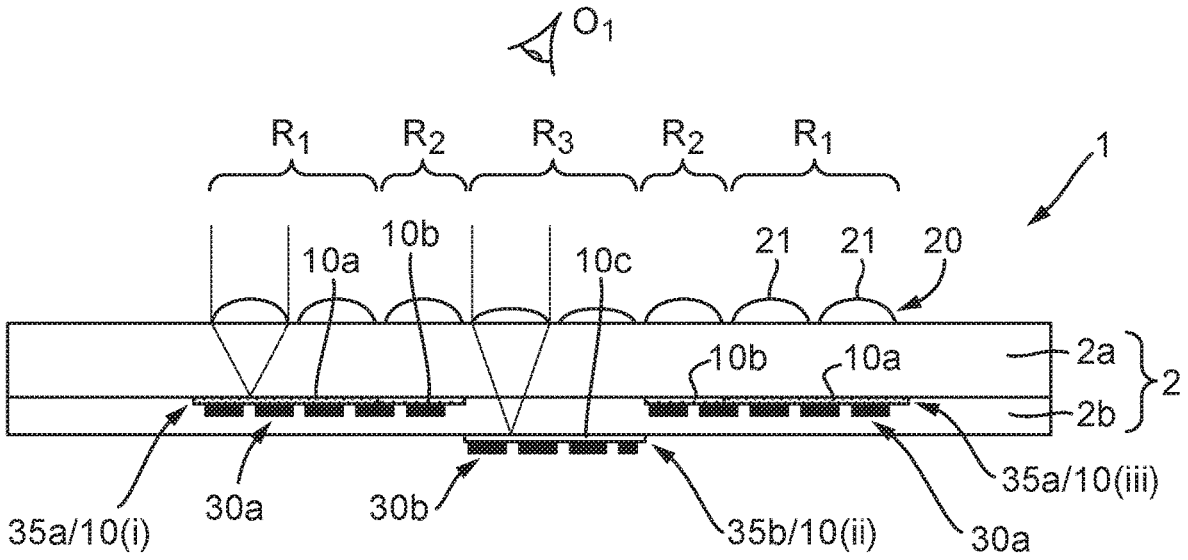
Figure 27:
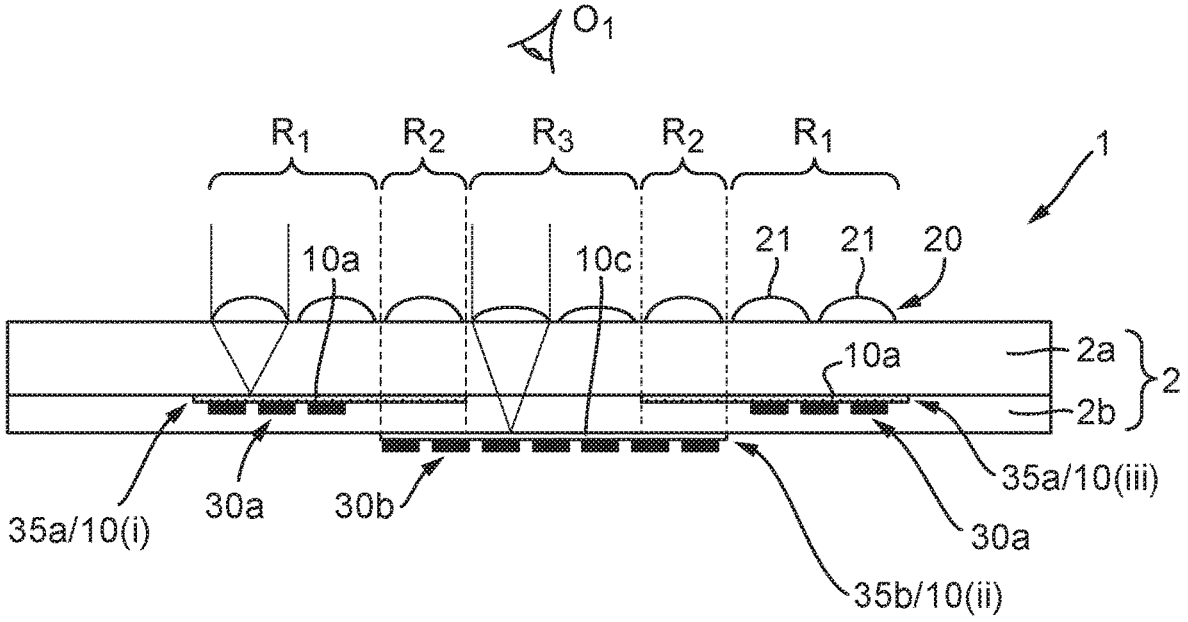
Figure 28A:
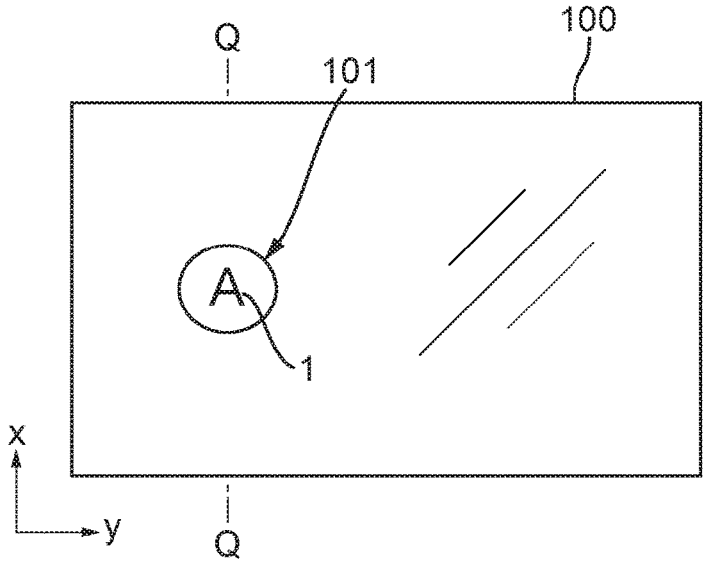
Figure 28B:
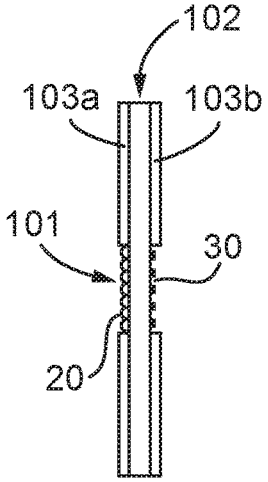
Figure 29A:
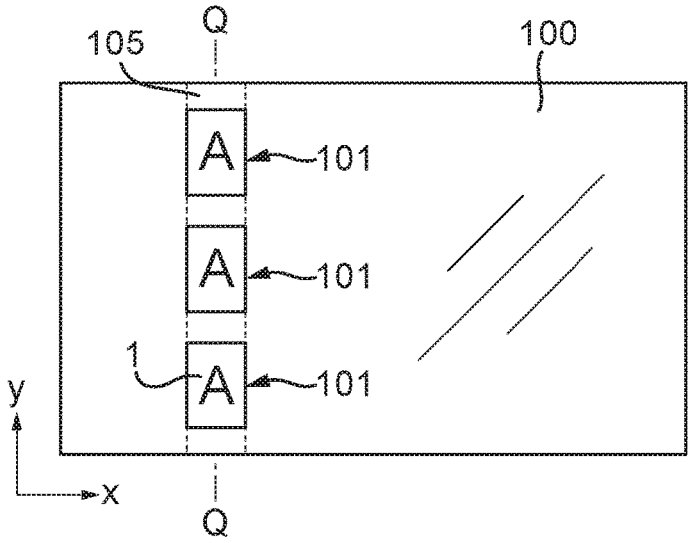
Figure 29B:
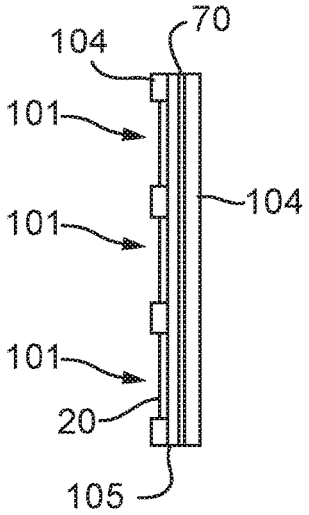
Figure 30A:
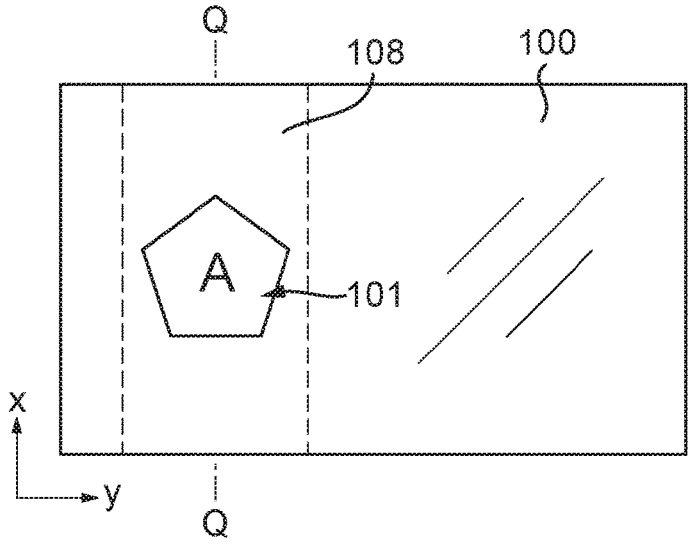
Figure 30B:
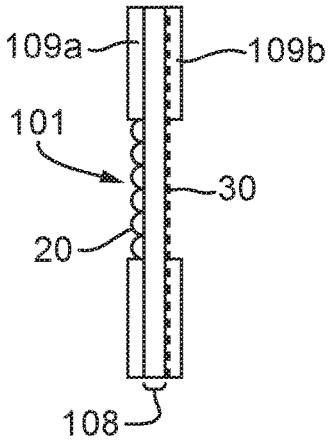
Figure 31A:
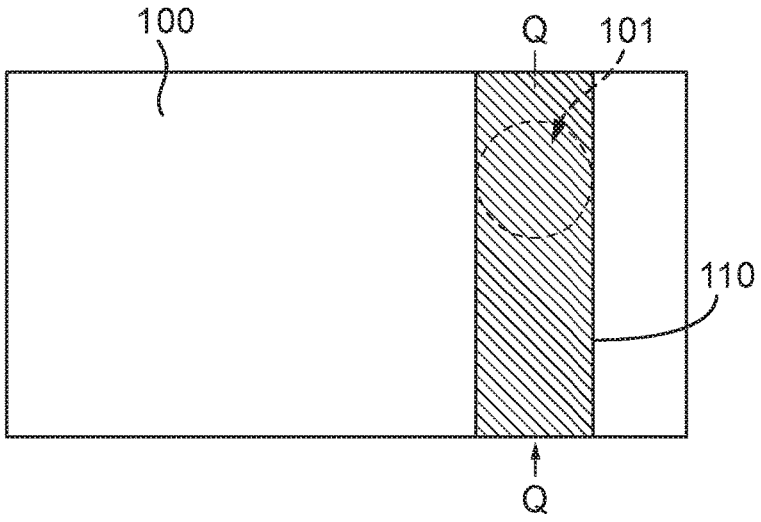
Figure 31C:
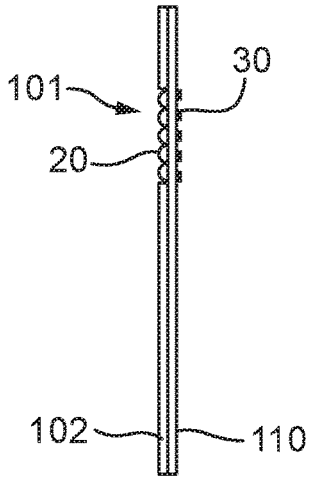
Figure 31B:
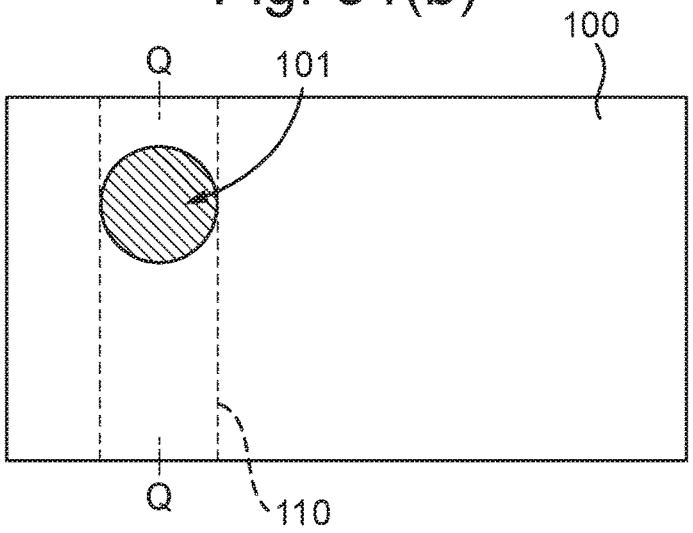

FIGS. 10 and 11 schematically depict two security devices in accordance with embodiments of the invention, (a) in cross-section and (b) in plan view;

FIGS. 12 to 17 schematically depict six further security devices in accordance with embodiments of the invention, (a) in cross-section, (b) in plan view from a first viewing angle and (c) in plan view from a second viewing angle;

FIGS. 18 (*a*) and (*b*) illustrate an exemplary apparatus for forming a focussing element array, in accordance with embodiments of the present invention, FIG. 18(*a*) illustrating the apparatus from a side view and FIG. 18(*b*) showing a perspective view of the focussing element support layer;

FIGS. 19 and 20 illustrate two variants of the apparatus shown in FIG. 18(*a*);

FIG. 21(*a*) shows an exemplary focussing element array formed as a transfer elements, suitable for use in embodiments of the invention, in cross-section, and FIG. 21(*b*) shows a security device in accordance with an embodiment of the present invention, comprising the focussing element array of FIG. 21(*a*);

FIG. 22*a* schematically depicts a security device in accordance with another embodiment of the present invention, in cross-section;

FIG. 22*b* shows a further embodiment of exemplary apparatus suitable for forming a focussing element array such as that in the FIG. 22*a* embodiment;

FIG. 23 schematically depicts a security device in accordance with another embodiment of the present invention, in cross-section;

FIGS. 24(*a*) and (*b*) and 25 (*a*) and (*b*) show four exemplary embodiments of apparatus suitable for forming an image array such as that in the FIG. 23 embodiment;

FIGS. 26 and 27 schematically depict two further security devices in accordance with embodiments of the present invention, in cross-section;

FIGS. 28, 29 and 30 show three exemplary articles carrying security devices in accordance with embodiments of the present invention (a) in plan view, and (b) in cross-section; and FIG. 31 illustrates a further embodiment of an article carrying a security device in accordance with the present invention, (a) in front view, (b) in back view and (c) in cross-section.

Security devices in accordance with aspects of the present disclosure make use of a colour filter to modify the apparent colour of an image array. The colour filter can be incorporated into the security device in various different ways each of which will produce substantially the same end result. Some preferred arrangements of the colour filter will be summarised with reference to FIG. 1 and discussed in more detail in connection with particular embodiments below. However it should be appreciated that all of the embodiments disclosed herein can be implemented with colour filters incorporated in any of the manners now described, or a combination thereof. In all cases however the colour filter should be located so that it lies between the image array and the viewer (observer) in use.

Figure 1:
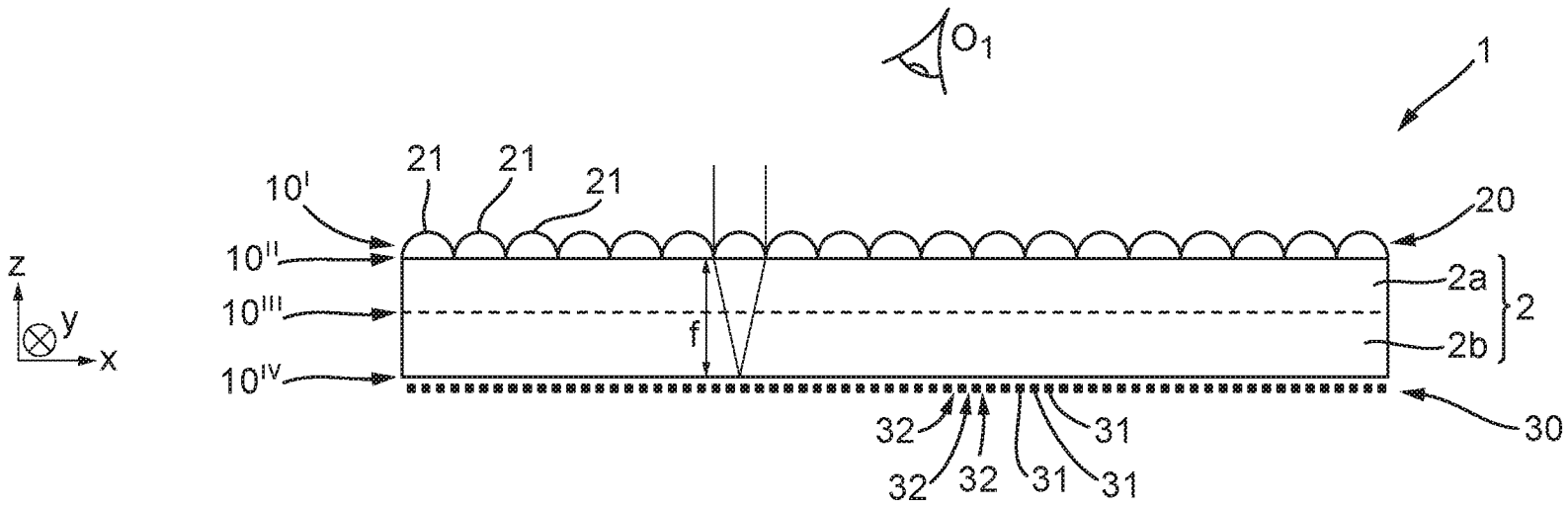

Hence, FIG. 1 schematically depicts an embodiment of a security device 1, in cross-section. The security device could be for example a moiré magnifier, an integral imaging device, a lenticular device or any other security device in which an optically variable effect is generated by the co-operation between a focussing element array and an image array. The security device comprises a transparent substrate 2, which is typically polymeric, and may be monolithic or formed of multiple layers such as layers 2*a*, 2*b* in this example. Suitable polymeric substrates include polypropylene (preferably BOPP), polyethylene, polyvinylchloride and the like. The thickness of the substrate will be selected based on the desired end use. For instance if the security device is to be formed as a thread, strip, foil or other article for application to a security document, typically the substrate thickness will be 50 microns or less, more preferably 35 microns or less. In other cases, the substrate 2 could be a portion of a document substrate such as that on which a polymer banknote is based in which case the thickness will be greater, e.g. in the region of 70 to 200 microns.

A focussing element array 20 is provided on one surface of the substrate 2 and comprises a regular array of focussing elements 21, such as lenses or mirrors. The particular arrangement of focussing elements 21 will depend on the nature of the optically variable effect to be generated. The array 20 may be periodic in one dimension or two dimensions—FIG. 1 depicts the array 20 as periodic in the x-axis direction but it may additionally be periodic in the orthogonal y-axis direction. The individual focussing elements could comprise elongate elements such as cylindrical focussing elements, or could be spherical or aspherical, for example. The focussing elements preferably take the form of lenses or mirrors. In the FIG. 1 embodiment, and in all the examples depicted below, the focussing element array is exemplified as lenses but in all cases could be replaced by a mirror array, in which case the observer $O_1$ would view the effect from the opposite side of the device. The colour filter would need to be repositioned within the structure accordingly.

The colour filter (generally denoted 10 in the Figures) may be integrated into another component of the security device 1 or may be provided separately. For instance, FIG. 1 shows four exemplary locations for the colour filter 10, labelled 10', 10", 10''' and $\mathbf{10}^{IV}$. In a first preferred option, the colour filter 10' is incorporated into the focussing element array 20 by forming the focussing elements 21 of differently coloured transparent materials in different regions of the device. Hence the focussing elements themselves perform dual functions of co-operating with the image array 30 to generate the optically variable effect and modifying the colour thereof. Alternatively, the colour filter 10" could be located between the focussing element array 20 and the surface of the substrate 2 on which the focussing element array 20 is located, in the form of a pedestal layer (not shown separately in FIG. 1). The pedestal layer will comprise transparent materials having different colours in different regions of the device 1.

If the substrate 2 is multi-layered, the colour filter 10''' could alternatively be provided at some intermediate location within the substrate 2 at an internal interface between adjacent substrate layers such as that illustrated between layers 2*a* and 2*b*. In this case, the colour filter 10''' could be a printed layer of coloured inks, for example. In a fourth example, the colour filter could be located between the image array 30 and the surface of the substrate on which the image array is carried. Here the colour filter $\mathbf{10}^{IV}$ could take the form of a printed layer on top of which the image array is then placed, or more preferable could be formed as a multi-coloured tie coat of coloured curable materials, as will be described further below.

For ease of manufacturing, colour filter locations 10" (pedestal layer) or $\mathbf{10}^{IV}$ in the form of a printed layer are especially preferred. However, forming the colour filter integrally with another component (e.g. in the focussing element array or as a tie coat) offers other advantages such as improved registration.

However the colour filter 10 is incorporated into the device, it comprises at least two transparent materials with different visibly coloured tints (one of which may be colourless), arranged in respective regions of the device. The colour filter 10 modifies the observed colour of the underlying image array by transmitting only selected wavelengths of the visible spectrum therethrough, which are different in the different regions. To consider the effect of the colour filter 10 on the appearance of the device, the following model is adopted:

The visible spectrum can be represented by red, green and blue wavebands of roughly equal width and therefore the terms R, G and B in the following equations are just label indices.

We represent the reflected colour of the image elements or microimages 31 making up the image array as $P(p)=(p_r\,R,\ p_g\,G,\ p_b\,B)$ or simply $(p_r,\ p_g,\ p_b)$. Meanwhile, the reflected colour of the background 32 surrounding the image elements of microimages is $B(b)=(b_r\,R,\ b_g\,G,\ b_b\,B)$ or simply $(b_r,\ b_g,\ b_b)$. For example, for Magenta: $b_r,\ b_b,\ p_r,\ p_b=1$ and $b_g,\ p_g=0$
Cyan: $b_b,\ b_g,\ p_b,\ p_g=1$ and $b_r,\ p_r=0$
Yellow: $b_r,\ b_g,\ p_r,\ p_g,\ 1$ and $b_b,\ p_b=0$
Black: $b_r,\ b_g,\ b_b,\ p_r,\ p_g\ p_b=0$ For the colour filter 10, the colour transmission is defined by $T(t)=(t_r\,R,\ t_g\,G,\ t_b\,B)$. For instance, a red filter as defined as that which passes only the red wave band and therefore $t_r=1$ and $t_g,\ t_b=0$ etc.

Given the previous representation and notation, the observed background colour exhibited by the image array 30 and colour filter 10 in combination can be denoted $OB=\Sigma_i\,(b_i \cdot t_i)\,i$, whilst the observed colour of the image elements or microimages 31 is $OP=\Sigma_i\,(p_i \cdot t_i)\,i$.

To illustrate, suppose the background 32 is a pure cyan with the colour matrix $B(b)=(0,1,1)$ and the image elements 31 are magenta with the colour matrix $P(p)=(1,0,1)$. Suppose the colour filter 10 transmits 90% red, 5% green and 5% blue, then $T=(0.9,\ 0.05,\ 0.05)$. Hence the observed background colour OB will be (0, 0.05, 0.05) i.e. very dark cyan, whilst the image element colour OP will be defined by (0.9, 0, 0.05) which will result in a bright red image element 31. Thus the effect of the colour filter 10 here will be transform a "magenta on cyan" image array 30 to a "red on dark magenta" observed image array. We therefore have a convenient way of qualitatively determining the observed colour for more complex colour compositions present in background 32, image elements 31 and/or the colour filter 10.

Figure 2A:
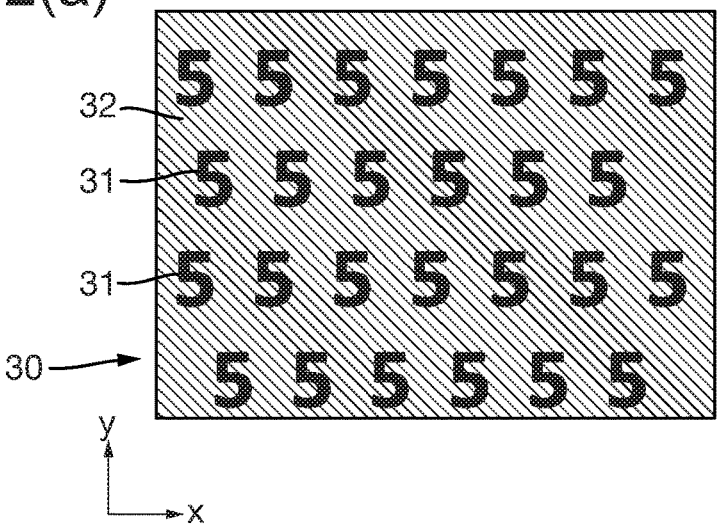
Figure 2B:
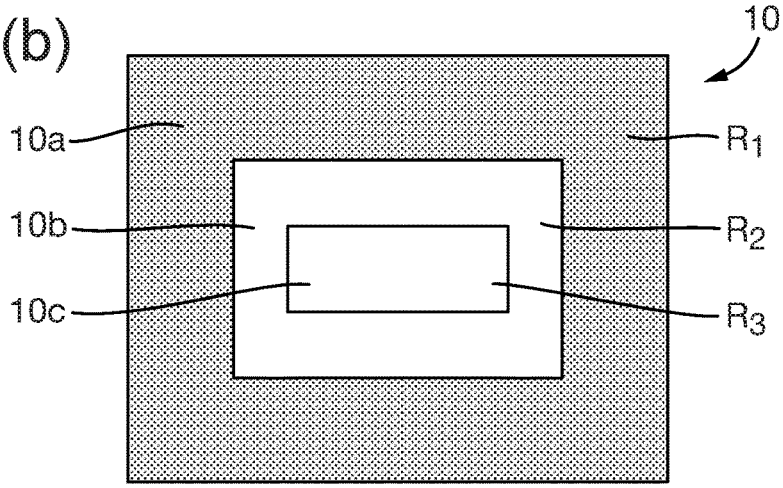
Figure 2C:
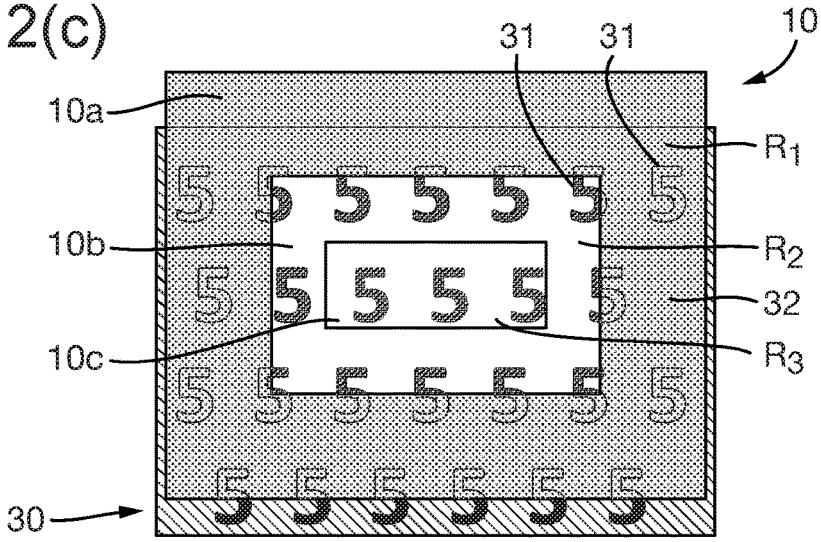
Figure 3A:
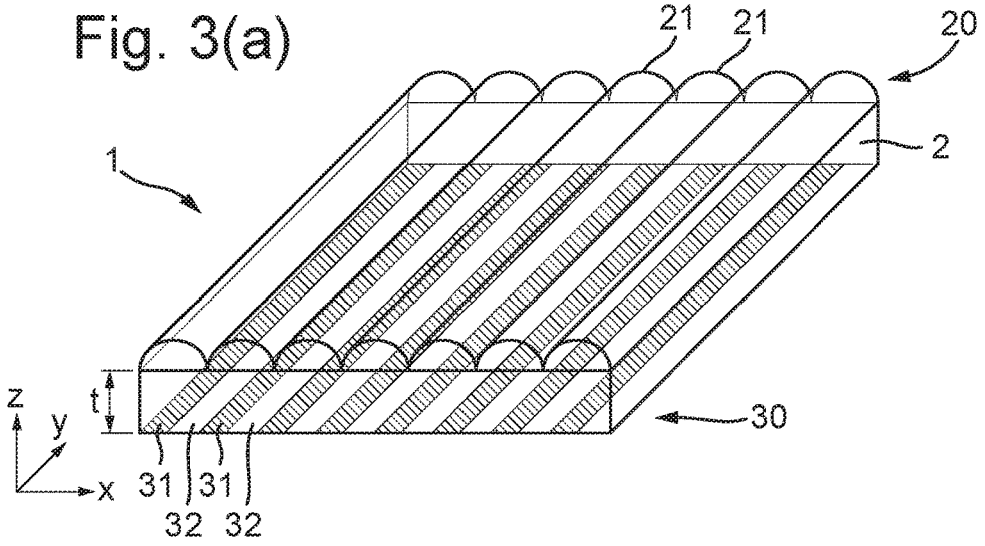
Figure 3B:
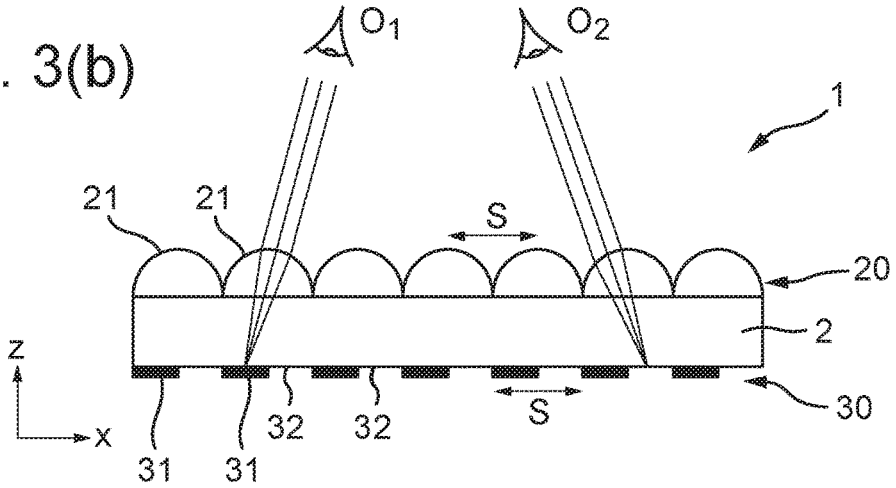
Figure 3C:
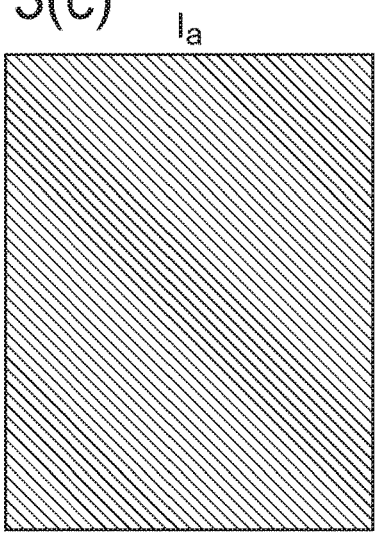
Figure 3D:
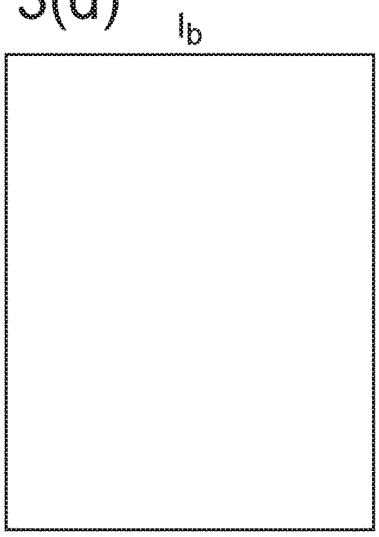

FIG. 2 shows these principles at work in an illustrative example. Here, FIG. 2(*a*) depicts an exemplary image array 30 which here comprises a regular array of microimages, each having in this example the form of the digit "5", which are formed in magenta, on a cyan background 32. FIG. 2(*b*) shows an exemplary colour filter 10 having three laterally offset and non-overlapping regions $R_1$, $R_2$ and $R_3$. In the first region $R_1$, the colour filter is formed of a first material 10*a* having a red tint, in the second region $R_2$, a second material 10*b* is provided which in this case is colourless (i.e. no tint), and in the third region $R_3$ a third material 10*c* is provided which here has a green tint. FIG. 2(*c*) shows the colour filter 10 and image array 30 arranged to partially overlap one another. Now, the image elements 31 which appear in the first region $R_1$ are observed as bright red against a dark cyan background, those appearing in the second region $R_2$ are unmodified and hence are observed as magenta image elements 31 against a cyan background, and in the third region $R_3$ the image elements 31 appear dark magenta on a green background. As a further example, if the colour filter 10 was formed of a yellow tinted material 10*b* in second region $R_2$, here the image elements 31 would appear red on a green background.

The above principles can be utilised to create various new and distinctive effects in optically variable security devices, of which preferred examples will now be described.

First, a comparative example of a lenticular device 10 is shown in FIG. 3 in order to illustrate certain principles of operation. FIG. 3(*a*) shows the device 1 in a perspective view and it will be seen that an array 20 of focussing element structures, here in the form of cylindrical lenses 21, is arranged on a transparent substrate 2. An image array 30 is provided on the opposite side of substrate 2 underlying (and overlapping with) the cylindrical lens array 20. Alternatively the image element array 30 could be located on the same surface of the substrate 2 as the lenses, directly under the lenses. Each cylindrical lens 21 has a corresponding optical footprint which is the area of the image element array 30 which can be viewed via the corresponding lens 21. In this example, the image array 30 is an interlaced image array comprising a series of image slices, of which two slices 31, 32 are provided in (and fill) each optical footprint.

The image slices 31 each correspond to strips taken from a first image $I_A$ whilst the image slices 32 each correspond to strips of a second image $I_B$. Thus, the size and shape of each first image slice 31 is substantially identical (being elongate and of width equal to half the optical footprint), but their information content will likely differ from one first image slice 31 to the next (unless the first image $I_A$ is a uniform, solid colour block). The same applies to the second image slices 32. The overall pattern of image slices is a line pattern, the elongate direction of the lines lying substantially parallel to the axial direction of the focussing elements 21, which here is along the y-axis. The lenses 21 and the image slices 31, 32 are periodic in the orthogonal direction (x-axis) which may be referred to below as the first direction of the device.

As shown best in the cross-section of FIG. 3(*b*), the image element array 30 and the focussing element array have substantially the same periodicity as one another in the x-axis direction, such that one first image slice 31 and one second image slice 32 lies under each lens 21. The pitch S of the lens array 20 and of the image element array 30 is substantially equal and is constant across the whole device. In this example, the image array 30 is registered to the lens array 20 in the x-axis direction (i.e. in the arrays' direction of periodicity) such that a first pattern element 31 lies under the left half of each lens and a second pattern element 32 lies under the right half. However, registration between the lens array 20 and the image array 30 in the periodic dimension is not essential.

When the device is viewed by a first observer $O_1$ from a first viewing angle, as shown in FIG. 3(*b*) each lens 21 will direct light from the underlying first image slice 31 to the observer, with the result that the device as a whole appears to display the appearance of the first image $I_A$, which in this case is a uniform block colour as shown in in FIG. 1(*c*). The full image $I_A$ is reconstructed by the observer $O_1$ from the first image slices 31 directed to him by the lens array 20. When the device is tilted so that it is viewed by second observer $O_2$ from a second viewing angle, now each lens 21 directs light from the second image slices 32 to the observer. As such the whole device will now appear to display a second image $I_B$, which in this example is blank, as shown in FIG. 1(*c*), although it could comprise any alternative image. Hence, as the security device is tilted back and forth between the positions of observer $O_1$ and observer $O_2$, the appearance of the whole device switches between image $I_A$ and image $I_B$.

In this example the first image elements 31 are provided by material forming the image array 30 whilst the second image elements 32 are provided by gaps therebetween. However in other cases as illustrated below the second image elements 32 could also be coloured, e.g. by providing a coloured background such as that described with reference to FIG. 2 above. It is also possible to interleave three of more images by extending the above principles accordingly.

As also noted in passing, the images need not be uniform blocks of colour (or lack thereof) but could each carry any desirable graphic, such as indicia or the like, by arranging each image slice 31 to be provided only in accordance with the desired graphic rather than in a continuous form along its length, as shown.

Figure 4A:
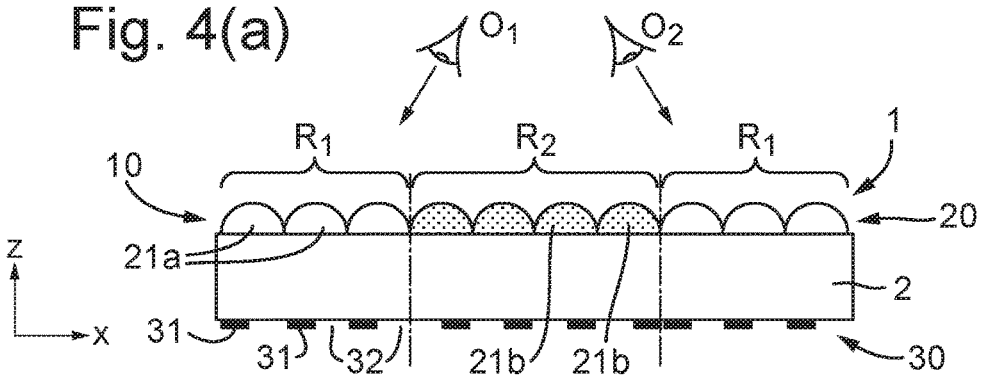
Figure 4B:
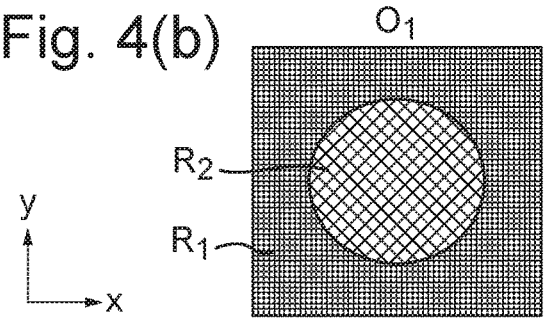
Figure 4C:
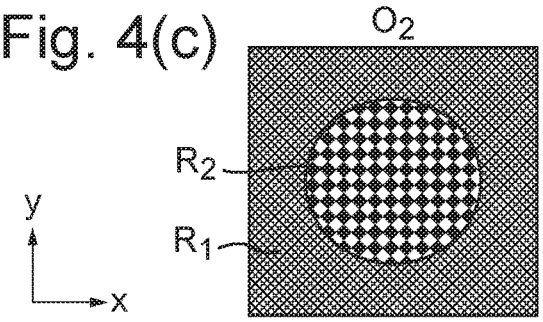

FIG. 4 illustrates an embodiment of a security device 1 in accordance with an aspect of the present invention which here is a lenticular device operating on the same principles described with respect to FIG. 3. Components of the device 1 are labelled using like reference numerals as before and so those already introduced will not be described again. The security device 1 comprises two laterally offset regions $R_1$ and $R_2$ which, as shown best in the plan views of FIGS. 4(*b*) and (*c*) are arranged as a circular area $R_2$ on a rectangular surroundings $R_1$. The device incorporates a colour filter 10 of the type described above which here is incorporated into the focussing element array 20, but could take any of the other implementations already mentioned. However in this example, the focussing elements 21*a* in the first region $R_1$ are formed of a transparent material in a first colour (e.g. blue) whilst the focussing elements 21*b* in the second region $R_2$ have a second colour (e.g. yellow). The image array 30 once again comprises first image slices 31 spaced by background slices 32 arranged so as to generate the above-described lenticular switching effect in combination with the focussing elements 21, upon tilting of the device. However, in the second region $R_2$, the image array is laterally shifted in the x-axis direction relative to its translational position in the first region $R_1$ (i.e. "phase-shifted"), which can be achieved through design of the image array 30. Thus, in the first region $R_1$ the first image slices 31 sit under the left half of each focussing element 21 whilst the second image slices 32 occupy the right half, and in the second region R the arrangement is reversed. In this example, the first image slices 31 are achromatic (e.g. black) whilst the second image slices 32 are colourless.

FIGS. 4(*b*) and (*c*) show the appearance of the device from two different viewing angles for respective observers $O_1$ and $O_2$. Observer $O_1$ sees outer region $R_1$ appearing dark blue/black due to the combination of the blue lenses 21*a* with the black image elements 31. However in the central region $R_2$ the focussing elements 21 will direct light from the second image elements 32 to the same observer $O_1$, due to the phase-shifted image array 30 and this in combination with the yellow lenses 21*b* will cause the region $R_2$ to appear bright yellow. When the device is tilted and viewed by observer $O_2$, now in the outer region $R_1$, the blue lenses 21*a* will direct light from the second image slices 32 to the viewer causing that region to appear bright blue whilst the central region $R_2$ will now appear dark yellow or gold due to the combination of the yellow lenses 21*b* and dark image elements 31. Hence, overall two different colours, each at two different darkness levels, are displayed by the device over the full range of viewing angles. In addition it will be noted that the contrast between the two regions has reversed during tilting: observer $O_1$ sees the outer region $R_1$ as dark compared with the centre region $R_2$ whereas the reverse is true for observer $O_2$. This provides a particularly strong and distinctive visual effect.

By requiring both the colour filter 10 and the image array 30 to possess different characteristics in respective regions of the device 1, the device presents a significant challenge to would-be counterfeiters, since any mis-registration between the colour filter 10 and the image array 30 will be noticeable since additional colour effects will appear at the boundaries between regions.

Figure 5A:
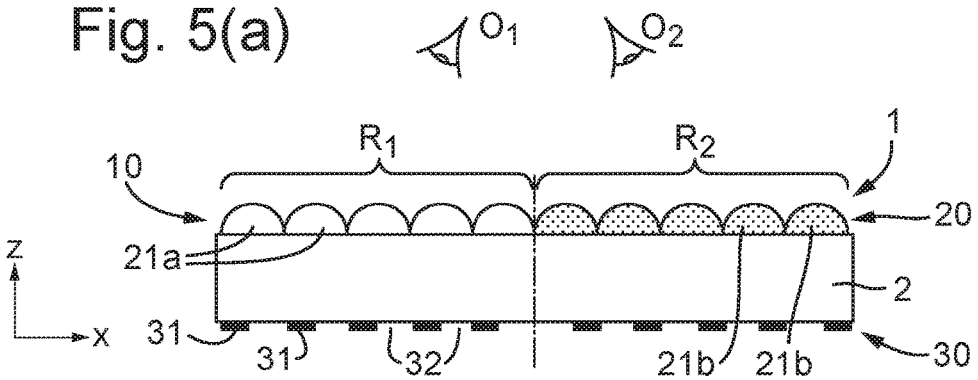
Figure 5B:
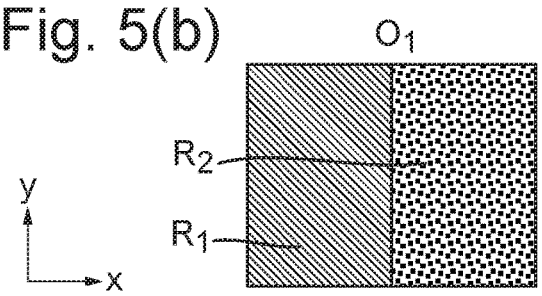
Figure 5C:
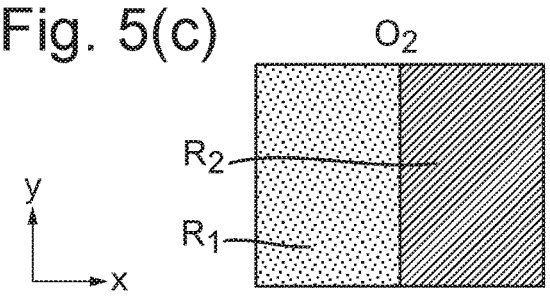

FIG. 5 illustrates another embodiment of a security device 1 which is a variant of that depicted in FIG. 4 and operates on the same principles. Here, the two regions $R_1$, $R_2$ are laterally offset rectangular areas of the device 1 and once again the colours of the colour filter 10 and the translational position of the image array 30 are varied between regions. In this example, however, the image elements 31 are not achromatic but themselves carry a hue which when combined with colours of the colour filter creates additional effects. To illustrate this, here the colour filter 10 (incorporated again into the focussing element array 20) is colourless in the first region $R_1$ but carries a yellow tint in the second region $R_2$. The image elements 31 are blue and the gaps 32 between them are colourless. Now, observer $O_1$ sees the first region $R_1$ as light blue and the second region $R_2$ as yellow. Upon tilting, observer $O_2$ sees the first region $R_1$ as colourless and the second region $R_2$ as green (due to the combination of blue and yellow). Hence four different colours are visible across the whole range of viewing angles, despite only three having been used in its production (counting colourless).

Figure 6A:
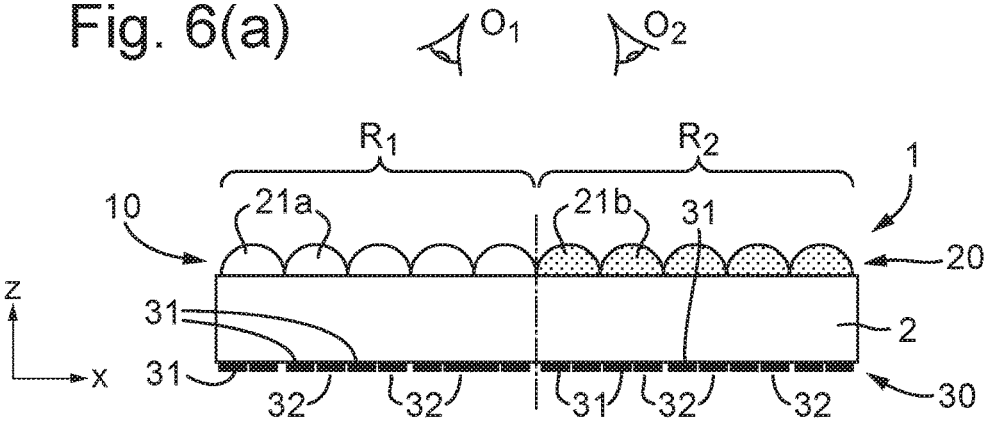
Figure 6B:
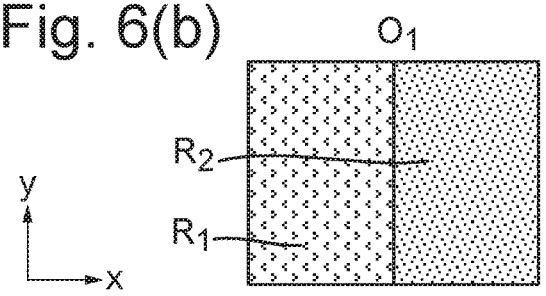
Figure 6C:
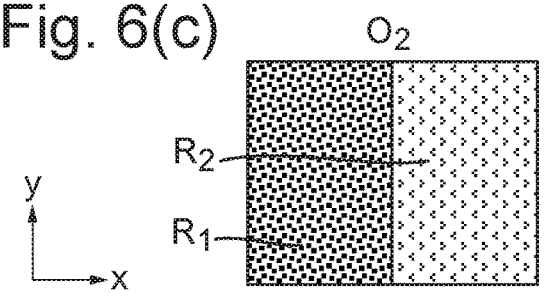

In the FIG. 6 embodiment, new colour effects are achieved by matching at least one of the colours in the colour filter 10 to at least one colour of the image array 30. Again the construction is similar to that in the two preceding embodiments and so only the differences will be highlighted here. The image array 30 in this example is formed of yellow first image slices 31 and intervening blue second image slices 32. Unlike in the preceding embodiments, there is no phase-shift in the image array 30 between regions and the arrangement of image slices continues uniformly across the device 1. The colour filter 10, meanwhile, is blue in the first region $R_1$ and yellow in the second region $R_2$ such that in this example the two colours in the filter 10 match each of the two colours in the image array 30 (although this is not essential, only one matching colours is required).

The described arrangement results in the generation of a new third colour which appears to move between regions upon tilting of the device. As shown in FIGS. 6(*b*) and (*c*), the first observer $O_1$ sees the first region $R_1$ as green due to the combination of the blue lenses 21*a* and the yellow first image slices 31, and the second region $R_2$ as yellow. Upon tilting, observer $O_2$ now sees the first region $R_1$ as blue whilst the new green colour has moved to the second region $R_2$.

Figure 7A:
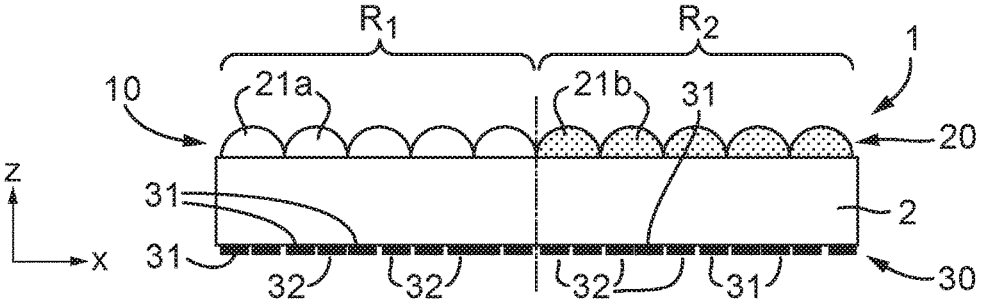
Figure 7B:
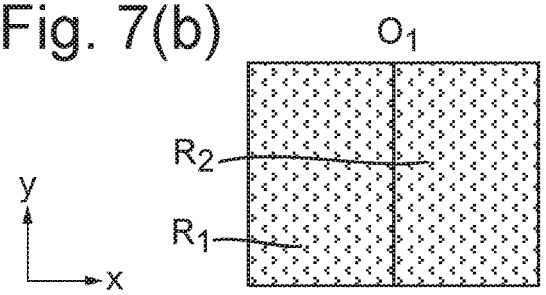
Figure 7C:
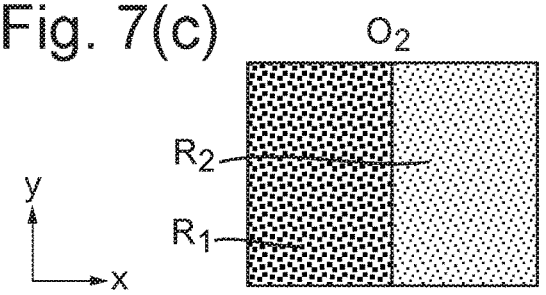

Another effect can be achieved by adding a phase-shift to the image array 30 between regions, as illustrated in the embodiment of FIG. 7. Here the construction of the device and choice of colours is the same as in the FIG. 6 embodiment, the only difference being that the image slices have been laterally shifted in region $R_2$ relative to region $R_1$. Now, observer $O_1$ will perceive both regions $R_1$ and $R_2$ as green, whereas observer $O_2$ will see only the two original colours: blue in region $R_1$ and yellow in region $R_2$. Hence the third colour, green, appears and disappears as the device is tilted.

The above examples of security devices have all operated on lenticular principles but colour filters of the types just mentioned in which at least one of the colour filter regions matches a colour in the image array also have particular benefit in security devices such as moiré magnifiers and integral imaging devices.

To illustrate the principles of operation, comparative examples of moiré magnifier and integral imaging devices will first be described with reference to FIGS. 8 and 9 respectively.

Figure 8A:
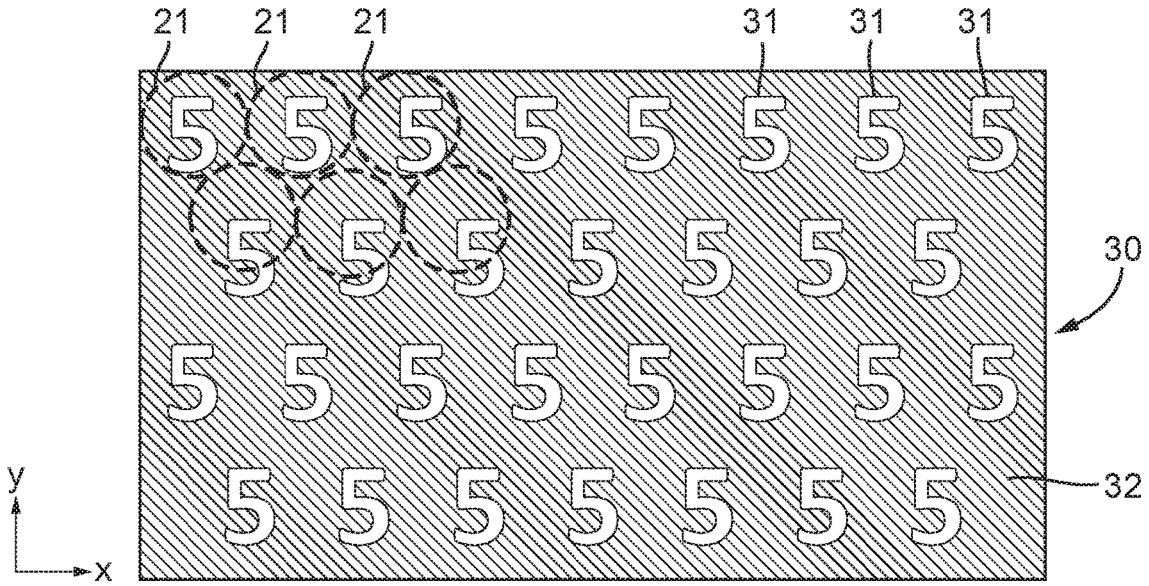
FIG. 8(*a*) illustrates in plan view an exemplary image array in accordance with an embodiment of the present invention, FIG. 8(*b*) showing in plan view the appearance of a security device in accordance with an embodiment of the present invention incorporating the image element array of FIG. 18(*a*), at one viewing angle.
Figure 8B:
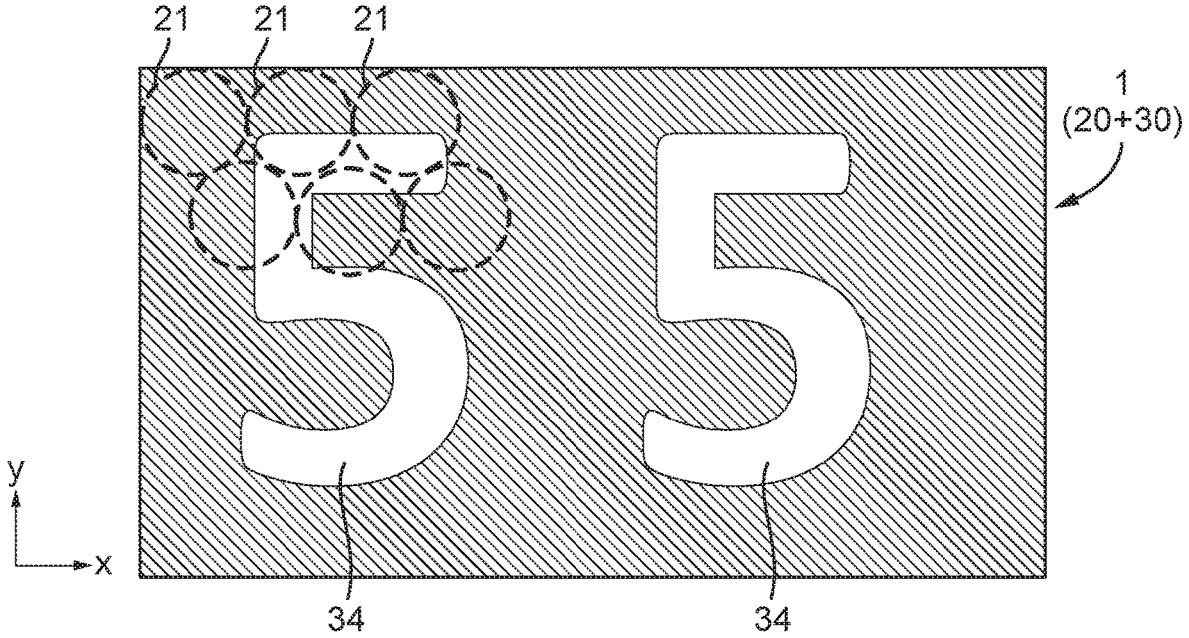
Figure 9A:
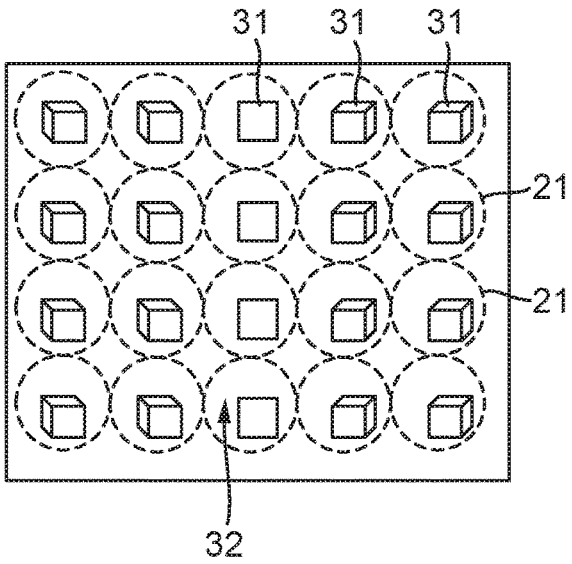
FIG. 9(*a*) illustrates an exemplary image array in accordance with an embodiment of the invention, and FIG. 9(*b*) shows the appearance of a security device incorporating the image pattern of FIG. 9(*a*)
Figure 9B:
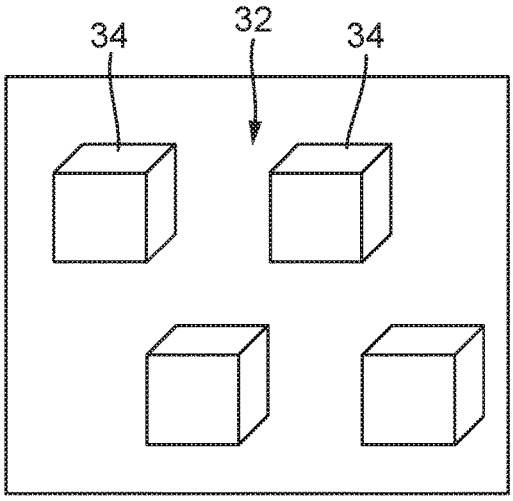

FIG. 8 depicts an exemplary moiré magnifier device, comprising an image element array 30 defining an array of microimages 31 and an overlapping focussing element array 20 with a pitch or rotational mismatch as necessary to achieve the moiré effect. FIG. 8(*a*) depicts part of the image element array 30 as it would appear without the overlapping focusing element array, i.e. the non-magnified microimage array (but shown at a greatly increased scale for clarity).

In contrast, FIG. 8(*b*) depicts the appearance of the same portion of the completed security device, i.e. the magnified microimages 34, seen when viewed with the overlapping focussing element array, at one viewing angle. It will be seen from FIG. 8(*a*) that the image array 30 here forms a regular array of microimages 31 which here each convey the digit "5". In this case all of the microimages 31 are of identical shape and size. The microimages 31 may be coloured or achromatic, formed of ink for example. Surrounding the microimages 31 is a contiguous, uniform background 32 which is preferably colourless but could be of a second contrasting colour. Alternatively, the arrangement could be reversed with the microimages 31 formed as negative, colourless gaps in a coloured background 32.

FIG. 8(*b*) shows the completed security device 1, i.e. the image element array 30 shown in FIG. 8(*a*) plus an overlapping focusing element array 20, from a first viewing angle which here is approximately normal to the plane of the device 30. It should be noted that the security device is depicted at the same scale as used in FIG. 8(*a*): the apparent enlargement is the effect of the focusing element array 20 now included. The moiré effect acts to magnify the microimage array such that magnified versions 34 of the microimages 31 are displayed. In this example just two of the magnified microimages are shown. In practice, the size of the enlarged images and their orientation relative to the device will depend on the degree of mismatch between the focussing element array. This will be fixed once the focusing element array is joined to the image element array. The magnified microimages will appear to move laterally relative to the device upon tilting and depending on the magnification level may be visualised above or below the surface plane of the device 1.

In the above example security device, the microimages are all identical to one another, such that the devices can be considered "pure" moiré magnifiers. However, the same principles can be applied to "hybrid" moiré magnifier/integral imaging devices, in which the microimages depict an object or scene from different viewpoints. Such microimages are considered substantially identical to one another for the purposes of the present invention. An example of such a device is shown schematically in FIG. 9, where FIG. 9(*a*) shows the unmagnified microimage array, without the effect of focusing elements 21, and FIG. 9(*b*) shows the appearance of the finished device, i.e. the magnified image. As shown in FIG. 9(*a*), the microimages 31 show an object, here a cube, from different angles. It should be noted that the microimages are formed as lines of one colour corresponding to the black lines of the cubes in the Figure, the remainder of the image array 30 providing a background thereto which may be coloured or contrasting. Again this arrangement could be reversed with the lines formed as colourless gaps in a coloured background layer. In the magnified image (FIG. 9(*b*)), the moiré effect generates magnified, 3D versions of the cube labelled 34. As the device is tilted the magnified cubes 34 will appear to move across the device, amounting to an effect with significant visual impact.

FIG. 10 shows another embodiment of a security device 1 in accordance with an aspect of the invention, which here is a moiré magnifier or integral imaging device. Thus whilst the physical structure of the device 1 is much the same as that described in the preceding embodiments, here the image array 30 comprises a regular array of microimages 31 rather than image slices. The microimages are arranged with a pitch mismatch and/or a rotational mismatch relative to the focussing element array 20 such that the device as a whole exhibits magnified versions of the microimages 31 as described with reference to FIGS. 8 and 9 above. The focussing element array could possess one dimensional or two dimensional periodicity, e.g. being formed of cylindrical, spherical or aspherical lenses. In a first region $R_1$ of the device, the focussing elements 21*a* carry a coloured tint, e.g.

yellow, whereas in a second region of the device $R_2$, the focussing elements 21*b* are colourless (although could possess any other colour different to that in region $R_1$). The image array 30 comprises microimages 31 which substantially match the colour of the filter 10 in region $R_1$ and hence are yellow in this example, against a colourless background (e.g. white, silver-reflective or clear).

As seen in the plan view of FIG. 10(*b*), the central second region $R_2$ here has the shape of a star whilst the first region $R_1$ provides a background thereto filling the remainder of the rectangular device area.

In the central second region $R_2$, the focussing elements 21*b* will cooperate with the microimages 31 in a standard manner to exhibit the desired optically variable effect. In the surrounding first region $R_1$, however, the matching colours of the filter 10 and the microimages 31, together with the colourless background 32, reduce or preferably prevent the visualisation of the microimages such that the appearance of the optically variable effect is substantially diminished and preferably eliminated. As a result, the device 1 appears optically variable only across star-shaped region $R_2$ and not elsewhere. This approach enables the shape, size and position of the optically variable area to be controlled solely through design of the colour filter 10 whilst the image array 30 can be provided in a continuous manner without modification. As such, more complex device designs can be achieved.

The embodiment shown in FIG. 11 advances the same principles a step further by making use of two image arrays 30*a* and 30*b*. The construction of the device 1 is otherwise the same as in the FIG. 10 example and so will not be described again here. The two image arrays 30*a* and 30*b* are formed in different colours from one another: hence, in an example the image array 30*a* is yellow (as per image array 30 in the preceding embodiment) whilst image array 30*b* is blue. Both image arrays have colourless backgrounds 32. Both of the image arrays may be provided across the whole area of the device, overlapping one another, e.g. formed in two sequential printed workings. The image arrays 30*a* and 30*b* might each define an array of microimages 31*a*, 31*b* which co-operates with the focussing element array 20 to exhibit a moiré magnification or integral imaging effect, or they could each be designed to generate different effects in combination with the focussing elements such as a moiré magnification effect from image array 30*a* and a lenticular effect from image array 30*b*. In this example, each image array 30*a*, 30*b* is adapted to generate a moiré magnification effect in combination with the focussing elements 20.

In the first region $R_1$, forming the outer surroundings of the device 1, as in the previous example, the optically variable effect from image array 30*a* is inhibited due to the colour matching between the colour filter 10 and the microimages 31*a*. However, the microimages 31*b* of the second image array 30*b* will not be inhibited since here the colours do not match. Thus, the optically variable effect arising from the second image array 30*b* (only) will be exhibited in the first region $R_1$. In the second region $R_2$ which again has here the shape of a star, since the colour filter 10 is colourless neither of the image arrays 30*a*, 30*b* will be inhibited and hence both optically variable effects will be displayed, superimposed on one another. The two image arrays can be designed to make best use of this superposition, e.g. through selection of the microimage content—for instance the microimages 31*a* could each be "£" signs and the microimages 31*b* each the digit "10" so that in combination information concerning the denomination "£10" is conveyed—and/or by configuring each set of magnified images to be visualised at different apparent heights or depths—for instance one set could appear to float above the device and the other appear sunken below it.

Alternatively, the colours could be selected so that each region of the colour filter matches one of the colours of the image arrays 30. This can be used to select single ones of the image arrays 30*a*, 30*b* etc to be active in each region. For instance if the FIG. 11 embodiment where modified such that the colour filer 10 is blue in region $R_2$, now only the optically variable effect generated by the first image array 30*a* will be exhibited in that region, whilst that generated by the second image array 30*b* will be inhibited due to the matching colours.

Generally, the colour of the colour filter 10 can therefore be used, by applying the principles above, to select which of a plurality of image arrays 30 is visualised in each region of the device. Any number of differently coloured image arrays 30 and regions could be combined in this way across the device, resulting in a highly complex appearance which is very difficult to replicate.

In some of the above embodiments, the distinctive visual effects are achieved by matching a colour of the colour filter 10 to a colour of the image array 30. However, other strong effects can be achieved by arranging a colour of the colour filter 10 to be complementary to a colour of the image array 30. A complementary colour is one which if mixed with its corresponding colour would provide substantially all wavelengths of the visible spectrum and so appear either black or white depending on whether the colour mixing mechanism is additive or subtractive. By utilising complementary colours in this way, the contrast between the various colours exhibited by the device (either between a microimage and its surroundings viewed simultaneously, or between different images in a lenticular device) can be enhanced and hence the effect made more visually distinct.

Figure 12A:
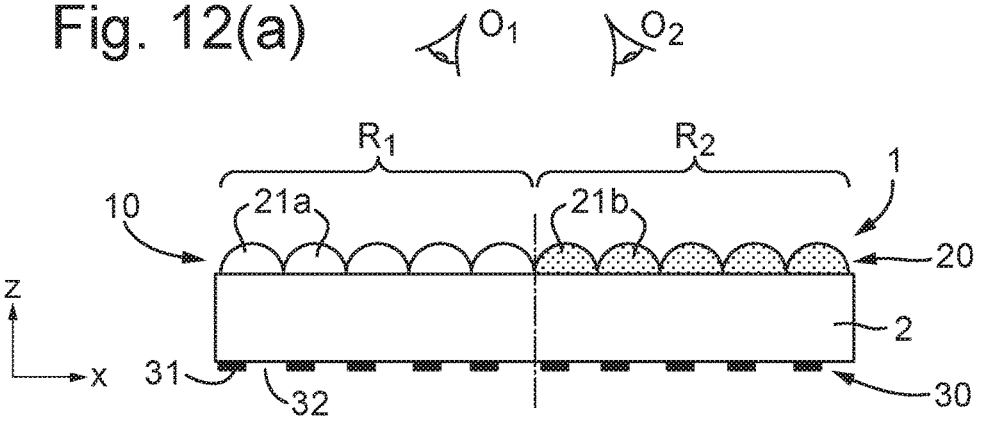
Figure 12B:
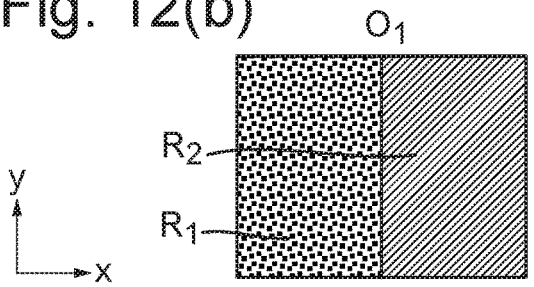
Figure 12C:
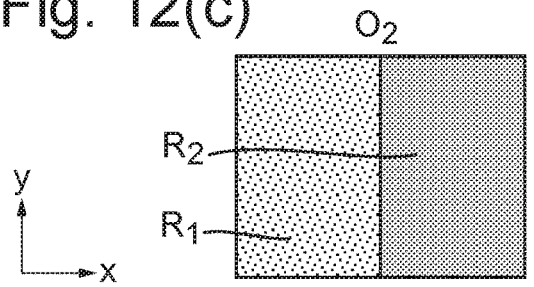
Figure 13A:
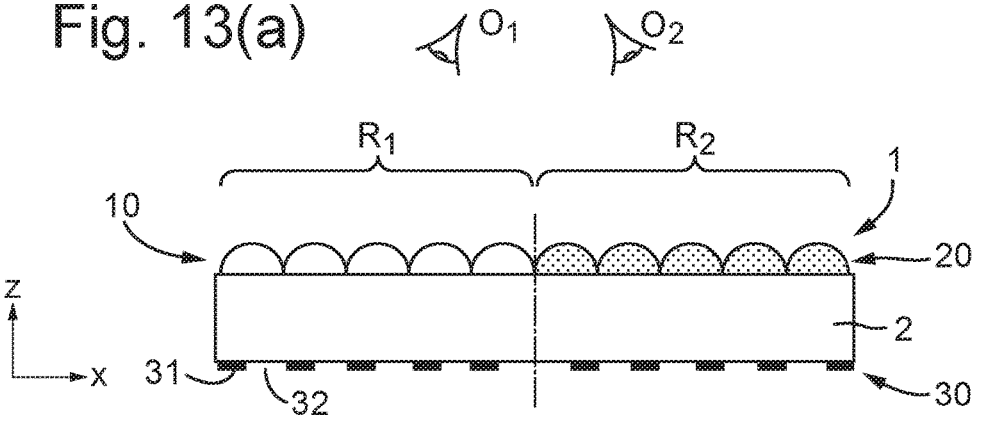
Figure 13B:
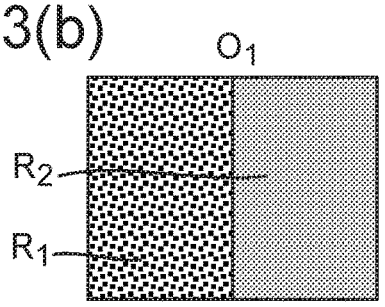
Figure 13C:
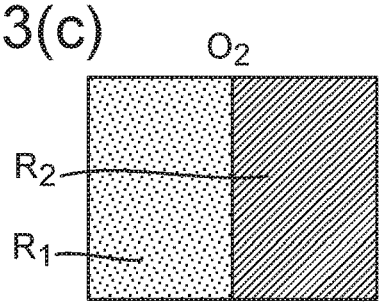

FIGS. 12 and 13 show two examples of security devices 1 utilising this principle which otherwise largely correspond in structure to the embodiments shown in FIGS. 6 and 7 respectively. Hence, only the modifications to those previous embodiments will now be described. In both examples, the security devices 1 are lenticular devices.

In the FIG. 12 embodiment, the colour filter 10 is arranged to be cyan in region $R_1$ and yellow in region $R_2$, whilst image elements 31 of array 30 are red, spaced by colourless gaps 32. Red and cyan are complementary colours according to the RGB additive colour model and the CMY subtractive colour model.

When viewed from a first viewing angle, observer $O_1$ perceives the first region $R_1$ to be very dark blue/indigo due to the combination of the cyan lenses 21*a* with the red image elements 31. The second region $R_2$ appears orange. Upon tilting to another viewing angle, the second observer $O_2$ sees the first region $R_1$ as light blue and the second region $R_2$ as yellow. Hence four different colours are visualised.

The FIG. 13 embodiment is substantially the same as the FIG. 12 embodiment except that here an additional effect is introduced by phase-shifting the image array 30 between regions as in the earlier embodiments described herein. Thus, observer $O_1$ again perceives the first region $R_1$ to be very dark blue/indigo but now the second region $R_2$ appears yellow. Upon tilting to another viewing angle, the second observer $O_2$ sees the first region $R_1$ as light blue and the second region $R_2$ as orange. Hence the position of the darker contrast region appears to move upon tilting.

In the preceding embodiments, the colour effects are achieved by the combination of the image array 30 and the overlying colour filter 10. However, still more complex effects can be achieved by additionally providing a multi-coloured backing layer which sits on the opposite side of the image array 30 and provides colour to any gaps therein between the image elements 31. FIGS. 14 to 17 provide four examples of embodiments of security devices making use of such a backing layer 40.

For ease of comparison, the embodiments of FIGS. 14 and 15 correspond in all respects other than the provision of the backing layer 40 to the embodiments just described with reference to FIGS. 12 and 13, respectively. However it should be appreciated that here it is not essential for the image array 30 to be provided in a colour which is complementary to either of the colours of the colour filter 10, although this is preferred in order to provide enhanced contrast as mentioned above.

Hence, the backing layer 40 can be provided as a printed layer or the like which covers at least part of the image array 30 on the side opposite from that on which the viewer is located in use. The backing layer 40 comprises at least two differently coloured materials 41*a*, 41*b* arranged in respective areas of the layer. It should be noted that these areas need not correspond to the aforementioned regions of the device, but this is preferred and in this example the first area of the backing layer containing material 41*a* corresponds to the first region $R_1$ whilst the second area of the backing layer containing material 41*b* corresponds to the second region $R_2$. The colours of the backing layer could be different to those of the colour filter but in this example they are the same. Hence, in region $R_1$ the focussing elements 21*a* are cyan as is the backing material 41*a*, and in region $R_2$, the focussing elements 21*b* and the backing material 41*b* are both yellow. The image elements 31 are red, spaced by colourless gaps 32.

When viewed from a first viewing angle, observer $O_1$ perceives the first region $R_1$ to be very dark blue/indigo due to the combination of the cyan lenses 21*a* with the red image elements 31. The second region $R_2$ appears orange. These colours are the same as in the FIG. 12 embodiment since the backing layer does not contribute here due to masking by the image elements 31. Upon tilting to another viewing angle, the second observer $O_2$ sees now the first region $R_1$ as bright blue and the second region $R_2$ as bright yellow, each with increased colour intensity due to the contributions from the colour filter 10 and backing layer 40.

Figure 14A:
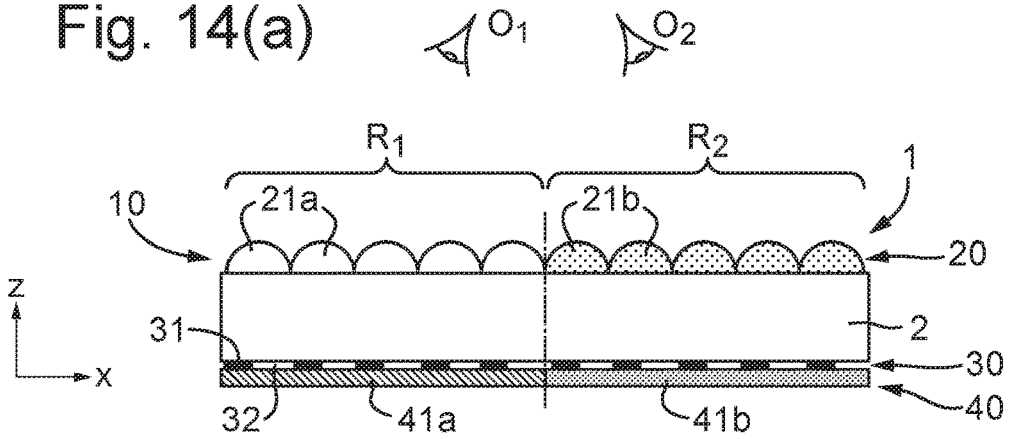
Figure 14B:
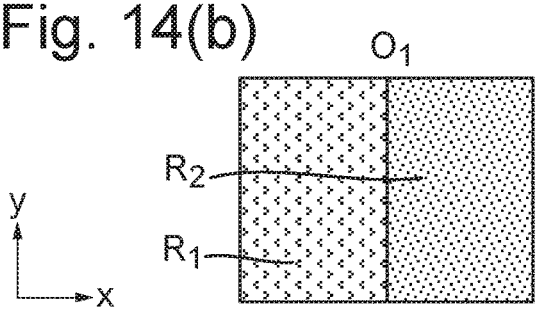
Figure 14C:
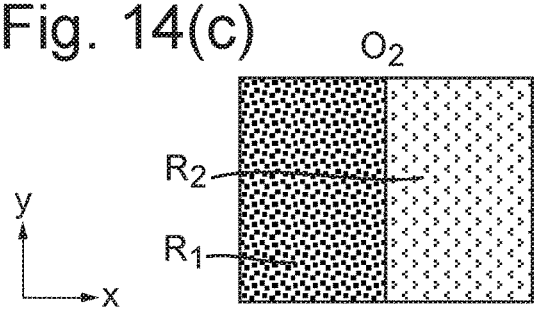
Figure 15A:
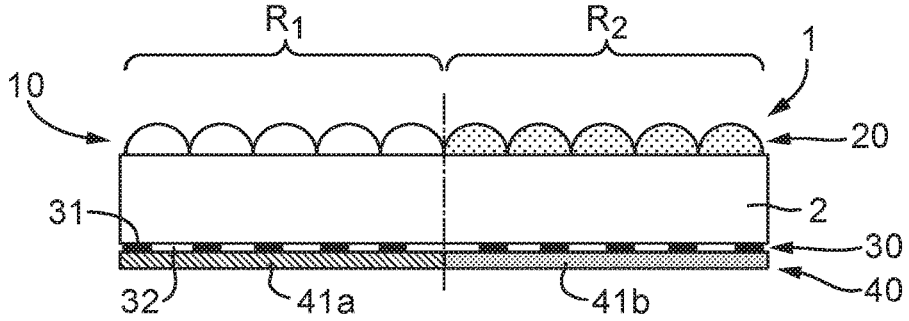
Figure 15B:
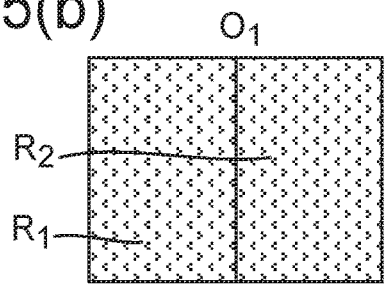
Figure 15C:
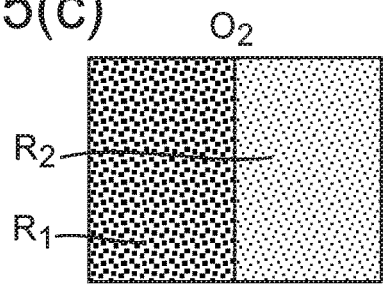

Similarly, the FIG. 15 embodiment is identical to the FIG. 14 embodiment, save for phase-shifting of the image array 30 between the two regions. Thus, observer $O_1$ again perceives the first region $R_1$ to be very dark blue/indigo but now the second region $R_2$ appears bright yellow. Upon tilting to another viewing angle, the second observer $O_2$ sees the first region $R_1$ as bright blue and the second region $R_2$ as orange. Hence the position of the darker contrast region appears to move upon tilting.

The complexity of the appearance can be further increased by arranging the areas of the backing layer 40 to differ from the regions $R_1$, $R_2$. For instance, multiple areas of the backing layer 40 could be located within any one of the regions. This is the case in the embodiments of FIGS. 16 and 17 which are otherwise structurally the same as the embodiments of FIGS. 14 and 15 respectively. Here, the backing layer 40 comprises four regions with materials 41*a* and 41*b* occupying the two halves of first region $R_1$ and materials 41*c* and 41*d* occupying the two halves of second region $R_2$. Materials 41*a* and 41*c* are cyan whilst materials 41*b* and 41*d* are yellow. The colour filter 10 is once again cyan in region $R_1$ and yellow in region $R_2$, whilst the image elements 31 are red.

When the device is viewed at a first angle by observer $O_1$, the whole of region $R_1$ appears dark blue/indigo since once again the backing layer 40 does not contribute, and similarly the second region $R_2$ appears orange. However upon tilting the arrangement of differently colours portions changes: now only half of region $R_1$ appears light blue (corresponding to area 41*a* of the backing layer) whilst the other half and the neighbouring half of the second region $R_2$ (corresponding to areas 41*b* and *c*) appear green, and the last half of region $r_2$ appears yellow (area 41*d*). Hence five different colours are exhibited across the range of viewing angles, and the pattern of differently coloured device portions also changes.

Figure 16A:
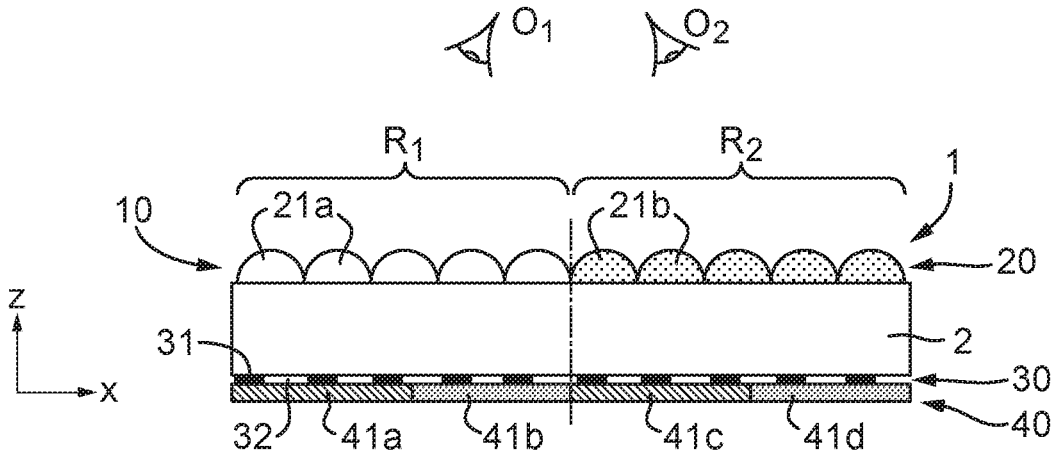
Figure 16B:
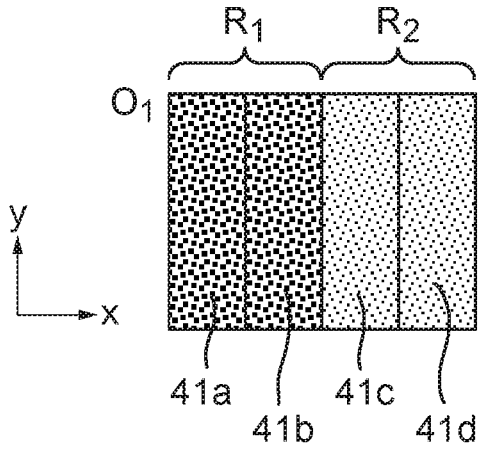
Figure 16C:
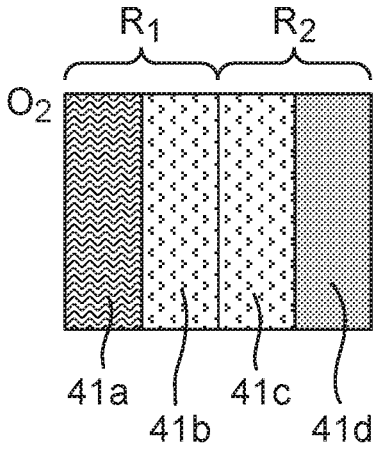
Figure 17A:
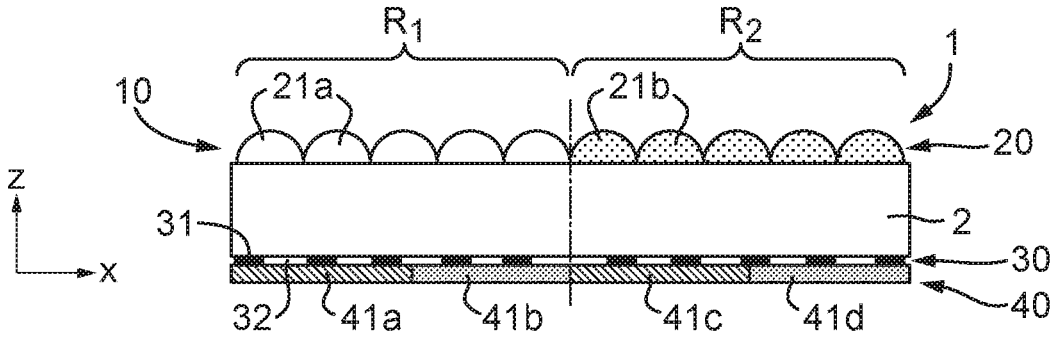
Figure 17B:
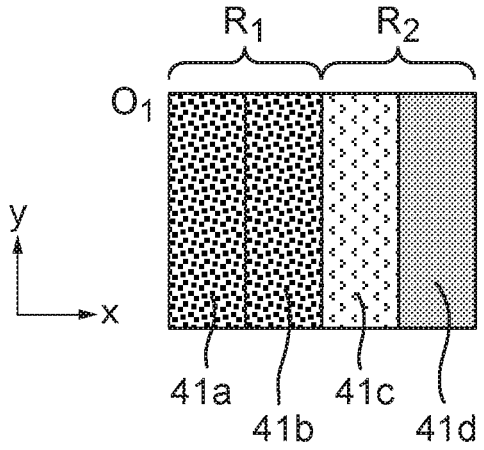
Figure 17C:
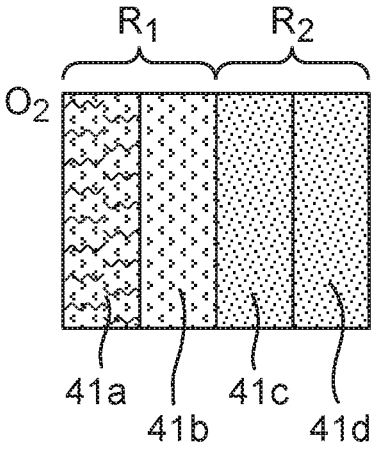

The FIG. 17 embodiment is identical to the FIG. 16 embodiment, save for phase-shifting of the image array 30 between the two regions. Thus, observer $O_1$ again perceives the first region $R_1$ to be very dark blue/indigo but now the second region $R_2$ appears in two halves: green in area 41*c* and yellow in area 41*d*. Upon tilting, observer $O_2$ now sees the first region $R_1$ split into two halves 41*a*, 41*b* which are bright blue and green respectively while the whole of region $R_2$ is orange.

In all of the embodiments described so far the colour filter 10 has been formed integrally with the focussing elements array 20, e.g. in the form of coloured lenses. Preferred methods for forming multi-coloured focussing element arrays suitable for this purpose will now be described with reference to FIGS. 18, 19 and 20, and are disclosed in more detail in our existing International patent application no. PCT/GB2016/052082.

In embodiments of the present invention, the focussing element array 20 is formed by cast-curing. This involves applying one or more transparent curable material either to the support layer or to a casting tool carrying a surface relief defining the desired focussing element array, forming the material using the casting tool and curing the material to fix the relief structure into the surface of the material.

Referring to FIG. 18, a first transparent curable material 205*a* is applied to a support layer 201 (such as the substrate 2 shown in previous embodiments) using an application module 210*a* which here comprises a patterned print cylinder 211*a* which is supplied with the curable material from a doctor chamber 213*a* via an intermediate roller 212*a*. For example, the components shown could form part of a gravure printing system. Other printing techniques such as lithographic, flexographic, screen printing or offset printing could also be used. Print processes such as these are preferred since the curable material 205*a* can then be laid down on the support 201 only in first regions 202*a* thereof, the size, shape and location of which can be selected by control of the print process, e.g. through appropriate configuration of the pattern on cylinder 211*a*. The curable material 205*a* is applied to the support 201 in an uncured (or at least not fully cured) state and therefore may be fluid or a formable solid.

A second application module 201*b* is then used to apply a second transparent curable material 205*b* to other second regions 202*b* of the support layer 201. The second application module is typically of the same construction as the first. The second transparent material 205*b* will have a different optical detection characteristic, particularly its visible colour, from the first material 205*a*.

The support 201 is then conveyed to a casting module 220 which here comprises a casting tool 221 in the form of a cylinder carrying a surface relief 225 defining the shape of the focussing elements which are to be cast into the curable materials 205*a,b*. As each patch 202 (comprising regions 202*a* and 202*b*) of curable material 205 (comprising materials 205*a* and 205*b*) comes into contact with the cylinder 221, the curable material 205 fills a corresponding region of the relief structure, forming the surface of the curable material into the shape defined by the relief. The cylinder 221 could be configured such that the relief structure 225 is only provided at regions corresponding to shape and position of the patches 202 of curable material 205. However this gives rise to the need for accurate registration between the application module 210 and the casting module 220 in order that the focussing elements are accurately placed in each first region 202 of the curable material. Therefore in a particularly preferred example, the cylinder 221 carries the relief structure corresponding to the focussing elements over an area larger than that of the patch 202, preferably around its complete circumference and most preferably over substantially its whole surface (although axial regions which will not come into the vicinity of the curable material may be excluded). In this way, each entire patch 202 of curable material 205 is guaranteed to come into contact with the surface relief structure 225 such that the focussing element array is formed over the full extent of the material. As a result, the shape, size and location of the focussing element array 20 is determined solely by the application of the curable material by the application modules.

Having been formed into the correct surface relief structure, the curable material 205 is cured by exposing it to appropriate curing energy such as radiation R from a source 222. This preferably takes place while the curable material is in contact with the surface relief 225 although if the material is already sufficiently viscous this could be performed after separation. In the example shown, the material is irradiated through the support layer 201 although the source 222 could alternatively be positioned above the support layer 201, e.g. inside cylinder 221 if the cylinder is formed from a suitable transparent material such as quartz.

The surface relief 225 may be carried by cylinder 221 in the form of a sheet embossed or otherwise provided with the required relief, which is wrapped around the cylinder 221 and clamped in place. This may result in a noticeable join 225*a* where the two ends of the sheet meet, at which there is a discrepancy in the relief pattern. If replicated into one of the focussing element arrays this would cause a reduction in quality. It is therefore preferred that the casting module is at least coarsely registered to the application module so that the location of join 225*a* where it contacts support 201 does not coincide with any of the first regions 202 but rather is located between them, as shown by the example location labelled 225*b*. In cases where the curable material is applied (and retained) all over the support, or at least along a continuous strip in the machine direction MD, this join 225*a* is still preferably positioned outside the first region which is to be used to form the security device, advantageously in a location which will subsequently be coated with one of the opacifying layers 3. To achieve this consistently it is desirable for the process for forming the focussing element array to be registered with the opacifying layer application process, e.g. performed in the same in-line process.

It will be noted that in the present example the two regions 202*a*, 202*b* (which correspond to regions $R_1$, $R_2$ in the preceding embodiments abut one another, as is preferred. Either the perimeter of the first region 202 as a whole, and/or the two regions 202*a,b* (in combination or independently of one another) preferably define indicia. The two application modules 210*a,b* are preferably registered to one another, e.g. performed in the same in-line process. The two curable materials 205*a,b* are then brought into contact with the casting cylinder 221 so as to form the surface relief into both materials, and cured as previously described. The result is a focussing element array formed of at least two materials laterally offset from one another (i.e. side by side), giving rise to an optically detectable pattern or indicia.

FIGS. 19 and 20 show two alternative apparatus arrangements which may be used to form focussing element arrays of at least two materials. In these examples, the two curable materials 205*a,b* are applied to the casting cylinder 221' rather than to the support layer 201. Thus, in the FIG. 19 embodiment, application module 210*a* selectively applies a first curable material 205*a* to first regions 202*a* of the surface relief 225 on cylinder 221' and then application module 210*b* selectively applies a second curable material 205*b* to second regions 202*b*. In each application module 210, either or both of the rollers 211, 212 in the inking chain may be patterned. For example, rollers 212*a,b* may be pattered gravure rollers configured to take up resin on selected portions of their surfaces only, with respective removal means 213*a*', 213*b*' such as doctor blades optionally being provided to remove any excess. Rollers 211*a,b* may then be uniform transfer rollers. The patterning required to form patches 202 and regions 202*a*, 202*b* could be achieved solely by the two application modules 210*a,b* in which case the focussing element relief structure 225 may be provided continuously across the whole surface of casting cylinder 221'. Alternatively, as shown in FIG. 19, the relief structure 225 may be provided only in discrete patches on the surface of cylinder 221' and an optional removal means 213*a*", 213*b*" such as respective doctor blades can be provided after each application station to remove any excess material. The precise location and extent of the patches 202 (and the regions thereof) which are ultimately formed on the support layer 201 may be determined by the manner in which the curable materials 205*a,b* and/or by the arrangement of the surface relief structure 225 on the cylinder 221'.

In a variant, shown in FIG. 20, rather than apply the two curable materials 205*a,b* onto the support layer 201 sequentially, the two application modules could be configured to apply the respective curable materials in the desired pattern onto some intermediate component, such as a blanket or an offset roller. The pattern of different curable materials can then be transferred onto the support layer 201 in a single application step. This has been found to improve the achievable registration. Thus, the apparatus shown in FIG. 20 corresponds largely to that of FIG. 19 except for the provision of collect roller 214 which is inserted between the application modules 210*a*, 210*b* and the casting cylinder 221'. Thus, each application module 210*a,b* deposits its curable material 205*a,b* in a pattern onto the surface of collect roller 214, from which both materials 205*a,b* are then transferred together onto the casting cylinder 221'. This approach has been found to achieve particularly accurate registration between the two curable materials 205*a,b*.

Figure 21A:
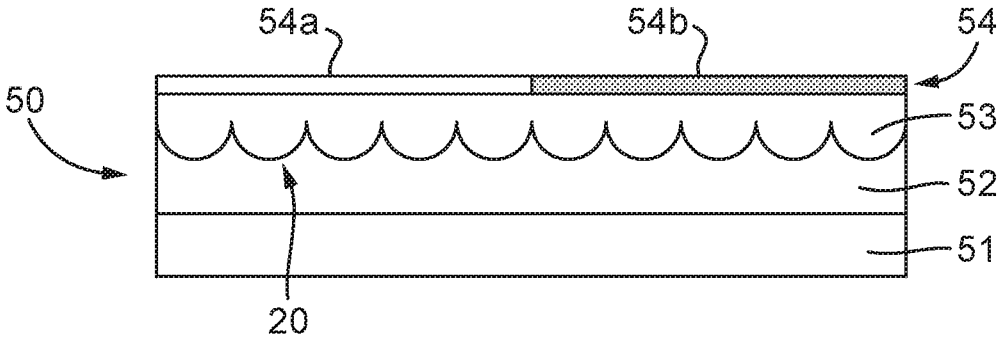

As mentioned at the outset, the colour layer could alternatively be provided at various different locations within the security device structure, and this applies to all embodiments described above. For example, the security device could be constructed utilising a lens array (or other focussing element array) formed as a transfer element which is then affixed to a substrate carrying the image array on its opposite side. The substrate could be that of a polymer banknote, for example. FIG. 21*a* shows a cross-section through an exemplary lens transfer structure 50 formed using methods disclosed in our British patent application no. 1607480.9. The lens transfer structure 50 comprises a layer of carrier material 51, an upper surface of which has preferably been corona treated. On the upper surface of the carrier material is a layer of first material 52, which is substantially transparent, and has a first refractive index, of 1.35 for example. The upper surface of the first material 52 is shaped into a lens relief structure, which in this embodiment is a regular two-dimensional array of concavities suitable for functioning as a two-dimensional array of spherical lenses. Over the lens relief structure, i.e. over and in contact with the upper surface of the first material 52, is located a layer of second material 53, a lower surface of which conforms to the lens relief structure, and an upper surface of which is spaced from the lens relief structure and is substantially flat. The second material is also substantially transparent, and has a second, different refractive index, of 1.55 for example. The refractive index of the second material 26 is higher than that of the first material 21 such that the second material filling the concavities in the surface of the first material acts as an array of spherical, convex lenses, in this example. The transfer structure 50 is also provided with an adhesive layer 54 for affixing the lens structure to a substrate, although this adhesive layer could alternatively be provided on the substrate itself. The adhesive 54 is preferably heat-activated so that portions of the transfer element can be transferred to the substrate by hot stamping for example. In this embodiment, the adhesive layer 54 provides the colour filter 10. Hence, different portions of the adhesive layer 54 are differently coloured. In this example, two differently coloured regions 54*a* and 54*b* are shown to illustrate this.

Figure 21B:
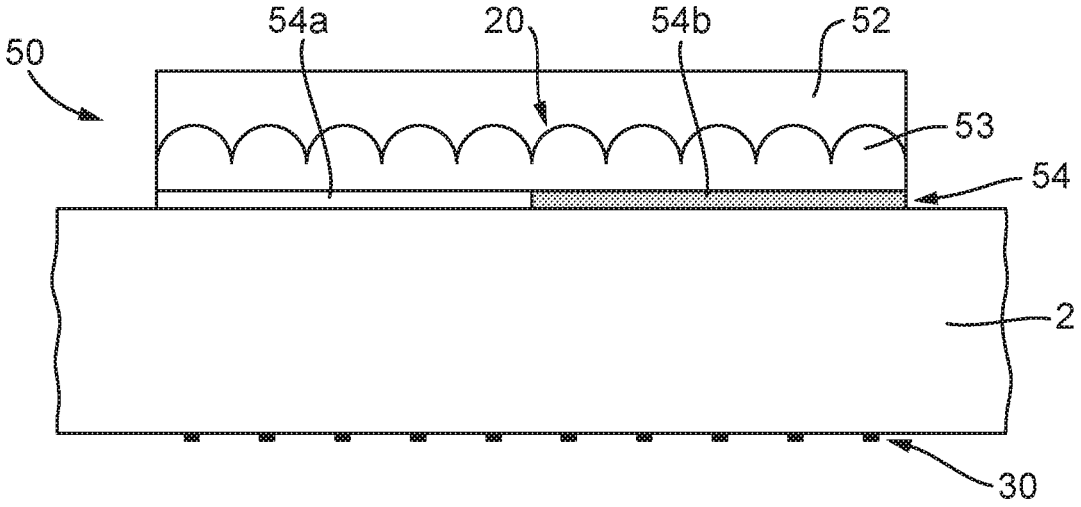

FIG. 21*b* shows the lens structure 50 described above having been transferred onto a security article, in this case a security document, however it could equally be transferred to any substrate, for example a security element such as a security thread. Transfer of the lens structure may be achieved by placing the upper surface of the lens transfer structure, i.e. the substantially flat surface of the second material 53 or the adhesive layer 54 if this is present, in contact with a surface of a substrate 2 of a security document (if the adhesive layer 54 is not provided as part of the transfer element 50 this will be pre-applied to the surface of substrate 2). The carrier layer 51 is then peeled away from the lens structure, leaving the lens structure formed by layers of the first and second material 52 and 53, and adhesive layer 54, on the surface of the substrate. The carrier layer is removed substantially without distorting the lens array provided within the lens structure since the peel strength of the bond between the carrier layer 51 and the first material 52 is relatively low, and in particular, is lower than the peel strength of the bond between the first and second materials 52 and 53.

FIG. 21*b* shows the lens structure on a transparent substrate 2, which may for example be a polymer, such as biaxially oriented polypropylene (BOPP) as used in polymer banknotes. On a surface of the substrate 2 opposite to the lens structure is located image array 30. As previously described, the colour filter layer 54 will act to modify the appearance of the image array 30 and hence of the optically variable effect ultimately generated by the device.

In a variant of this embodiment, rather than colour the adhesive layer 54, a colour filter layer may be applied between layers 53 and 54 or printed onto the surface of substrate 2 before the lens transfer structure 50 is applied.

FIG. 22*a* schematically shows a further embodiment in which the colour filter 10 is provided in the form of a multi-coloured pedestal layer 25 located under the focussing element array on the surface of substrate 2, which is colourless (or of a single uniform colour) across the device. In this example the device has three concentric regions $R_1$, $R_2$ and $R_3$ in each of which the pedestal layer is formed by a differently coloured transparent material 25*a*, 25*b*, 25*c*. Pedestal layers are described in more detail in our existing International Patent Application No. PCT/GB2016/052085 and typically have a preferred height in the region of at least 1 micron, more preferably at least 3 microns and most preferably at least 5 microns. The pedestal materials 10*a,b,c* are preferably flexible elastomers which helps improve the resilience of the device 1.

A preferred method for forming a focussing element array with a pedestal layer will now be discussed with reference to FIG. 22*b*. Again, this involves cast-curing and any of the method variants described above could be employed for application of the curable material(s) 205 and forming thereof. However, an additional layer, referred to as a pedestal layer 25, is formed between the curable material(s) in which the focussing element array is defined and the support layer 201.

Thus FIG. 22*b* shows an exemplary process in which, prior to application of the curable material 205 to the support layer 201, a pedestal layer 25 is formed by applying at least two transparent materials 207*a,b* to the support layer 201, using pedestal application modules 240*a,b*. Again this could involve printing or coating the transparent materials 207*a,b* onto the support layer using any of the same methods as previous mentioned for the application of curable material 205, such as gravure printing. In this example the material 207*a* is applied to a patterned gravure roller 241*a* from a reservoir 243*a* and a removal means 243*a*' such as a doctor blade is provided for removing any excess material. If necessary, the support layer is then conveyed through a drying and/or curing section 245*a* to fix the material 207*a*. Whether the section 245*a* involves drying and/or curing will depend on the nature of the material 208*a*. Next the support layer 201 is conveyed through a second pedestal application module 240*b* at which a section transparent material 207*b*, of different colour, is applied selectively to a second region 208*b* of the support layer 201, in register with the first material 207*a*. The apparatus of the second pedestal application module 240*b* corresponds to that of the first pedestal application module 240*a* in this example. Again, a drying and/or curing section 245*b* may be provided for fixing the second material 207*b*. The pedestal materials 207*a,b* do need to cover at least the patches 202 in which the focussing element arrays are to be formed. In the example depicted, the areas 208*a,b* to which the pedestal materials 207*a,b* are applied are coincident with the patches 202, but this is not essential, and indeed may not be desirable since this gives rise to greater registration requirements. In more preferred examples, the each pair of regions 208*a,b* to which the pedestal materials 207*a,b* are applied are collectively larger than the extent of the respective focussing element array to be formed thereon, at least in the machine direction MD. This reduces the accuracy with which the lens application and formation stage must be registered to the pedestal application stage.

The transparent materials 207*a,b* forming the pedestal layer may or may not also be a curable material. If not, the transparent material is preferably dried or otherwise solidified sufficiently before proceeding. If the material is curable, it may be cured during application from cylinder 241*a,b* or after, possibly at the same time as curing the curable material 205. However, preferably at least partial curing of material 207*a,b* takes place before curable material 205 is applied, which takes place at application station 210. In this example, this comprises a patterned gravure cylinder 211 onto which the curable material 205 is applied from a reservoir 213, a doctor blade 213' or similar being provided to remove excess. The curable material 205 can be applied in the same way as previously described but now is applied onto the pedestal layer 25 rather than onto the support layer 201. The curable material is then brought into contact with the casting tool 221 at casting station 220 in the same manner as previously described, and the focussing element array formed and cured into material 205.

FIG. 23 illustrates an embodiment of a security device in which the colour filter 10 is again provided in a different location within the security element, as a base layer 35 located between the image array 30 and the substrate 2. Thus, the focussing element array 20 itself and any pedestal layer 25 provided can be colourless or of uniform colour across the device. The base layer 35 comprises at least two transparent materials of different colour arranged in respective concentric regions of the device. Hence in first region $R_1$, the base layer 35 is formed of a first material 35*a* with a first colour, in second region $R_2$, the base layer 35 is formed of a second material 35*b* with a second colour and in third region 35*c* the base layer 35 is formed of a third material 35*c* with a third colour.

Such a base layer 35 could be formed in various different ways. In some preferred examples, the base layer could be printed or otherwise applied to the surface of substrate 2 using any convenient application technique, such as gravure printing or the like, the various different materials being applied in register with one another. The image array 30 would then be formed and affixed over the top of the existing base layer.

However in other preferred embodiments, the coloured base layer 35 can take the form of a tie coat which is created integrally with the image array 30 and some preferred techniques for achieving this will now be described with reference to FIGS. 24 and 25.

FIG. 24(*a*) shows a first preferred embodiment of a method for forming the image array 30, which is based on the principles disclosed in WO 2014/070079 A1, where more details can be found. The image array is formed on an image array support layer 301, which is preferably transparent, and such as the polymer substrate 2 mentioned above. The image array support layer 301 is preferably pre-primed, e.g. by applying a primer layer such as a thin, optically clear UV adhesive layer (not shown) or by raising its surface energy e.g. by corona treatment. The desired pattern of image elements which are to form the image array 30 (e.g. microimages, or slices of interleaved images) is defined by recessed areas in the surface 303 of a die form 302. Each recessed area preferably has a depth of the order of 1 to 10 microns, more typically 1 to 5 microns, and a width in the range 0.5 to 5 microns. The recessed areas are separated by raised areas of that surface 303. The die form preferably takes the form of a cylinder, but this is not essential.

The recessed areas of the die form are filled with a curable material 305, which is preferably visibly coloured (including white, grey or black). The material 305 may or may not be transparent. An exemplary application module for applying the material 305 into the recessed areas is shown at 310*a*. This includes a slot die 312*a* configured to supply the curable material 305 to a transfer roller 311*a* from which it is applied to the die form surface 303. The shore hardness of the transfer roller 311*a* is preferably sufficiently low that some compression/compliance is achieved to improve the transfer of material to the die form 302, which is typically relatively rigid such as a metal print cylinder. The applied ink layer should match or exceed the depth of the recessed areas. The viscosity of the curable material may be configured so that the material 305 transfers substantially only into the recessed areas of the die form and not onto the raised surfaces but in case any of the material 305 remains on the raised surfaces it is preferred to provide a removal means such as doctor blade 315*a* to remove any such excess material 305 from outside the recessed areas. The material 305 in the recessed areas is preferably then at least partially cured by exposing the material 305 to appropriate curing energy, e.g. radiation, from a source 320*a*, although this curing could be performed at a later stage of the process.

Any suitable curable material 305 could be used, such as a thermally-curable resin or lacquer. However, preferably, the curable material is a radiation curable material, preferably a UV curable material, and the curing energy source is a radiation source, preferably a UV source. UV curable polymers employing free radical or cationic UV polymerisation are suitable for use as the UV curable material. Examples of free radical systems include photo-crosslinkable acrylate-methacrylate or aromatic vinyl oligomeric resins. Examples of cationic systems include cycloaliphatic epoxides. Hybrid polymer systems can also be employed combining both free radical and cationic UV polymerization. Electron beam curable materials would also be appropriate for use in the presently disclosed methods. Electron beam formulations are similar to UV free radical systems but do not require the presence of free radicals to initiate the curing process. Instead the curing process is initiated by high energy electrons.

The finished pattern should be visible (optionally after magnification) to the human eye and so the curable material comprises at least one colourant which is visible under illumination within the visible spectrum. For instance, the material may carry a coloured tint or may be opaque. The colour will be provided by one or more pigments or dyes as is known in the art. Additionally or alternatively, the curable material may comprise at least one substance which is not visible under illumination within the visible spectrum and emits in the visible spectrum under non-visible illumination, preferably UV or IR. In preferred examples, the curable material comprises any of: luminescent, phosphorescent, fluorescent, magnetic, thermochromic, photochromic, iridescent, metallic, optically variable or pearlescent pigments.

If the first application module 310*a* achieves substantially complete filling of the recessed areas with material 305 then no further application of curable material 305 may be required. However it has been found that the recessed areas may not be fully filled by a single application process and so, in particularly preferred embodiments, a second application module (not shown) may be provided downstream of the first (and preferably of curing source 320*a*) for applying more of the same material 305 to the die form.

Next, a tie coat 35 formed of at least two second curable materials 35*a*, 35*b* is applied over substantially the whole surface of the die form 303, i.e. coating both the filled recessed areas and the raised areas of the surface 303. The second curable materials may be of the same composition as the first curable material but are of a different appearance so as to provide a visual contrast with the first material in the finished array, as well as with each other. In particularly preferred embodiments, the tie coat composition may be selected so as to improve the adhesion between the first curable material and the support layer 301. The tie coat materials 35*a*, 35*b* are applied by respective tie coat application modules 330*a,b* which here each comprise a slot die 332 and a patterned transfer roller 331 which defines the different regions $R_1$, $R_2$ etc of the finished device.

Preferably the two tie coat application modules 330*a,b* are registered to one another. In this way, each of the second materials 35*a*, 35*b* is applied to different respective parts of the cylinder 302 resulting in the desired differently coloured regions of the tie coat 35.

The multi-coloured tie coat 35 may be partially cured at this point by a further radiation source (not shown). The die form surface carrying the filled recesses and tie coat is then brought into contact with the support layer 301, either at a nip point or, more preferably, along a partial wrap contact region between two rollers 309*a*, 309*b* as shown. The combination is then exposed to curing energy, e.g. from radiation source 335, preferably while the support layer 301 is in contact with the die form surface. The support layer 301 is then separated from the die form at roller 309*b*, carrying with it the tie coat 35 and the elements of material 305 removed from the recessed areas of the die form surface 303 by the tie coat 307. The material 305 is therefore present on the support layer 301 in accordance with the desired pattern, forming image array 30.

The tie coat 35 is preferably at least partially cured before the die form 302 leaves contact with the support layer 301 at roller 309*b*, hence the preferred use of a partial wrap contact via lay on and peel off rollers 309*a, b* as shown which tension the web around the die form cylinder. If the material is not fully cured in this step, an additional curing station may be provided downstream (not shown) to complete the cure.

In a variant, after the tie coat 35 has been applied, a removal means such as a further doctor blade could be provided to remove the tie coat 307 from the raised portions of the die form surface 303 such that the regions of the tie coat 307 are confined to the print images. These tie coat regions will most likely not be proud of the die form surface. As such the support layer 301 in this embodiment is preferably primed with a compliant adhesive layer which may be partly cured prior to contacting the die form but should still be compliant before entering the curing wrap.

FIG. 24(*b*) shows a second preferred embodiment which corresponds in substantially all respects to that described above with reference to FIG. 24(*a*), the only difference being that here the two tie-coat materials 35*a*, 35*b* are each applied by the patterned rollers 331*a*, 331*b* to an intermediate collection roller 335 from which the two materials are then transferred simultaneously onto the cylinder 302 to form the tie coat 35. This approach has been found to achieve improved register between the tie coat materials.

It will be appreciated that whilst in the above examples only two tie coat materials 35*a, b* are utilised, in practice any number of such materials could be used to form the tie coat 35 so that any number of differently coloured regions can be formed.

Figure 25A:
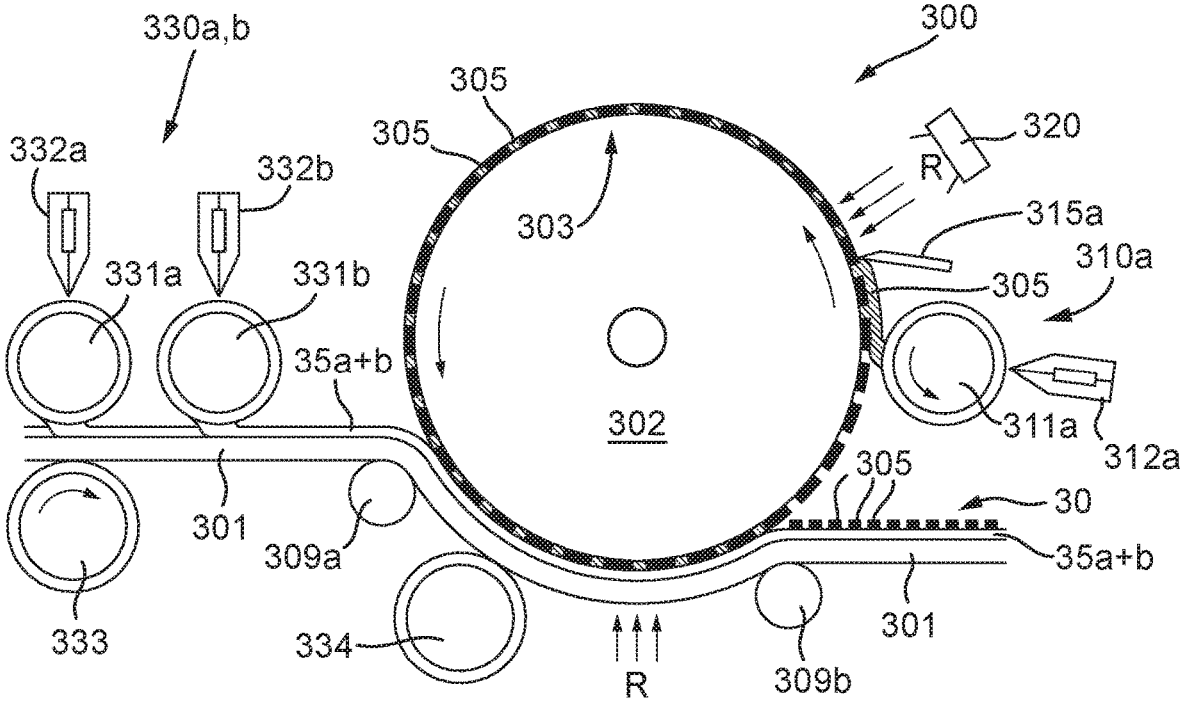
Figure 25B:
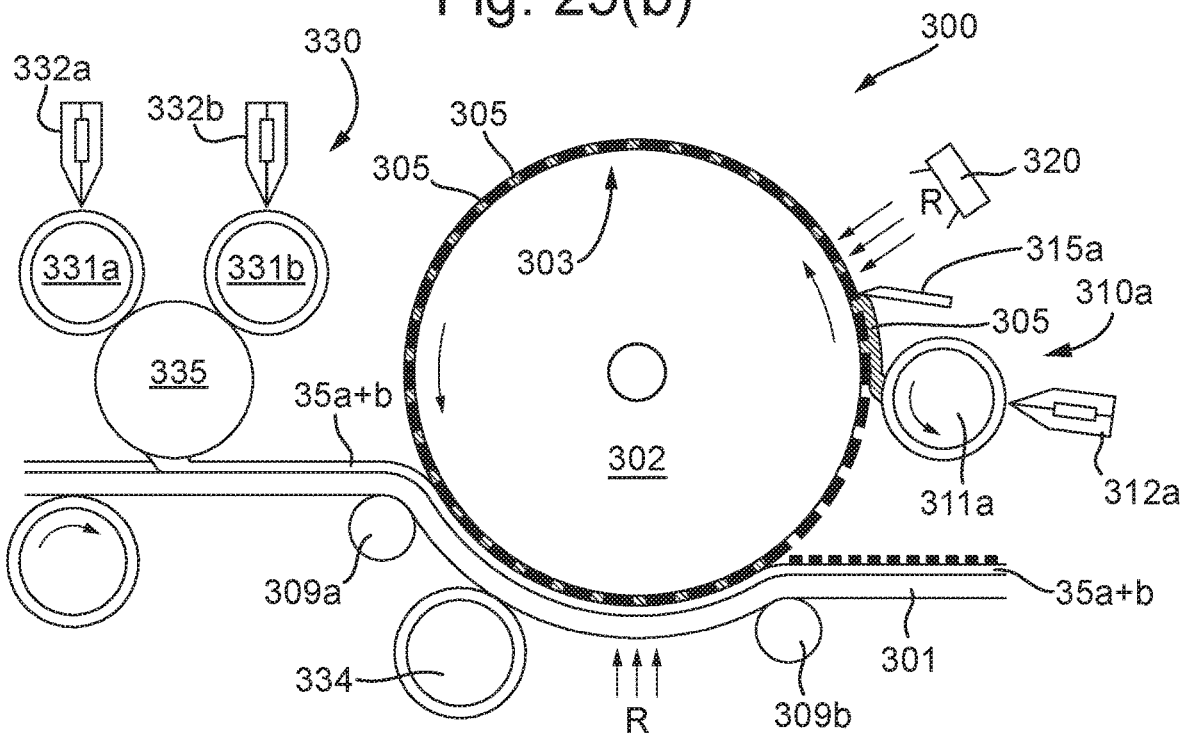

Another embodiment of a method for forming an image array 30 is shown in FIG. 25. In many respects this is the same as described above with reference to FIG. 24 and so like items are labelled with the same reference numbers and will not be described again. The main difference is that here, the tie coat 35 is not applied to the die form surface 303 but rather to the surface of support layer 301, upstream of the point at which it is brought into contact with the die form. Thus the tie coat application module 330 is positioned upstream and is configured to apply the materials 35*a,b* to the surface of support layer 301. As before, each tie coat material 35*a,b* can be applied in a patterned manner to the support layer 301 by a respective tie coat application module 330*a,b* comprising for instance a slot die 332*a,b* feeding a patterned roller 331*a,b*, with an impression roller 333 being provided on the opposite side of the substrate. The tie coat application modules 330*a,b* are preferably registered to one another as before and result in the desired arrangement of differently coloured regions forming the tie coat 35.

The support layer 201 carrying the tie coat 35 is then brought into contact with the die form surface so as to cover the filled recessed areas and adjacent raised areas with the tie coat 35. Preferably the tie coat 35 is pressed into the recessed areas so as to achieve good joining therebetween before the curing process begins. A second impression roller 334 may be provided for this purpose, located after the lay on roller 309*a* but before curing module 335.

FIG. 25(*b*) shows a variant of the FIG. 25(*a*) method in which the two tie coat materials 35*a,b*, are each applied to an intermediate transfer roller 335 and then applied simultaneously to the support layer 301. Again this has been found to result in improved register between the materials.

In the above embodiments, the colour filter 10 has been provided at a single location within the security device structure, i.e. either integrally with the focussing element array, as a pedestal layer, as an intermediate layer between substrates or as a base layer of the image array. However it is also possible to provide the colour filter using a combination of these approaches either in different respective regions of the device or together in the same region(s). For instance, in one region of the device the colour filter could be integrally provided in the focussing element array 20 whilst in another region it could take the form of a pedestal layer 25 and in yet another region it could be provided by a base coat 35 to the image array 30. Whilst the various parts of the colour filter will then be located at different heights within the device, this will not be apparent to the observer. Alternatively or in addition the different parts of the colour filter could overlap one another, either across the whole device or in portions thereof. In this case the effective colour of each region of the colour filter will be that created by the overlapping portions in combination with one another.

FIGS. 26 and 27 illustrate two further embodiments of security devices in which the colour filter is provided at multiple locations across the device 1, although in this case all of the portions of the filter 10 are formed as a base layer to respective image arrays 30, e.g. in the form of tie-coats. In the FIG. 26 embodiment, the device substrate 2 is formed of two transparent substrate layers 2*a*, 2*b* which are laminated together. The focussing element array 20 is colourless and is formed on a first surface of layer 2*a*. On the second surface of layer 2*a* are formed two areas of a first image array 30*a* and in each cases these are located on a base layer 35*a* which is arranged in two regions of different coloured materials 10*a*, 10*b*. For instance, the base layer 35*a* could be formed as a tie coat using any of the methods described above in relations to FIGS. 24 and 25. The first surface of second substrate layer 2*b* is affixed over the first image array 30*a* and on its second surface a second image array 30*b* is provided, which also sits on a base coat 35*b* which here is of a single colour. Thus, the colour filter 10 as a whole is made up of three parts: 10(*i*) and 10(*iii*) which are laterally spaced portions of base coat 35*a*, sitting at the interface between substrate layers 2*a* and 2*b*, and 10(*ii*) which is formed by base coat 35*b* located on the outer surface of substrate layer 2*b*. The result is an arrangement of three concentric regions across the device 1: region $R_1$ in which the colour filter 10 has the colour of material 10*a* (e.g. blue), region $R_2$ in which the colour filter 10 has the colour of material 10*b* (e.g. green) and region $R_3$ in which the colour filter has the colour of material 10*c* (e.g. yellow). The arrangement of colours in the filter 10 can be selected and combined with colours of the image arrays 30*a,b* to offer any of the enhanced security effects already described above.

Since the image arrays 30*a*, 30*b* are located on different substrate surfaces, it may be desirable to vary the focal position of the focussing elements between regions, in order that the image elements remain in focus across the device. This could be achieved for instance by forming the focussing elements 21 in region $R_3$ with a different shape for those in regions $R_1$ and $R_2$ such that they have a longer focal distance. Alternatively, the focussing elements in regions $R_1$ and $R_2$ could be placed on pedestal layers to raise them away from the surface of substrate 2*a* so that their focal position is raised accordingly relative to that in region $R_3$.

The construction of the exemplary security device shown in FIG. 27 is substantially the same as that in 27 except that here each of the individual base layers 35*a,b* making up the colour filter 10 is of a single colour and they partially overlap to create additional colours. Hence, base layer 10*a* extends across regions $R_1$ and $R_2$ and is blue in both, whilst base layer 35*b* extends across regions $R_2$ and $R_3$ and is yellow in both. As a result the device will have substantially the same appearance as in FIG. 26 with region $R_1$ appearing blue, $R_2$ appearing green (due to the overlapping yellow and blue filters) and $R_3$ appearing yellow. It will be noted that the arrangement of image elements in arrays 30*a,b* has been modified to ensure that all portions of the colour filter are located between the arrays and the viewer.

In order to achieve an acceptably low thickness of the security device (e.g. around 70 microns or less where the device is to be formed on a transparent document substrate, such as a polymer banknote, or around 40 microns or less where the device is to be formed on a thread, foil or patch), the pitch of the lenses must also be around the same order of magnitude (e.g. 70 microns or 40 microns). Therefore the width of the image slices or microimages 31 is preferably no more than half such dimensions, e.g. 35 microns or less.

As mentioned above, the thickness of the device 1 is directly related to the size of the focusing elements and so the optical geometry must be taken into account when selecting the thickness of the transparent layer 2. In preferred examples the device thickness is in the range 5 to 200 microns. "Thick" devices at the upper end of this range are suitable for incorporation into documents such as identification cards and drivers licences, as well as into labels and similar. For documents such as banknotes, thinner devices are desired as mentioned above. At the lower end of the range, the limit is set by diffraction effects that arise as the focusing element diameter reduces: e.g. lenses of less than 10 micron base width (hence focal length approximately 10 microns) and more especially less than 5 microns (focal length approximately 5 microns) will tend to suffer from such effects. Therefore the limiting thickness of such structures is believed to lie between about 5 and 10 microns.

Whilst in the above embodiments, the focusing elements have taken the form of lenses, in all cases these could be substituted by an array of focusing mirror elements. Suitable mirrors could be formed for example by applying a reflective layer such as a suitable metal to the cast-cured or embossed lens relief structure. In embodiments making use of mirrors, the image array should be semi-transparent, e.g. having a sufficiently low fill factor to allow light to reach the mirrors and then reflect back through the gaps between the image elements. For example, the fill factor would need to be less than $1/\sqrt{2}$ in order that that at least 50% of the incident light is reflected back to the observer on two passes through the image element array.

In all of the embodiments described above, the security level can be increased further by incorporating a magnetic material into the device. This can be achieved in various ways. For example an additional layer may be provided (e.g. under the image array 30) which may be formed of, or comprise, magnetic material. The whole layer could be magnetic or the magnetic material could be confined to certain areas, e.g. arranged in the form of a pattern or code, such as a barcode. The presence of the magnetic layer could be concealed from one or both sides, e.g. by providing one or more masking layer(s), which may be metal. If the focussing elements are provided by mirrors, a magnetic layer may be located under the mirrors rather than under the image array.

Security devices of the sort described above can be incorporated into or applied to any article for which an authenticity check is desirable. In particular, such devices may be applied to or incorporated into documents of value such as banknotes, passports, driving licences, cheques, identification cards etc.

The security device or article can be arranged either wholly on the surface of the base substrate of the security document, as in the case of a stripe or patch, or can be visible only partly on the surface of the document substrate, e.g. in the form of a windowed security thread. Security threads are now present in many of the world's currencies as well as vouchers, passports, travellers' cheques and other documents. In many cases the thread is provided in a partially embedded or windowed fashion where the thread appears to weave in and out of the paper and is visible in windows in one or both surfaces of the base substrate. One method for producing paper with so-called windowed threads can be found in EP-A-0059056. EP-A-0860298 and WO-A-03095188 describe different approaches for the embedding of wider partially exposed threads into a paper substrate. Wide threads, typically having a width of 2 to 6 mm, are particularly useful as the additional exposed thread surface area allows for better use of optically variable devices, such as that presently disclosed.

The security device or article may be subsequently incorporated into a paper or polymer base substrate so that it is viewable from both sides of the finished security substrate. Methods of incorporating security elements in such a manner are described in EP-A-1141480 and WO-A-03054297. In the method described in EP-A-1141480, one side of the security element is wholly exposed at one surface of the substrate in which it is partially embedded, and partially exposed in windows at the other surface of the substrate.

Base substrates suitable for making security substrates for security documents may be formed from any conventional materials, including paper and polymer. Techniques are known in the art for forming substantially transparent regions in each of these types of substrate. For example, WO-A-8300659 describes a polymer banknote formed from a transparent substrate comprising an opacifying coating on both sides of the substrate. The opacifying coating is omitted in localised regions on both sides of the substrate to form a transparent region. In this case the transparent substrate can be an integral part of the security device or a separate security device can be applied to the transparent substrate of the document. WO-A-0039391 describes a method of making a transparent region in a paper substrate. Other methods for forming transparent regions in paper substrates are described in EP-A-723501, EP-A-724519, WO-A-03054297 and EP-A-1398174.

The security device may also be applied to one side of a paper substrate so that portions are located in an aperture formed in the paper substrate. An example of a method of producing such an aperture can be found in WO-A-03054297. An alternative method of incorporating a security element which is visible in apertures in one side of a paper substrate and wholly exposed on the other side of the paper substrate can be found in WO-A-2000/39391.

Examples of such documents of value and techniques for incorporating a security device will now be described with reference to FIGS. 28 to 31, FIG. 28 depicts an exemplary document of value 100, here in the form of a banknote. FIG. 28*a* shows the banknote in plan view whilst FIG. 28*b* shows the same banknote in cross-section along the line Q-Q'. In this case, the banknote is a polymer (or hybrid polymer/paper) banknote, having a transparent substrate 102. Two ° pacifying layers 103*a* and 103*b* are applied to either side of the transparent substrate 102, which may take the form of opacifying coatings such as white ink, or could be paper layers laminated to the substrate 102.

The opacifying layers 103*a* and 103*b* are omitted across an area 101 which forms a window within which the security device is located. As shown best in the cross-section of FIG. 28*b*, an array of focusing elements 20 is provided on one side of the transparent substrate 102, and a corresponding image element array 30 is provided on the opposite surface of the substrate (the colour filter 10 is not shown but will be present). The focusing element array 20 and image element array 30 are each as described above with respect to any of the disclosed embodiments, such that the device 1 displays an optically variable effect in window 101 upon tilting the device (an image of the letter "A" is depicted here as an example). It should be noted that in modifications of this embodiment the window 101 could be a half-window with the opacifying layer 103*b* continuing across all or part of the window over the image element array 30. In this case, the window will not be transparent but may (or may not) still appear relatively translucent compared to its surroundings. The banknote may also comprise a series of windows or half-windows. In this case the different regions displayed by the security device could appear in different ones of the windows, at least at some viewing angles, and could move from one window to another upon tilting.

FIG. 29 shows such an example, although here the banknote 100 is a conventional paper-based banknote provided with a security article 105 in the form of a security thread, which is inserted during paper-making such that it is partially embedded into the paper so that portions of the paper 104 lie on either side of the thread. This can be done using the techniques described in EP0059056 where paper is not formed in the window regions during the paper making process thus exposing the security thread in is incorporated between layers of the paper. The security thread 105 is exposed in window regions 101 of the banknote. Alternatively the window regions 101 which may for example be formed by abrading the surface of the paper in these regions after insertion of the thread. The security device is formed on the thread 105, which comprises a transparent substrate with lens array 20 provided on one side and image element array 30 provided on the other. In the illustration, the lens array 20 is depicted as being discontinuous between each exposed region of the thread, although in practice typically this will not be the case and the security device will be formed continuously along the thread.

If desired, several different security devices 1 could be arranged along the thread, with different or effects displayed by each. In one example, a first window could contain a first device, and a second window could contain a second device, each having their focusing elements arranged along different (preferably orthogonal) directions, so that the two windows display different effects upon tilting in any one direction. For instance, the central window may be configured to exhibit a motion effect when the document 100 is tilted about the x axis whilst the devices in the top and bottom windows remain static, and vice versa when the document is tilted about the y axis.

In FIG. 30, the banknote 100 is again a conventional paper-based banknote, provided with a strip element or insert 108. The strip 108 is based on a transparent substrate and is inserted between two plies of paper 109*a* and 109*b*. The security device is formed by a lens array 18 on one side of the strip substrate, and an image element array 70 on the other. The paper plies 109*a* and 109*b* are apertured across region 101 to reveal the security device, which in this case may be present across the whole of the strip 108 or could be localised within the aperture region 101. The focusing elements 20 are arranged with their long direction along the X axis which here is parallel to the long edge of the note. Hence the lenticular effect will appear to activate upon tilting the note about the X-axis.

A further embodiment is shown in FIG. 31 where FIGS. 31(*a*) and (*b*) show the front and rear sides of the document 100 respectively, and FIG. 31(*c*) is a cross section along line Z-Z'. Security article 110 is a strip or band comprising a security device according to any of the embodiments described above. The security article 110 is formed into a security document 100 comprising a fibrous substrate 102, using a method described in EP-A-1141480. The strip is incorporated into the security document such that it is fully exposed on one side of the document (FIG. 31(*a*)) and exposed in one or more windows 101 on the opposite side of the document (FIG. 31(*b*)), Again, the security device is formed on the strip 110, which comprises a transparent substrate with a lens array 20 formed on one surface and image element array 30 formed on the other.

In FIG. 31, the document of value 100 is again a conventional paper-based banknote and again includes a strip element 110. In this case there is a single ply of paper. Alternatively a similar construction can be achieved by providing paper 102 with an aperture 101 and adhering the strip element 110 on to one side of the paper 102 across the aperture 101. The aperture may be formed during paper-making or after papermaking for example by die-cutting or laser cutting. Again, the security device is formed on the strip 110, which comprises a transparent substrate with a lens array 20 formed on one surface and image element array 30 formed on the other.

In general, when applying a security article such as a strip or patch carrying the security device to a document, it is preferable to have the side of the device carrying the image element array bonded to the document substrate and not the lens side, since contact between lenses and an adhesive can render the lenses inoperative. However, the adhesive could be applied to the lens array as a pattern that the leaves an intended windowed zone of the lens array uncoated, with the strip or patch then being applied in register (in the machine direction of the substrate) so the uncoated lens region registers with the substrate hole or window It is also worth noting that since the device only exhibits the optical effect when viewed from one side, it is not especially advantageous to apply over a window region and indeed it could be applied over a non-windowed substrate. Similarly, in the context of a polymer substrate, the device is well-suited to arranging in half-window locations.

The invention claimed is:

1. A security device, comprising:

an array of focussing elements with periodicity in at least a first direction, each focusing element having an optical footprint of which different portions will be directed to a viewer in dependence on a viewing angle; and an array of image elements with periodicity in at least the first direction overlapping the array of focusing structures, the image elements representing portions of at least two respective images, and at least one image element from each respective image being located in the optical footprint of each focusing structure;

wherein the security device includes a first region and a second region which is laterally offset from the first, the image elements in the first region being laterally shifted in at least the first direction relative to the image elements in the second region such that, at a first viewing angle, in the first region of the device the focussing structures direct image elements corresponding to a first image to the viewer such that the first image is displayed across the first region of the device, and simultaneously, in the second region of the device, the focussing structures direct image elements corresponding to a second image to the viewer such that the second image is displayed across the second region of the device, and at a second viewing angle the second image is displayed across the first region of the device and simultaneously the first image is displayed across the second region of the device, and the security device further comprises a colour filter located in use between the image elements and the viewer, the colour filter overlapping at least part of the array of focussing elements and the array of image elements, and having a first colour in the first region of the device and a different colour in the second region of the device such that a colour appearance of the first and second images is different in the respective first and second regions of the device, and wherein the colour filter is formed at least in part by the focussing elements of the focussing element array having different colours from one another in the respective first and second regions of the device, or the colour filter is formed at least in part by a pedestal layer provided between the focussing element array and a surface of a substrate on which the focussing element array is located, the pedestal layer comprising at least first and second transparent materials of different colours from one another in the respective first and second regions of the device, or the colour filter is formed at least in part by an image base layer provided between the image array and a surface of a substrate on which the image array is formed, the image base layer comprising at least first and second transparent materials of different colours from one another in the respective first and second regions of the device, or the colour filter is formed at least in part by an intermediate layer spaced from both the focussing element array and from the image array.

2. A security device according to claim 1, wherein the image array comprises a set of monochromatic image elements corresponding to the first image in the first and second regions of the device.

3. A security device according to claim 2, wherein the monochromatic image elements are either opaque; or semi-transparent or translucent.

4. A security device according to claim 3, wherein the monochromatic image elements are semi-transparent or translucent and a colour of the monochromatic image elements either is different from the colours of the colour filter in both the first and second regions of the device; or matches the colour of the colour filter in one of the first and second regions of the device.

5. A security device according to claim 1, wherein the image base layer is a tic-coat formed of curable materials for affixing the image array to the substrate.

6. A security device according to claim 1, wherein the colour filter comprises at least two colour filter layers provided at different spacings from the focussing element array and/or from the image array which are laterally offset.

7. A security device according to claim 1, wherein the security device is formed as a security thread, strip, foil, insert, label or patch.

8. An article provided with a security device according to claim 1.

9. A security device, comprising:

an array of focussing elements with periodicity in at least a first direction, each focusing element having an optical footprint of which different portions will be directed to a viewer in dependence on a viewing angle; and a corresponding first image array overlapping the array of focussing elements and configured to co-operate with the array of focussing elements so as to generate a first optically variable effect which varies with viewing angle, the first image array comprising a periodic arrangement of image elements or microimages formed in a first colour across the security device, wherein the security device further comprises a colour filter located in use between the first image array and the viewer, the colour filter overlapping at least part of the array of focussing elements and the first image array, and having different colours in respective first and second regions of the device which are laterally offset from one another, the colour of the colour filter layer in the first region of the device matching the first colour of the image elements or microimages, and wherein the colour filter is formed at least in part by the focussing elements of the focussing element array having different colours from one another in the respective first and second regions of the device, or the colour filter is formed at least in part by a pedestal layer provided between the focussing element array and a surface of a substrate on which the focussing element array is located, the pedestal layer comprising at least first and second transparent materials of different colours from one another in the respective first and second regions of the device, or the colour filter is formed at least in part by an image base layer provided between the image array and a surface of a substrate on which the image array is formed, the image base layer comprising at least first and second transparent materials of different colours from one another in the respective first and second regions of the device, or the colour filter is formed at least in part by an intermediate layer spaced from both the focussing element array and from the image array.

10. A security device according to claim 9, wherein in the first region of the device the image elements or microimages are concealed from view by the matching colours of the image elements or microimages and the colour filter, such that the first optically variable effect is exhibited in the second region and not in the first region.

11. A security device according to claim 9, further comprising a second image array overlapping the array of focussing elements and configured to co-operate with the array of focussing elements so as to generate a second optically variable effect which varies with viewing angle, the second image array comprising a periodic arrangement of image elements or microimages formed in a second colour across the security device.

12. A security device according to claim 11, wherein the colour of the colour filter layer in the second region of the device matches the second colour of the image elements or microimages.

13. A security device according to claim 12, wherein in the second region of the device the image elements or microimages are concealed from view by the matching colours of the image elements or microimages and the colour filter, such that the second optically variable effect is exhibited in the first region and not in the second region.

14. A security device, comprising:

an array of focussing elements with periodicity in at least a first direction, each focusing element having an optical footprint of which different portions will be directed to a viewer in dependence on a viewing angle; and a corresponding first image array overlapping the array of focussing elements and configured to co-operate with the array of focussing elements so as to generate a first optically variable effect which varies with viewing angle, the first image array comprising a periodic arrangement of image elements or microimages formed in a first colour across the security device, wherein the security device further comprises a colour filter located in use between the first image array and the viewer, the colour filter overlapping at least part of the array of focussing elements and the first image array, and having different colours in respective first and second regions of the device which are laterally offset from one another, the colour of the colour filter layer in the first region of the device being complementary to the first colour of the image elements or microimages, and wherein the colour filter is formed at least in part by the focussing elements of the focussing element array having different colours from one another in the respective first and second regions of the device, or the colour filter is formed at least in part by a pedestal layer provided between the focussing element array and a surface of a substrate on which the focussing element array is located, the pedestal layer comprising at least first and second transparent materials of different colours from one another in the respective first and second regions of the device, or the colour filter is formed at least in part by an image base layer provided between the image array and a surface of a substrate on which the image array is formed, the image base layer comprising at least first and second transparent materials of different colours from one another in the respective first and second regions of the device, or the colour filter is formed at least in part by an intermediate layer spaced from both the focussing element array and from the image array.

15. A security device, comprising:

an array of focussing elements with periodicity in at least a first direction, each focusing element having an optical footprint of which different portions will be directed to a viewer in dependence on a viewing angle; and a corresponding first image array overlapping the array of focussing elements and configured to co-operate with the array of focussing elements so as to generate a first optically variable effect which varies with viewing angle, the first image array comprising a periodic arrangement of image elements or microimages formed in a first colour across the security device;

wherein the security device further comprises:

a colour filler located in use between the first image array and the viewer, the colour filter overlapping at least part of the array of focussing elements and the first image array, and having different colours in respective first and second regions of the device which are laterally offset from one another; and a backing layer located behind the first image array such that the first image array is between the colour filter and the backing layer, the backing layer comprising at least two laterally offset areas of different colour, the backing layer being visible at least between the image elements or microimages in the first image array.

16. A security device according to claim 15 wherein either two of the differently coloured areas of the backing layer correspond to the first and second regions of the device respectively; or at least two of the differently coloured areas of the backing layer are located in each of the first and second regions of the device.

17. A method of forming an image array for a security device, the image array comprising a pattern of at least one first curable material, the method comprising:

(i) providing a die form, the die form having a surface comprising an arrangement of raised areas and recessed areas defining the pattern;

(ii) applying the at least one first curable material to the surface of the die form such that said at least one first curable material fills the recessed areas;

(iii) bringing a pattern support layer in contact with the surface of the die form such that it covers the recessed areas;

(iv) separating the pattern support layer from the surface of the die form such that the first curable material in the recessed areas is removed from said recessed areas and retained on the pattern support layer in accordance with the pattern; and (v) during and/or after step (ii), at least partly curing the first curable material in one or more curing steps; wherein the method further comprises either:

(ii') after step (ii) and before step (iii), covering the surface of the die form and the recessed areas filled with the at least one first curable material with a tie coat comprising at least two tie coat curable materials arranged in respective laterally offset areas; or (ii") before step (iii), applying to the pattern support layer the tie coat comprising the at least two tie coat curable materials arranged in the respective laterally offset areas;

step (v) further comprises at least partly curing the at least two tie coat curable materials such that in step (iv) the tie coat and the at least one first curable material are retained on the pattern support layer; and the at least two tie coat curable materials have different optical detection characteristics from one another, whereby the image array comprises a background to the pattern of the at least one first curable material, formed by the tie coat, the background having different appearances in the respective laterally offset areas.

* * * * *